US007021021B2

(12) United States Patent
Saldana

(10) Patent No.: US 7,021,021 B2
(45) Date of Patent: Apr. 4, 2006

(54) CONNECTORS, TRACKS AND SYSTEM FOR SMOOTH-FACED METAL FRAMING

(76) Inventor: Eluterio Saldana, 1691 A Kamamalu Ave., Honolulu, HI (US) 96813

( * ) Notice: Subject to any disclaimer, the term of this patent is extended or adjusted under 35 U.S.C. 154(b) by 0 days.

(21) Appl. No.: 10/642,031

(22) Filed: Aug. 14, 2003

(65) Prior Publication Data

US 2004/0049993 A1 Mar. 18, 2004

Related U.S. Application Data

(62) Division of application No. 10/046,127, filed on Jan. 9, 2002, now Pat. No. 6,609,344.

(60) Provisional application No. 60/334,283, filed on Nov. 21, 2001.

(51) Int. Cl.
*E04B 2/00* (2006.01)

(52) U.S. Cl. ..... 52/696; 52/715; 52/712; 52/243; 52/655.1

(58) Field of Classification Search ..... 52/696, 52/712, 715, 655.1, 243, 289, 92.1, 93.1, 52/737.06, 481.1, 481.2, 653.1, 653.2, 731.3, 52/702, 731.4, 731.8, 731.9, 733.2
See application file for complete search history.

(56) References Cited

U.S. PATENT DOCUMENTS 3,020,602 A * 2/1962 Siering ..... 52/714
3,184,800 A * 5/1965 Nelson ..... 403/219
3,423,898 A * 1/1969 Coloney et al. ..... 52/713
3,615,110 A * 10/1971 Fugate ..... 403/230
3,845,601 A 11/1974 Kostecky
3,877,193 A 4/1975 Hall
4,021,988 A 5/1977 Edeus et al.
4,093,167 A 6/1978 Rooklyn
4,527,375 A * 7/1985 Braginetz ..... 52/712

(Continued)

*Primary Examiner*—Carl D. Friedman
*Assistant Examiner*—Chi Q. Nguyen
(74) *Attorney, Agent, or Firm*—Seth M. Reiss

(57) ABSTRACT

A novel system for constructing smooth-faced metal framing and novel connectors therefore. The system and connectors of the present invention utilize metal framing members or wall studs that demonstrate a U-channel configuration having a base, sidewalls, and marginal lips that extend inward from the sidewalls, and similarly configured framing tracks having a recessed channel along the sidewalls thereof. A variety structurally related connectors, comprising at least a connector body, lip and base flange are described. These connectors are capable of interconnecting metal framing members and tracks performing all framing functions including, without limitation, floor and ceiling joists, top and bottom plates, roof rafters, roof rims, window sills, trusses, headers and wall studs. The connectors lock into place within the member or track and are secured from the inside using fasteners applied into the non-surface aspects of the stud. The stud connectors demonstrate three dimensional rigidity and a box-like fit within the metal framing members or tracks to form joints that are strong, durable and precise. The framing system using the stud connectors of the present invention leaves the outside surfaces of the framing members and tracks smooth and continuous, without protruding fastener heads or interruptions of any sort. The resulting smooth outside surfaces can be covered much more easily and inexpensively than the uneven and generally awkward outside surfaces presently encountered in metal framed structures. The manner in which the connectors lock within the members and tracks promote their safe and efficient installation. The system and connectors of the present invention enables an entire structure to be framed using one type and size of metal framing member or track cut to appropriate lengths on site.

20 Claims, 38 Drawing Sheets

U.S. PATENT DOCUMENTS

| | | | | | |
|---|---|---|---|---|---|
| 4,835,935 | A | | 6/1989 | Murphy | |
| 5,189,857 | A | * | 3/1993 | Herren et al. | 52/317 |
| 5,325,651 | A | * | 7/1994 | Meyer et al. | 52/715 |
| 5,394,665 | A | | 3/1995 | Johnson | |
| 5,625,995 | A | * | 5/1997 | Martin | 52/715 |
| 5,685,121 | A | | 11/1997 | DeFrancesco et al. | |
| 5,797,233 | A | * | 8/1998 | Hascall | 52/481.1 |
| 5,953,876 | A | | 9/1999 | Agar | |
| 6,079,181 | A | | 6/2000 | Ruff | |
| 6,176,053 | B1 | | 1/2001 | St. Germain | |
| 6,189,277 | B1 | | 2/2001 | Boscamp | |
| 6,199,341 | B1 | | 3/2001 | Carlin et al. | |
| 6,237,300 | B1 | | 5/2001 | Carne et al. | |
| 6,260,318 | B1 | | 7/2001 | Herren | |
| 6,301,854 | B1 | | 10/2001 | Daudet | |
| 6,374,558 | B1 | * | 4/2002 | Surowiecki | 52/241 |
| 6,430,890 | B1 | * | 8/2002 | Chiwhane et al. | 52/715 |

* cited by examiner

CONNECTORS, TRACKS AND SYSTEM FOR SMOOTH-FACED METAL FRAMING

CROSS-REFERENCE TO RELATED PATENT APPLICATIONS

This is a (fourth) division of U.S. non-provisional application Ser. No. 10/046,127, filed Jan. 9, 2002 now U.S. Pat. No. 6,609,344, and granted on Aug. 26, 2003, which application is based in substantial part upon and claims the benefit of U.S. Provisional Application No. 60/334,283 filed Nov. 21, 2001.

STATEMENT REGARDING FEDERALLY SPONSORED RESEARCH OR DEVELOPMENT

The subject invention is not the result of or in any way related to federally sponsored research or development.

BACKGROUND OF INVENTION

1. Field of Invention

The present invention relates to materials and methods for metal framing. In particular, this invention describes an improved system of metal framing that employs specially configured connectors and tracks that leave the faces of the resulting framed structure smooth and easy to cover.

This fourth divisional application claims a species of structurally related connectors having a connector body, base flange and lip flange and a method wherein the connectors demonstrate three dimensional rigidity and a box-like fit within the metal framing studs to form joints that are strong, durable and precise.

2. Description of the Prior Art

Framing in metal, both when building out commercial spaces and when erecting entire structures, is becoming more and more common. Metal framed structures provide an advantage over traditional wood framed structures in terms of reduced construction time, increased strength, decreased weight, decreased flammability, and increased resistence to degradation and damage from rot or pests, particularly termites. Using metal as opposed to wood for framing is also environmentally friendly as it slows the depletion of hardwood forests.

Probably the best known and most prevalent method of framing in metal involves the use of metal channeling, typically rolled from sheet steel and sometimes aluminum. These metal framing members or studs, often used to erect and reinforce commercial and residential structures, are channels having a substantially U-shaped cross section with a broad base and narrow sides of uniform height. To enhance the stud or framing member's strength and rigidity, the edges of the sides of the U-channel component are bent over to form lips parallel to the plane of the U-channel base.

The outside dimensions of the metal framing members and studs, and the weight or gauge of the member or stud, vary. Typically the members are fabricated to be approximately 4 inches wide by 2 inches deep, corresponding thereby to the width and depth of wood framing and stud members, in which case the lips may extend ¼ to ½ inch from the sides of the studs. Eighteen to 20 gauge metal may be used for light gauge, residential construction and commercial wall construction. A heavier range of metal gauge is used in some residential and commercial framing and particularly in multiple story commercial construction.

With the increased popularity of metal framing there has developed a variety of methods for connecting and securing metal frames and wall studs. At the most basic level, metal studs are inserted into and secured within metal tracks by drilling and screwing, from the outside wall of the track into an adjoining metal stud. This method of track and stud interconnection, commonly encountered when framing interior walls of residential and commercial buildings, leaves screw heads protruding from what would be an otherwise smooth track and stud surfaces. Also according to the track and stud model familiar to the construction industry, the tracks are wider than the studs. The resulting frame is rough and discontinuous rather than smooth and continuous.

Similarly, commercially available devices for interconnecting metal framing members, as for example tie brackets, shear connectors and plate connectors, require the use of screws and bolts that are applied from the outside of the track or stud member inwards. The heads of such fasteners, like the screw heads in the above example, protrude and interrupt the smooth continuous frame exterior. Building codes often time require the use of heavy duty fasteners, having larger heads, in order that the resulting structure is more likely to withstand a hurricane. The resulting discontinuous surface renders the job of finishing over the metal frame more difficult, more time consuming, and more expensive.

It is a primary object of the present invention to provide a system for interconnecting metal framing members, tracks and studs that can employ a member or stud of uniform dimension and that results in a frame having a smooth, continuous outer surface, devoid of protruding fasteners heads, facilitating the easy, quick and inexpensive application of wall covering and wall surfaces.

Many known methods of interconnecting metal framing members and studs require fasteners to be applied from the outside of the member or stud, inward. When erecting and securing the outside frame of a multiple story building, the construction worker performing this task must either extend his or her upper body outside from the building, or work from outside scaffolding or ladders.

It is a further object of the present invention to provide a system of interconnecting metal framing members in which fasteners are applied from the inside of the members outward, allowing the members to be secured by workers working entirely from within the building.

Metal studs and framing members have been modified to include saw or punch slots, tabs and brackets intended to facilitate the interconnection of these studs and framing member to adjoining studs and framing members and/or to cross-bars and other non-framing members that serve to reinforce the studs and framing members. Such modifications increase the cost of stud manufacture. Also because these slots and tabs must be stamped or cut during fabrication, or factory modified following their initial fabrication, this method of interconnecting framing members requires the use of members or studs of predetermined length.

It is a further object of the present invention to provide a system of interconnecting metal framing members, tracks and studs that does not require the framing members, tracks or studs to be specially machined, tooled or configured, and that allows the framing members, tracks and studs to be cut to length on site and as needed.

Framing members that are secured one to the other by screws applied from the outside, and known methods for interconnection involving plate, bracket and tie connectors, typically secure the framing members in one dimension only. Securing framing members in one dimension leaves the resulting structure more vulnerable to forces applied in the area of the joined members from the second and third, unprotected, directions.

It is a further object of the present invention to provide a method of interconnecting metal framing members, tracks and studs in at least two, and often three, dimensions for additional strength and durability.

Known connectors, including bracket, plate and tie connectors, presently used to tie together and interconnect metal studs, are generally drilled and screwed on site. Drilling and screwing unsecured connectors pose a safety risk to the worker since the connectors tend to be small and light, and thus easily grabbed and spun by a hand drill.

It is a further object of the claimed invention to provide connectors for interconnecting metal framing members and studs that interlock within the framing members, tracks and studs that can be screwed and secured safely on site, without significant risk that the connector will be grabbed and spun by a powered drill or bit.

BRIEF SUMMARY OF THE INVENTION

These and other objects are accomplished according to the present invention, a system for interconnecting metal framing members, tracks and studs by way of a variety of novel connectors and tracks. The connectors are specially configured and designed to fit within and interlock with the framing members, tracks and studs. The connectors serve to secure one member, track or stud to another member, track or stud, by fasteners applied from within the connector outwards into the non-surface aspects of the member, track or stud. The tracks are specially configured to utilize the novel connectors of the present invention to interconnect with other tracks or studs using fasteners applied from both the inside out, and the outside in, in three dimensions, while still leaving the surface aspects of tracks and studs free of fastener heads or other protrusions.

The novel system of the subject invention employs traditional U-channel shaped framing members or studs, made of sheet steel or aluminum. According to the system, the U-channel members comprise many or all framing components for commercial and residential construction as, for example, wall studs, tracks, headers, hips, floor joists, ceiling joists, roof trusses, fascia, stud blocking, etc. The framing members or studs are tied together by a collection of more than twenty-eight structurally related metal connectors specially configured and grooved to interlock within the familiar U-channel framing member. These novel connectors are secured to the studs using fasteners, typically self-tapping screws, inserted from within the connectors, through the connectors, and outward into the adjoining member or stud.

Because the securing fasteners are inserted from the inside out, into the non-surface aspects of the framing member, track or stud, rather from the outside surface aspects of the framing member in as is practiced currently, the exterior surface of the frame is left continuous and smooth, without interruption or protrusion. Wall or surfacing material, as for example drywall or plaster, can thus be applied more easily, less expensively, and with better results as compared with covering presently encountered metal framing. Also, because the securing fasteners are inserted and fasten the members to the connector, and to each other, in at least two dimensions, compared with only one as is taught by the prior art, the novel method and connectors of the present invention result in stronger, more durable, metal frames.

The novel tracks of the present invention are similar to the traditional U-channel framing member discussed above but include recessed channels along their surface aspects. Like the stud members, the tracks can be used to comprise many or all framing components, but more typically would be used in conjunction with the traditional stud to frame a structure. When used with the connectors of the present invention, fasteners are applied from the outside of the track through the recessed channels formed within the surface aspects and into the connectors that have been placed and locked into position within the track. When additional fasteners are applied from the connector outward into the non-surface aspects of the track, the track is tied to another track, or to a stud member, in three dimensions while still leaving the frame surfaces smooth and continuous.

Most of the connectors of the present invention are termed "universal" in that they may be applied to join studs and tracks that form all manners and functions of framing members. Some of the connectors are specially designed to join studs and tracks comprising specific framing components. Many of the universal connectors are easily modified for specialized framing applications.

The metal framing system of the present invention is safer and easier to employ than presently known systems of metal framing. Because fasteners are applied substantially or entirely from the inside out, and not from the outside in, workers securing the U-channel framing members according to the present system can work from the safety of the inside of the building and need not dangle their torso out from the building interior or work from scaffolding or ladders when securing elevated exterior frame members. Also, because many of the connectors are specially configured to interlock within the tracks and stud members, the connectors can be screwed and secured more easily and without the risk that the connector will be grabbed and spun by power drill.

Since one size and shape of metal stud and/or track can be used to form all framing components, a complete residential or commercial structure can be framed, or the entire interior of a building built out, using the single dimensioned U-channel framing member and/or U-channel framing track and a variety of novel connectors of the present invention sized to interlock with the stud member and track. Because the stud members and tracks are of uniform dimension, the outside surface of the resulting frame will be continuous and easy and inexpensive to cover. Also, because the ends of the stud members or tracks do not need to be slotted, grooved or tabbed for interconnection, the members and tracks do not need to be delivered in pre-determined lengths but can simply be cut on-site to needed lengths. Thus framing according to the system of the subject invention allows for a greater degree of customization, and erecting metal frames with greater precision, compared with the currently known systems of metal framing.

Further objects and advantages of this invention will become apparent from consideration of the drawings and ensuing description.

DETAILED DESCRIPTION OF THE PREFERRED EMBODIMENTS

Prior Art Framing Members

Figure 1:
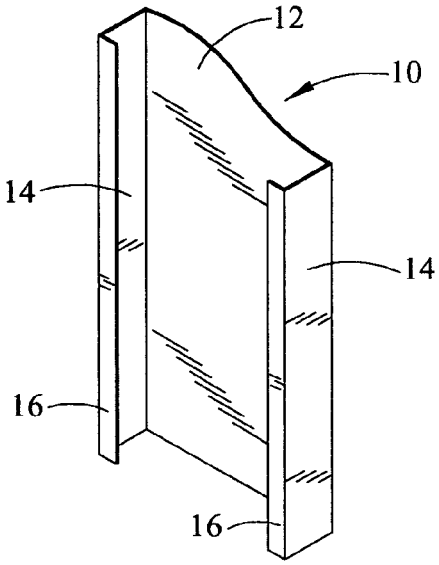
FIG. 1 is a perspective view of a U-channel framing member or stud.

A conventional U-channel metal framing member or stud 10 is shown in FIG. 1. Framing member 10 comprises abase 12, two sidewalls 14 which extend perpendicular from base 12, and two lips 16 which extend inward from the tops of sidewalls 14 perpendicular thereto and parallel to base 12.

Member 10 can be of any length, width and depth. Typically member 10 will have a width defined by the width of base 12 that is at least twice its depth defined by the width of sidewalls 14. When substituting for 2"×4" framing lumber, member 10 will have sidewalls 14 of approximately 2 inches in width and base 12 of approximately 4 inches in width. Lips 16 in this case will extend approximately ⅛ to ½ inch inward from sidewalls 14, although other depths are also possible.

Member 10 is rolled from steel or aluminum, but could be made of any metal, including stainless steel. The weight and strength of member 10 will be determined by its gauge, which will vary depending upon the intended use; heavy gauge for the most demanding industrial uses and lighter gauge for residential and some commercial uses. The use of members 10 having gauges outside these limits are possible without departing from the scope and objects of the subject invention.

In the method of the present invention, framing member 10 comprises many, most or all major components of the frame of a commercial or residential structure, as for example floor joists, ceiling joists, roof rafters, jack rafters, headers, blocking, top and bottom plates, roof ridges, roof trusses, window sills, wall studs, etc., in the construction and build-out of single and multi-story structures.

Universal Right Angle Stud Connectors

Figure 2:
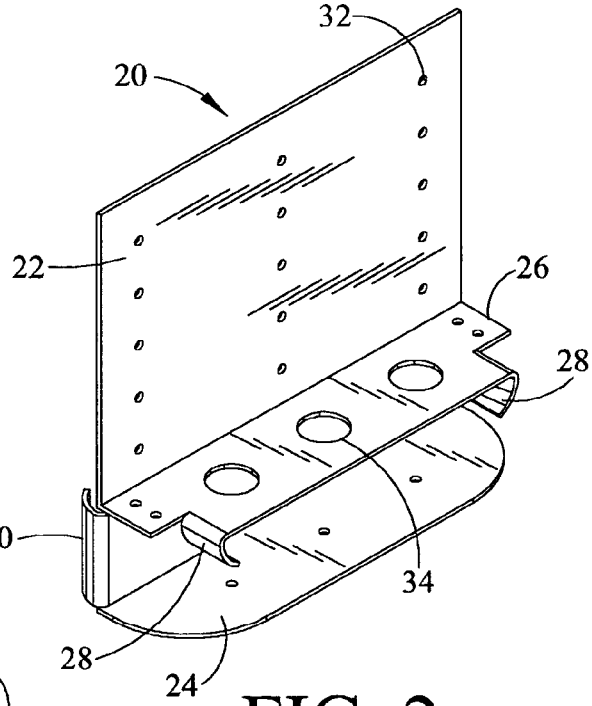
FIG. 2 is a perspective view of the front side of a snap-in right angle stud connector of the present invention.

FIG. 2 depicts in perspective view the front side of a universal snap-in right angle stud connector 20 of the present invention specially configured to interconnect framing members 10 (shown in FIG. 1), at right angles, one to the other, without leaving fasteners protruding from the sidewalls 14 of said members 10. Universal right angle stud connector 20 is comprised of a brace plate 22 rectangular in shape, a base flange 24 which extends from the bottom of brace plate 22 perpendicular thereto, and a rectangular lip flange 26 in spaced apart relation to base flange 24 extending out from brace plate 22 along a plane parallel to base flange 24. In the case of right angle stud connector 20, base flange 24 is substantially rectangular with radius cut outside corners whereas the outside corners of lip flange 26, which is also substantially rectangular, are squared.

The ends of lip flange 26 are split midway along its width and the resulting outside end rectangles of flange 26 are bent downward and inward to form U-shaped locking clips 28. Rectangular tabs which extend out from the bottom of brace plate 22, between base flange 24 and lip flange 26, are similarly bent back and inward to form two U-shaped support tabs 30 (only one of which is seen in FIG. 2). A plurality of pre-drilled holes 32, designed to receive fasteners, are formed in parallel series along the length of brace plate 22, along the inside ends of lip flange 26, and along the length of base flange 24. A plurality of access cutouts 34, that permit access to base flange 24 by power drills and hand tools, are formed along the length of lip flange 26.

Figure 3:
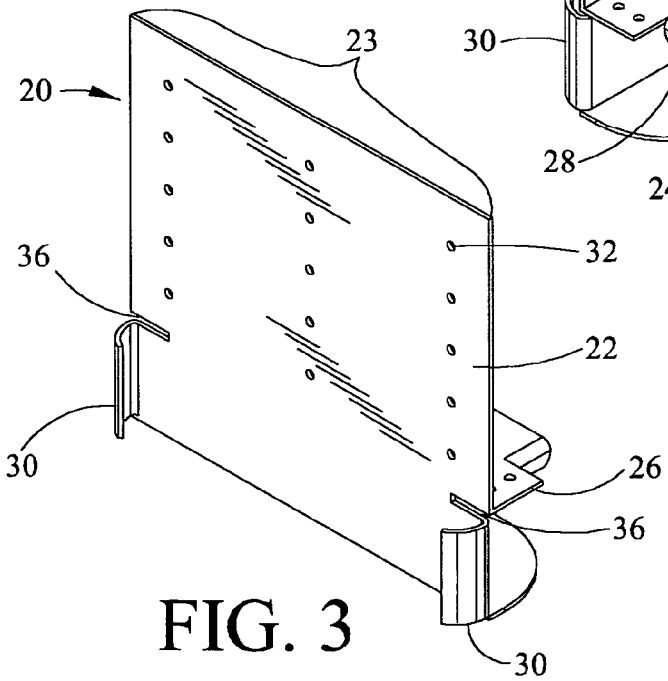
FIG. 3 is a perspective view of the back side of the snap-in right angle stud connector shown in FIG. 2.

FIG. 3 illustrates the universal snap-in right angle stud connector 20 shown in FIG. 2 from behind. Support tabs 30 can now be seen extending from the bottom of both sides of brace plate 22. Pre-drilled holes 32 extend down the length of brace plate 22 only until where lip flange 26 extends from the front side thereof. Two lip receiving grooves 36 are cut in from the sides of brace plate 22, perpendicular thereto, immediately below where the bottom of lip flange 26 extends from the front side thereof and immediately above where the top of support tabs 30 extend from the back side thereof.

As will be made clear in subsequent figures, right angle stud connector 20 is sized and configured to interlock inside framing member 10 (shown in FIG. 1) and interconnect one member 10 to another member 10. Accordingly, brace plate 22 of connector 20 demonstrates a width 23 that corresponds to the inside width of base 12 of framing member 10 (shown in FIG. 1). Similarly, lip flange 26 and brace plate 22 are spaced apart by a distance that corresponds to the width of sidewalls 14 of framing member 10 (shown in FIG. 1). Finally, lip receiving grooves 36 are formed to a depth sufficient to accommodate the width of lips 16 of member 10.

Universal right angle stud connector 20, like the other specially configured connectors described herein, is bent from a single piece of stamped sheet metal. The preferred metal for connector 20 and other connectors is galvanized steel, but stainless steel and other metals and metal alloys can be used with good results. The weight and thickness of connector 20 will be determined by the intended use, and will be fabricated from a gauge of metal appropriate to industry standards and applicable building codes.

Figure 4:
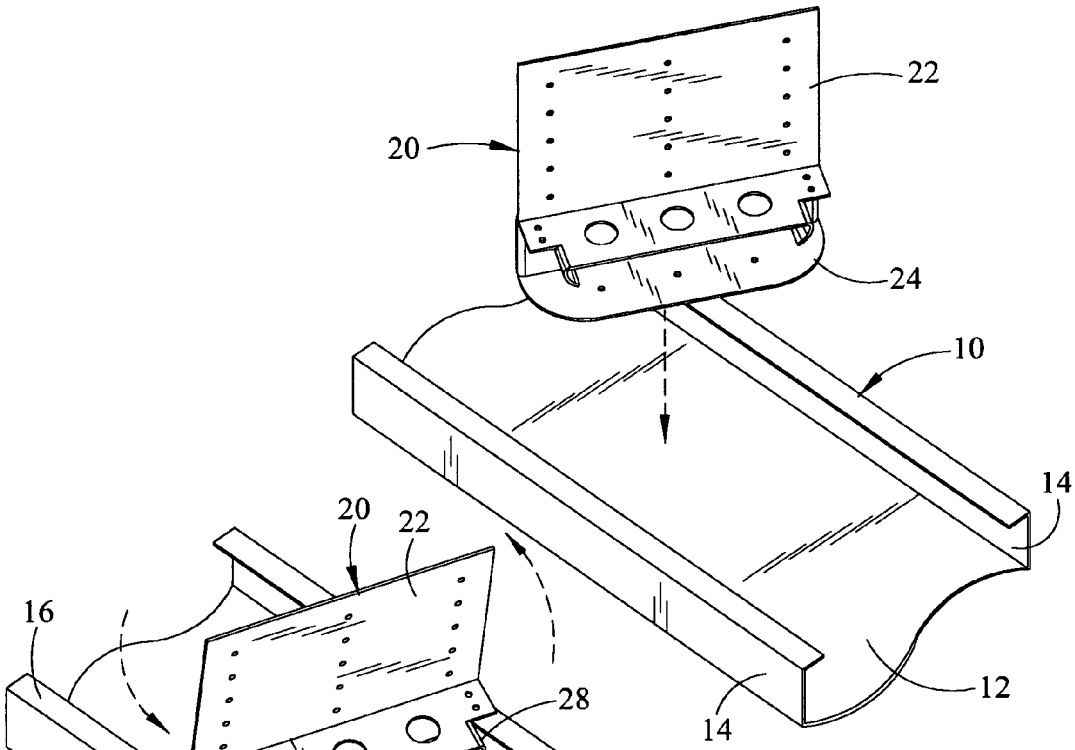
FIG. 4 illustrates in perspective view the manner of inserting the snap-in right angle stud connector into a first framing member.
Figure 5:
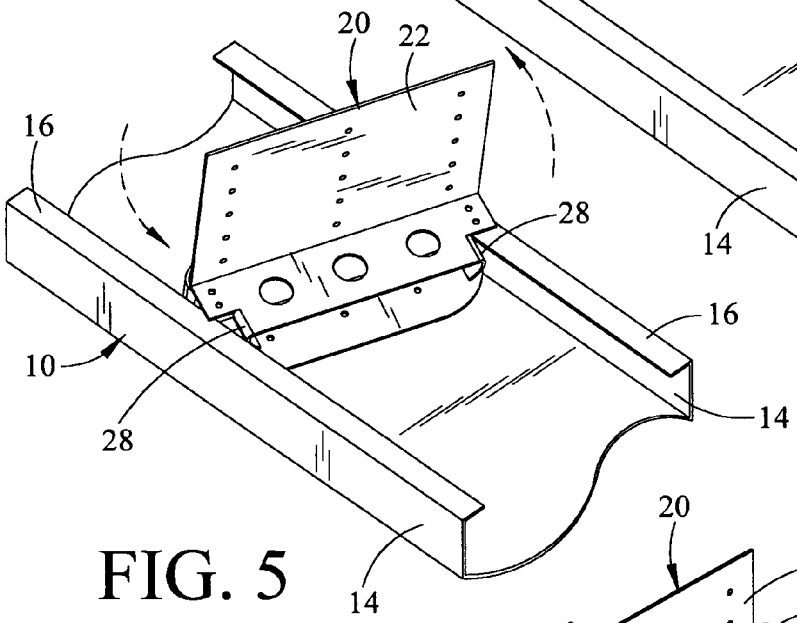
FIG. 5 further illustrates in perspective view the manner of inserting the snap-in right angle stud connector into the first framing member.
Figure 6:
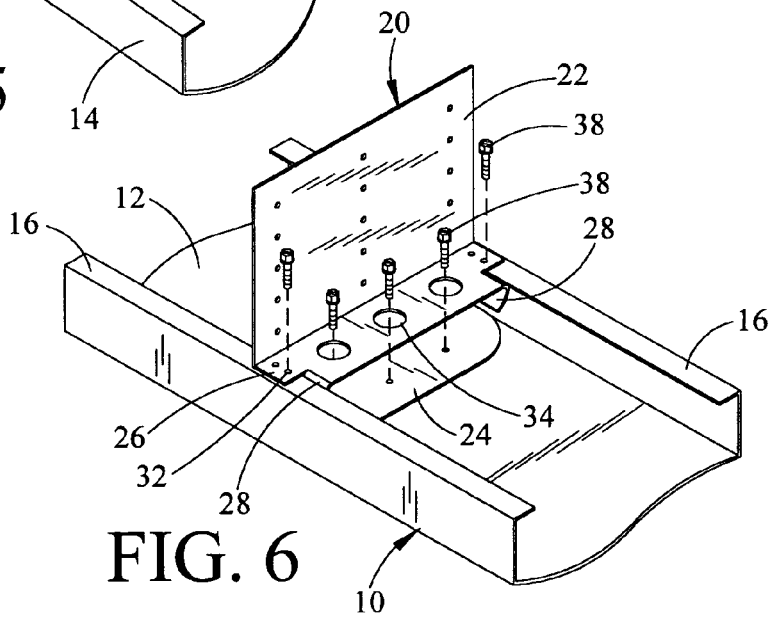
FIG. 6 shows in perspective view the snap-in right angle stud connector positioned and secured within the first framing member.

FIGS. 4 through 6 demonstrate the manner of insertion of universal snap-in right angle stud connector 20 into a first framing member 10. Referring to FIG. 4, connector 20 is inserted into the U-channel of member 10, base flange 24 first, with brace plate 22 generally perpendicular to base 12 of member 10 but angled and tilted, at the same time, relative to sidewalls 14 of member 10. Referring to FIG. 5, one end of connector 20 (as depicted, the near end) is inserted below one of the lips 16 of member 10 and the locking clip 28 on that side is engaged under the lip 16, while the other locking clip 28 (at the far end) remains just above the other lip 16. Connector 20 is then rotated (shown here counterclockwise) and at the same time tilted forward until the un-engaged locking clip 28 snaps into place under the adjacent lip 16 and brace plate 22 is perpendicular to sidewalls 14. Once in position as shown in FIG. 6, support tabs 30 (not shown) which extend from the back of brace plate 22 occupy the space between lips 16 and base 12, while locking clips 28 lock connector 20 in place by holding the ends of lip flange 26 firmly against the top surface of lips 16.

Still referring to FIG. 6, connector 20 is secured to first framing member 10 by applying a plurality of self-tapping screws 38 through the pre-drilled holes 32 formed at the ends of lip flange 26 and along the length of base flange 24 into lips 16 and base 12 of member 10, respectively. A power drill can be used through access cutouts 34 to access the top of base flange 24 and secure screws through base flange 24 into base 12.

Member 10 is not pre-drilled; rather connector 20 is secured to member 10 along any point of connector 10 that may be appropriate to the structure being framed. While the use of self-tapping screws 38 is recommended, other types of fasteners may be employed, including bolting, which would require drilling through framing member 10 after connector 20 has been snapped in place.

Because locking clips 28 hold connector 20 firmly in place at a specified point along the length of member 10, connector 20 can be secured to first member 10 by screwing, or drilling and bolting, with much greater facility as compared with connectors that need to be held in place by hand at the same time as screwing and drilling, and also much more safely, without the risk that the connector will become loose and be spun by the power drill or bit used to secure the connector. The facility provided by locking clips 28 and lip receiving groove 36 (shown in FIG. 3) holding connector 20 in place along first framing member 10 is more apparent when member 10 is positioned sideways or upside down, as it more often then not will be in the construction of a building frame.

Figure 7:
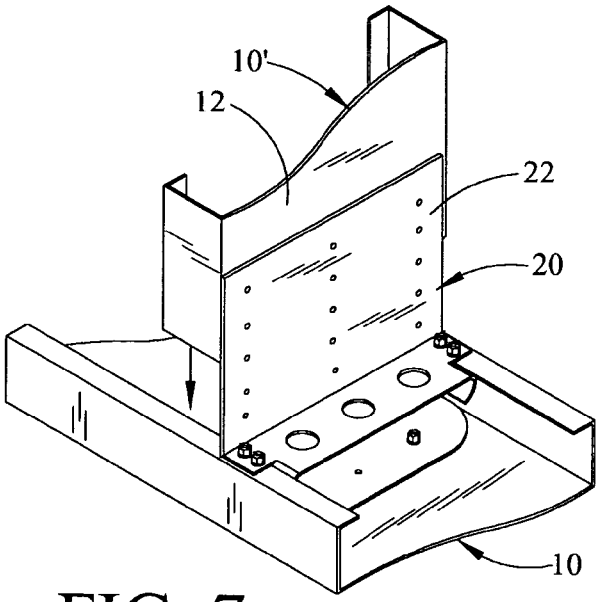
FIG. 7 illustrates in perspective view a second framing member being positioned for interconnection with the snap-in right angle stud connector.
Figure 8:
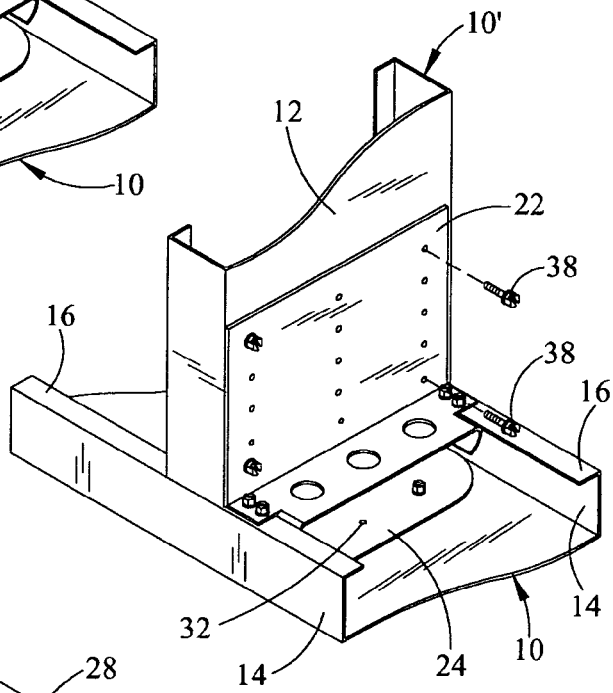
FIG. 8 shows in perspective view the snap-in right angle stud connector interconnecting a base plate and a wall stud.

The manner of positioning and securing a second framing member to universal snap-in right angle stud connector 20 is illustrated in FIGS. 7 and 8. Referring to FIG. 7, a second framing member 10' is positioned such that its base 12 lies along the back side of brace plate 22 of connector 20. According to the right angle interconnect configuration shown in FIG. 8, one end of second member 10' abuts lips 16 of first member 10 with its outside base 12 lying against the back top portion of brace plate 22. Referring now to FIG. 8, self-tapping screws 38 are applied through brace plate 22 into the bottom of base 12 of member 10'. As already discussed with reference to FIG. 6, member 10' is not pre-drilled and so member 10' may be positioned without regard to lining up drill holes. Rather it is the pre-drilled holes 32 in brace plate 22 that determines the points along base 12 that screws 38 penetrate, allowing for greater precision in positioning second member 10' relative to first member 10.

As will be appreciated from FIG. 8 and later figures showing interconnected framing members using the connectors described herein, members 10 and 10' are joined by connector 20 to form a secure joint having substantial strength without any fastener being applied to member sidewalls 14. Because sidewalls 14 form the outside surface of the framed structure, the connectors and system of the present invention leave the outside framed surface smooth, without projections, bumps or interruptions of any kind. Because the connectors and system of the present invention also promote precision framing, the outside framed surface is left continuous and true.

FIG. 8 illustrates universal snap-in right angle stud connector 20 interconnecting a second framing member 10' functioning as a wall stud and a first framing member 10 functioning as a bottom plate. When used in this manner, base flange 24 and bottom plate 10 are both secured to the building foundation (not shown) by applying an alternative fastener designed to anchor components into building foundations through pre-drilled holes 32. Second framing member 10' can alternatively be positioned such that its lips 16 abut brace plate 22 and self-tapping screws 38 are applied through brace plate 22 into lips 16 of member 10'.

Figure 9:
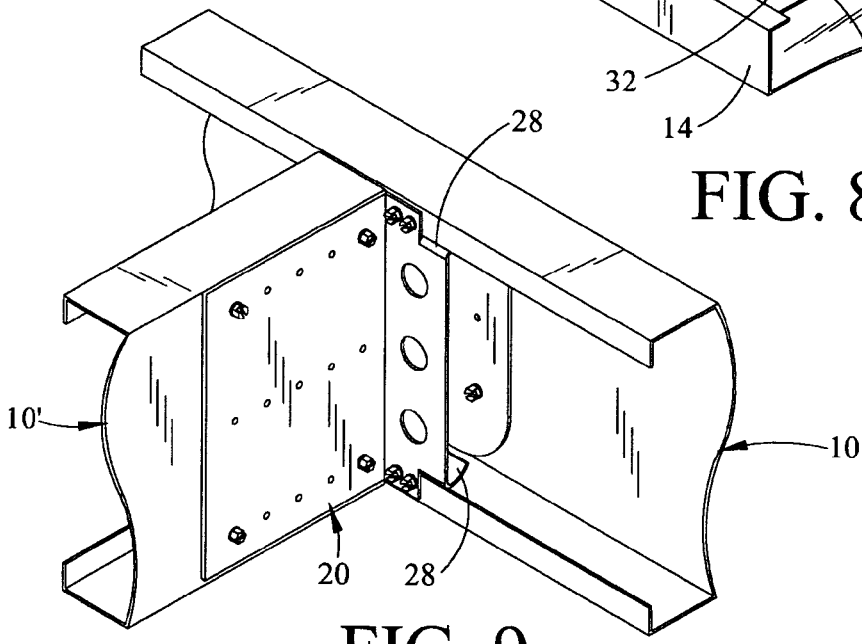
FIG. 9 is a perspective view of the snap-in right angle stud connector interconnecting a floor or ceiling joist and a rim joist.

FIG. 9 illustrates universal snap-in right angle stud connector 20 interconnecting a second framing member 10' functioning as, alternatively, a floor or ceiling joist with a first framing member 10 functioning as a rim joist. As discussed with reference to FIG. 6 above, locking clips 28 hold connector 20 firmly in place within first member 10 making the task of securing connector 20 within first member 10 easy and safe notwithstanding that first member 20 faces sideways. This is in contrast to conventional connectors that would need to be held up, in place, while being secured to a sideways facing first framing member.

Figure 10:
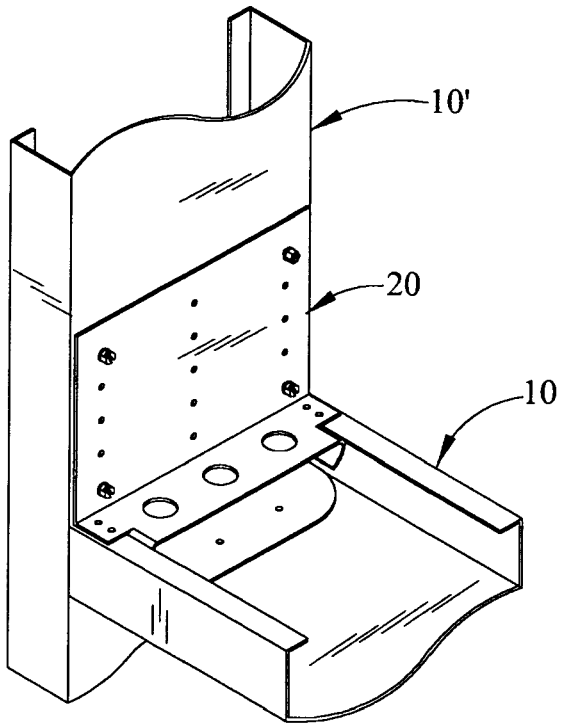
FIG. 10 is a perspective view of the snap-in right angle stud connector interconnecting a wall stud and a door or window header.

FIG. 10 illustrates the universal snap-in right angle stud connector used to interconnect second framing member 10' functioning as a wall stud with first framing member 10 functioning as a door or window header. Whereas in FIGS. 8 and 9, connector 20 was secured to first member 10 along its length and to second member 10' at one of its ends, in contrast in FIG. 10 connector 20 is secured to first member 10 at one of its ends and to second member 10' at an intermediate point along its length. Although not all possible configurations are shown, it will be appreciated by those skilled in the art of framing buildings that connector 20 can be inserted into first framing member 10 forward or backward, and can be secured to second framing member 10' right-side up or upside down. Connector 20 is termed "universal" because, like most of the other connectors of the present invention, connector 20 can be used in a variety of ways to interconnect most of the framing components in a building structure to form most of the joints encountered in a building structure.

Figure 11:
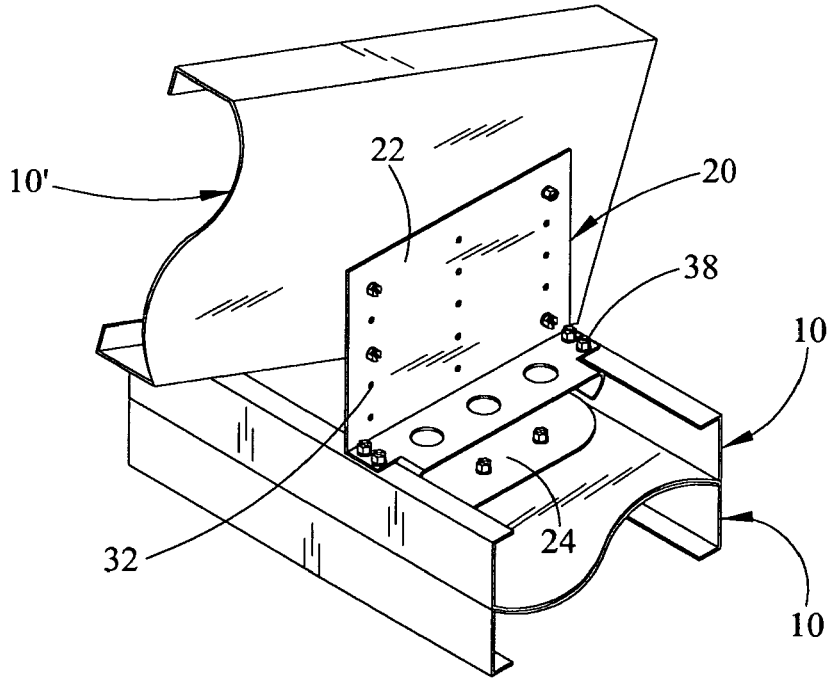
FIG. 11 is a perspective view of the snap-in right angle stud connector interconnecting a straight rafter and a wall top plate.

Connector 20's universal character is again illustrated in FIG. 11, which depicts connector 20 interconnecting a second framing member 10' functioning as a straight roof rafter with a first framing member 10 functioning as half of a top plate. The other half of the top plate is formed from an opposing member 10. Screws 38 which secure base flange 24 to first framing member 10 also traverse the opposing member 10 and secure the opposing members 10 one to the other.

Roof rafter 10' is secured to top plate 10 at some acute angle relative to the width of top plate 10 reflecting the pitch of the roof. Because second framing member 10' is secured at an angle, certain pre-drilled holes 32 do not overlap member 10' and will not receive self tapping screws 38. Notwithstanding, member 10' is adequately secured by fastening with screws 38 through more than half the holes 32 formed in brace plate 22.

Note that in the interconnect configuration shown in FIG. 11, both first and second framing member 10 and 10' are secured to connector 20 at intermediate points along their respective lengths further illustrating the universal nature of connector 20.

Universal snap-in right angle stud connector 20 can also be used to join any and all framing members which interconnect at right angles as well as those which, as illustrated in FIG. 11, interconnect at some angle other than 90 degrees. Though not shown here, connector 20 can be manufactured to accommodate and interconnect framing members which demonstrate compound angles one to the other.

Figure 12:
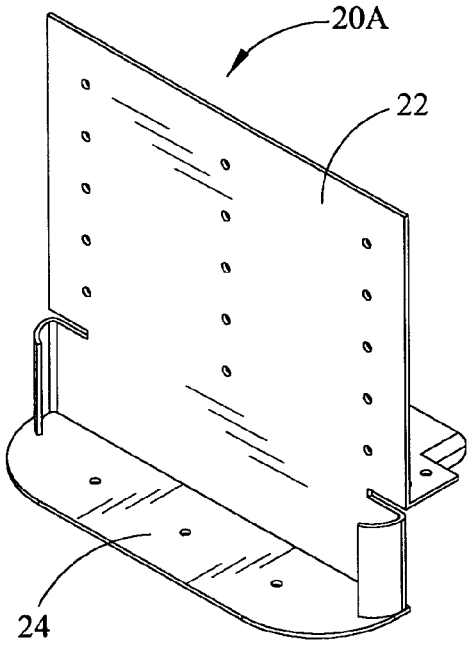
FIG. 12 is a perspective view of the back side of a snap-in right angle stud connector with reversed base flange.
Figure 13:
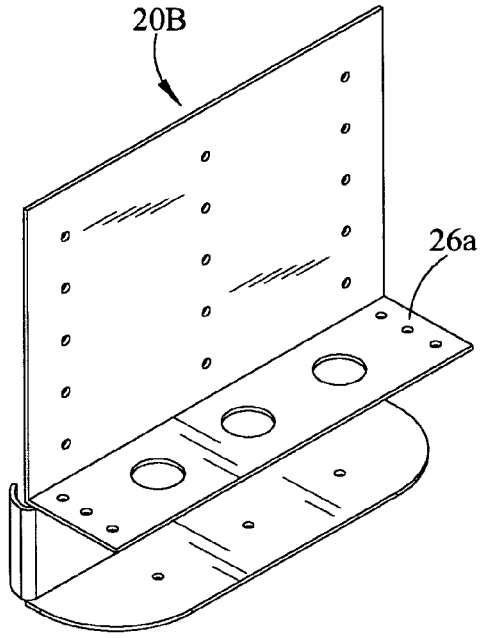
FIG. 13 is a perspective view of the front side of a snap-in right angle stud connector with straight lip flange.
Figure 14:
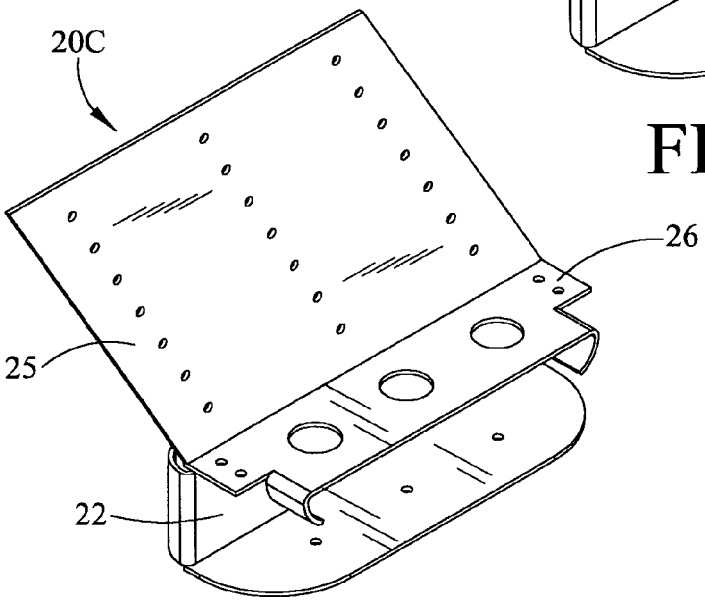
FIG. 14 is a perspective view of the front side of a snap-in right angle stud connector with angled brace plate for interconnecting ridge rafters.

FIGS. 12 through 14 illustrate alternative embodiments of universal snap-in right angle stud connector 20. Depicted in FIG. 12 is a snap-in right angle stud connector 20A with reverse base flange shown from the back. Universal right angle stud connector 20A is identical in all respects to universal right angle stud connector 20 except that base flange 24 of connector 20A extends backwards from the bottom of brace plate 22 instead of forwards as it does in connector 20. Connector 20A is used in the same manner, and to form most of the same types of joints, as connector 20.

A second alternative preferred embodiment of connector 20, a snap-in right angle stud connector 20B without locking clips, is illustrated in FIG. 13. Snap-in connector 20B is identical to snap-in connector 20 except that connector 20B exhibits a lip flange 26*a* substantially rectangle and continuous with squared outside corners and with no locking clips 28 attached. Not shown but nevertheless present are lip receiving grooves 36. Unlike the previously described universal right angle stud connectors, connector 20B does not lock in place within framing member 10 prior to screwing. Connector 20B is slightly easier to insert and typically cheaper to manufacture than the analogous connectors with locking clips 28.

Like connector 20, universal right angle stud connectors 20A and 20B can be used to join any and all framing members which interconnect at right angles as well as those which interconnect at some other angle and framing members which demonstrate compound angles one to the other.

Illustrated in FIG. 14 is a universal snap-in right angle rafter connector 20C, shown from the front. Right angle rafter connector 20C is identical to right angle stud connector 20 except that the top portion 25 of brace plate 22 which is flat (not bent), beginning where lip flange 26 extends out from brace plate 22, is substantially trapezoidal and not rectangular as in previously described universal right angle stud connectors. Not shown but nevertheless present are lip receiving grooves 36. When used to tie roof rafters to ridge joists or the like, top portion 25 is angled relative to the bottom portion of brace plate 22 to correspond to the angle of the pitch of the roof.

Though not shown, it will be appreciated by those skilled in the art of framing in general, and in the art of framing roofs in particular, that rafter connector 20C can be modified to accommodate jack rafters by bending top portion 25 of brace plate 22 back relative to its bottom portion such that the modified rafter connector 20C interconnects roof framing members at compound angles one to the other.

Figure 15:
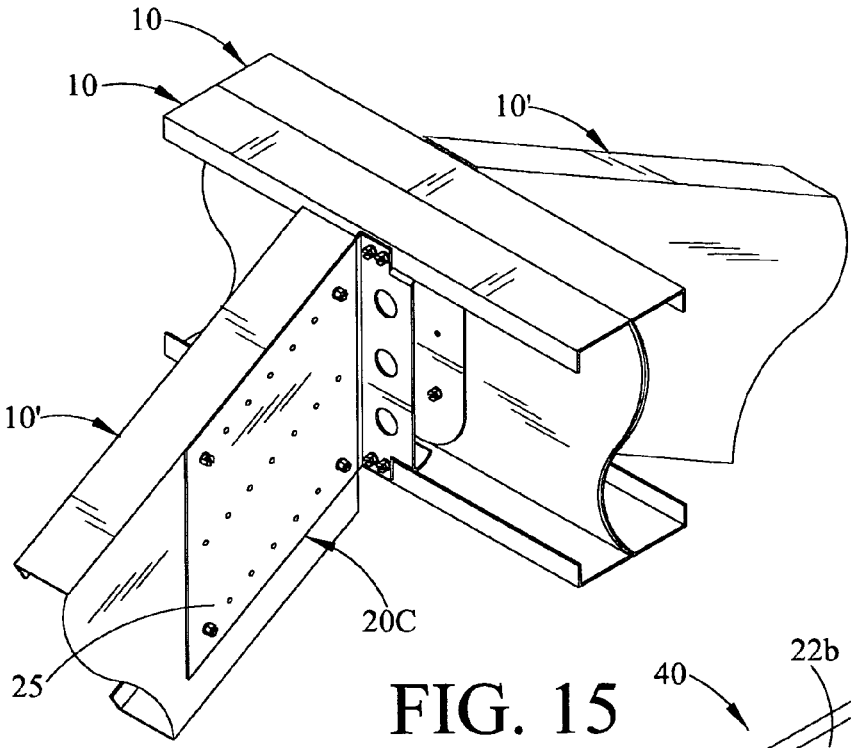
FIG. 15 is a perspective view of the rafter connector of FIG. 14 interconnecting a straight rafter with the roof ridge.

FIG. 15 illustrates universal rafter connector 20C interconnecting a second framing member 10' functioning as a straight roof rafter with a first framing member 10 functioning as half of a roof ridge. The other half of the roof ridge is formed from an opposing member 10 which in turn is interconnected with an opposing framing member 10' functioning as a roof rafter by another rafter connector 20C (not shown). Top portion 25 forms an angle relative to the bottom portion of brace plate 22 that corresponds to the angle roof rafter 10' demonstrates with respect to roof ridge 10. Roofs having different pitches require the employment of rafter connectors 20C with top portion 25 demonstrating different angles. Universal right angle rafter connector 20C can also be fabricated to interconnect rafters that demonstrate a compound angle relative to the framing member to which they attach, as for example in the case of joining a jack rafter as described above.

Universal Heavy Duty Right Angle Stud Connectors

Figure 16:
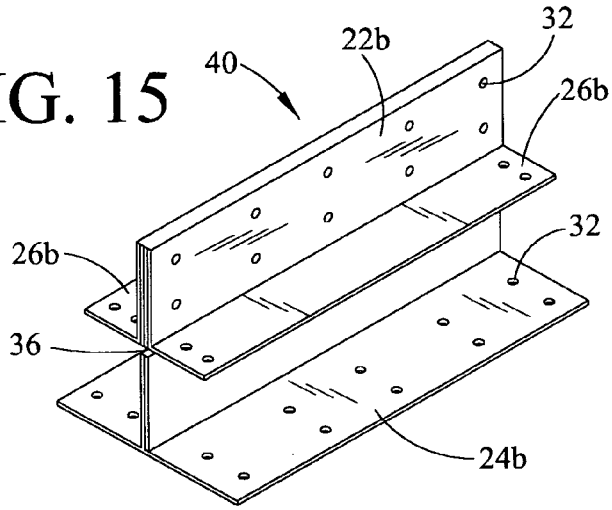
FIG. 16 is a perspective view of a slide-in heavy duty right angle stud connector.

Depicted in FIGS. 16 through 21 are alternative embodiments of universal heavy duty right angle stud connectors of the present invention and the manner of their use. Referring first to FIG. 16, a first preferred slide-in heavy duty right angle stud connector 40 is comprised of brace plate 22*b*, two opposed base flanges 24*b* which extend out from the bottom of brace plate 22*b* perpendicular thereto, and two opposed lip flanges 26*b* which extend out from brace plate 22*b* in spaced relation to base flanges 24*b* and parallel thereto. As with right angle stud connectors 20, the width of brace plate 22*b* corresponds to the inside width of base 12 of framing member 10 and base flanges 24*b* and lip flanges 26*b* are spaced apart by a distance that corresponds to the width of sidewalls 14 of framing member 10. Unlike the snap-in connectors 20, the outside edges of base flange 24*b* of slide-in connector 40 (and the other side-in connectors of the subject invention) are squared.

Pre-drilled holes 32 are formed in rows along the length of brace plate 22*b* and opposed base flanges 24*b*, and along the ends of opposed lip flanges 26*b*. Lip receiving grooves 36 (seen best in FIGS. 17 and 18) are formed in from each side of brace plate 22*b* immediately below and along where opposed lip flanges 26*b* extend from brace plate 42. Grooves 36 are cut to a depth sufficient to accommodate the width of lips 16 of member 10.

Connector 40, like connectors 20 and all the other connectors taught by the present invention, is manufactured by folding from a single piece of stamped sheet metal.

Figure 17:
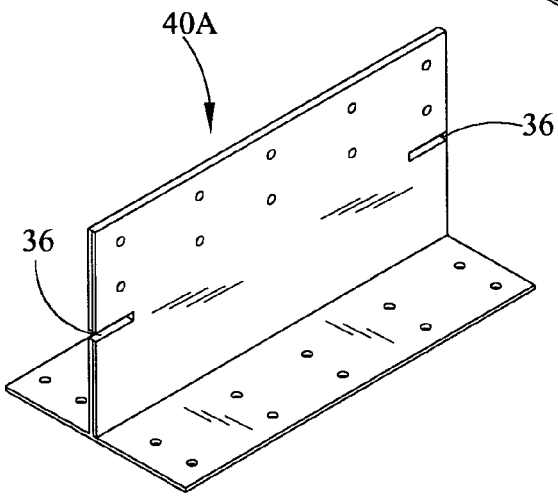
FIG. 17 is a perspective view of a slide-in heavy duty right angle stud connector without lip flange.
Figure 18:
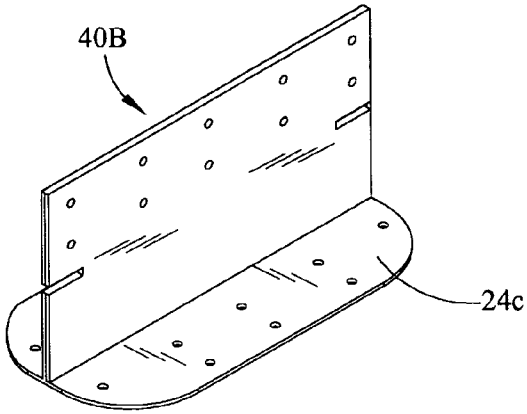
FIG. 18 is a perspective view of a snap-in heavy duty right angle stud connector without lip flange.

Depicted in FIG. 17 is a slide-in heavy duty right angle stud connector 40A. Heavy duty right-angle stud connector 40A differs from heavy duty connector 40 shown in FIG. 16 only in that it lacks lip flanges 26*b*. Depicted in FIG. 18 is a snap-on heavy duty right angle stud connector 40B. Heavy duty connector 40B differs from heavy duty connector 40A shown in FIG. 17 only in that the outside corners of the two opposed base flanges 24*c* are radius cut, as in the case of connectors 20 described above, allowing connector 40B to be snapped in rather than slid into first framing member 10.

Although not illustrated, a further embodiment of a heavy duty right angle stud connector 40 within the scope and intent of the present invention would comprise a connector 40 with opposed lip flanges 26*c* and opposed radius cut brace base flanges 24*c* that could be snapped into first framing member 10 and secured through lip flanges 26*c*. Also within the scope of the present invention are heavy duty right angle stud connectors 40 having brace plates 22*b* of greater or lesser height as strength needs may dictate.

Figure 19:
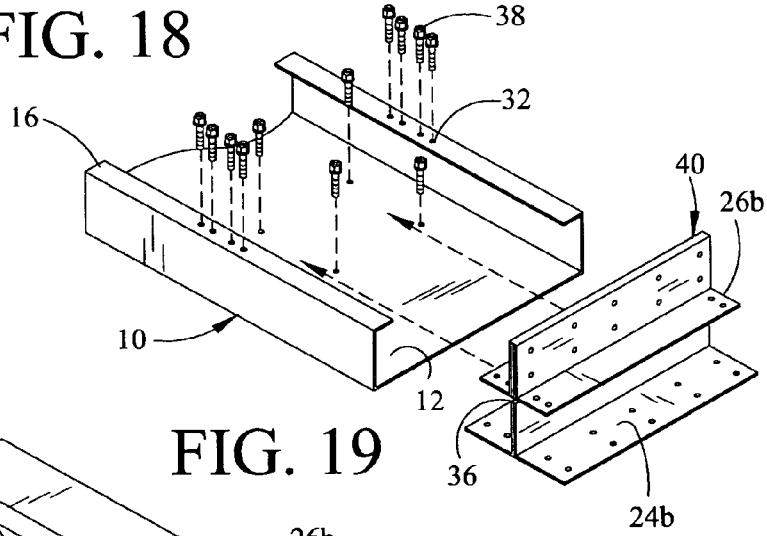
FIG. 19 is a perspective view of the manner of inserting the slide-in heavy duty right angle stud connector into a first framing member.

The manner of insertion of slide-in heavy duty connectors 40 (or 40A) into first framing member 10 is illustrated in FIG. 19. Because base flange 24*b* of connector 40 has squared corners, connector 40 cannot be snapped into first framing member 10 as could the previously described connectors having radius cut base flanges. Rather, connector 40 is slid into first framing member 10 from the end thereof such that lips 16 of member 10 are received into grooves 36 of connector 40, base flanges 24*b* rest on the inside surface of base 12 of member 10, and the bottom ends of lip flanges 26*b* rest on the top surface of lips 16. Once in position along member 10, heavy duty right angle stud connector 40 is secured by applying self-tapping screws 38 through pre-drilled holes 32 formed in lip flanges 26*b* and base flanges 24*c* into lips 16 and base 12, respectively, of member 10.

Figure 20:
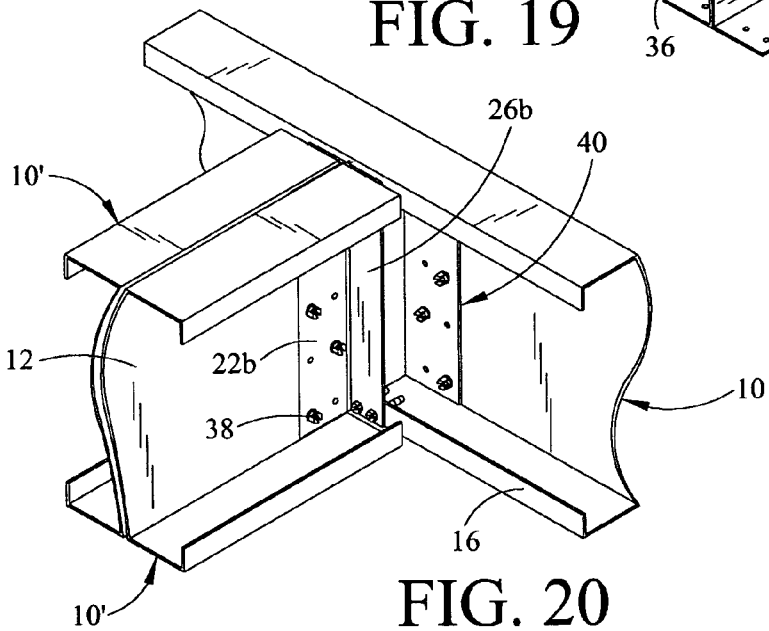
FIG. 20 is a perspective view of the slide-in heavy duty right angle stud connector interconnecting a floor or ceiling joist and rim joist.
Figure 21:
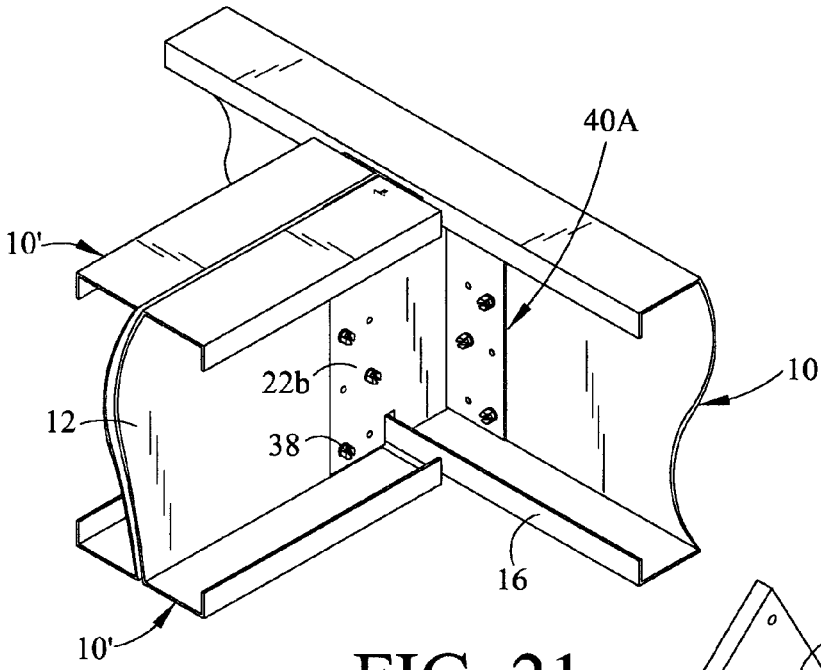
FIG. 21 is a perspective view of the slide-in heavy duty right angle stud connector without lip flange interconnecting a floor or ceiling joist and rim joist.

Slide-in heavy duty right angle stud connectors 40 and 40A are illustrated interconnecting floor or ceiling joists to rim joists in FIGS. 20 and 21. In both cases heavy duty connectors 40 and 40A are slid into, positioned on and secured to first framing member 10 functioning as a rim joist. Next the ends of opposed second framing members 10' are positioned to abut the side edges of lip flanges 26*b* in the case of connector 40, and to abut the lips 16 of member 10 in the case of connector 40A, with the inside of base 12 of one member 10' lying against the back of brace plate 22*b*. Brace plate 22*b* is secured to bases 12 of opposed second framing members 10' using screws 38. In FIG. 20, the side edges of lip flanges 26*b* can be seen sandwiched between the ends of second framing members 10' and the lips 16 of first framing member 10.

As demonstrated by FIGS. 20 and 21, heavy duty connectors 40 and 40A function identically except that the opposed lip flanges 26*b* extending from connector 40 but not 40A provide the resulting joint additional strength and stability. Connector 40A is somewhat simpler and less expensive to manufacture compared with connector 40. Snap-in heavy duty connector 40B, which is somewhat easier to use, may be essential in situations where an end of member 10 cannot be accessed.

Although heavy duty connectors 40A and 40B are illustrated here interconnecting a first framing member 10 to a second framing member 10', heavy duty connectors 40A and 40B (though not connector 40) are also useful to tie framing members 10 to hard surfaces including, for example, concrete and steel I-beams. In such cases the heavy duty connector (40A or 40B) is first secured to the hard surface by hard surface fasteners through the pre-drilled holes 32 in base flange 24*b* or 24*c* into the hard surface, after which framing member 10 is secured to connector 40A or 40B by applying screws 38 through brace plate 22*b* into base 12 of framing member 10.

Figure 22:
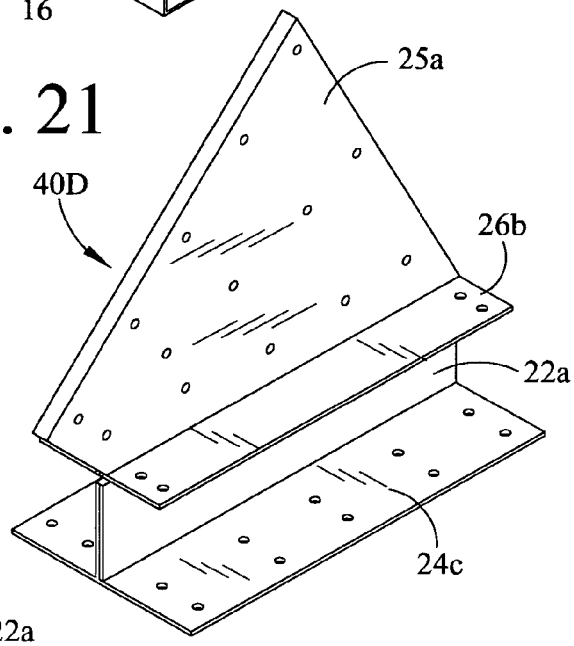
FIG. 22 is a perspective front view of a slide-in heavy duty rafter connector.
Figure 23:
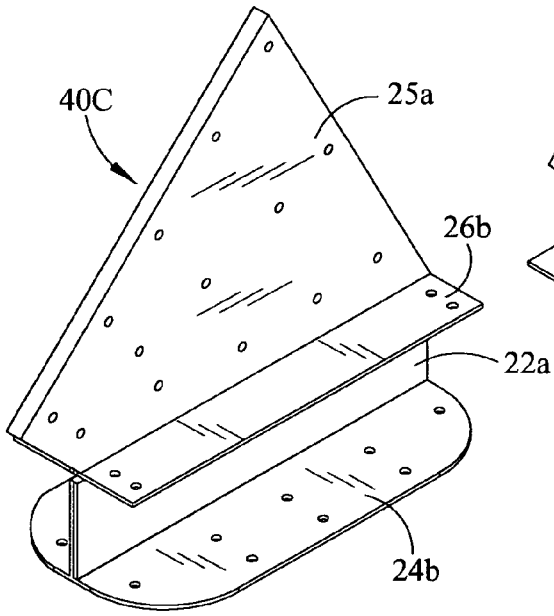
FIG. 23 is a perspective front view of a snap-in heavy duty rafter connector.

Illustrated in FIGS. 22 and 23 are two embodiments of heavy duty right angle rafter connectors. FIG. 22 shows a slide-in heavy duty right angle rafter connector 40D comprising a brace plate 22*a* having an angled top portion 25*a*, opposed lip flanges 26*b* (only one of which can be seen in FIG. 22), and opposed base flanges 24*c* with squared outside corners. FIG. 23 shows a snap-in heavy duty right angle rafter connector 40C comprising brace plate 22*a* with angled top portion 25*a*, opposed lip flanges 26*b* (only one of which can be seen in FIG. 23), and opposed base flanges 24*b* with radius cut outside corners.

Figure 24:
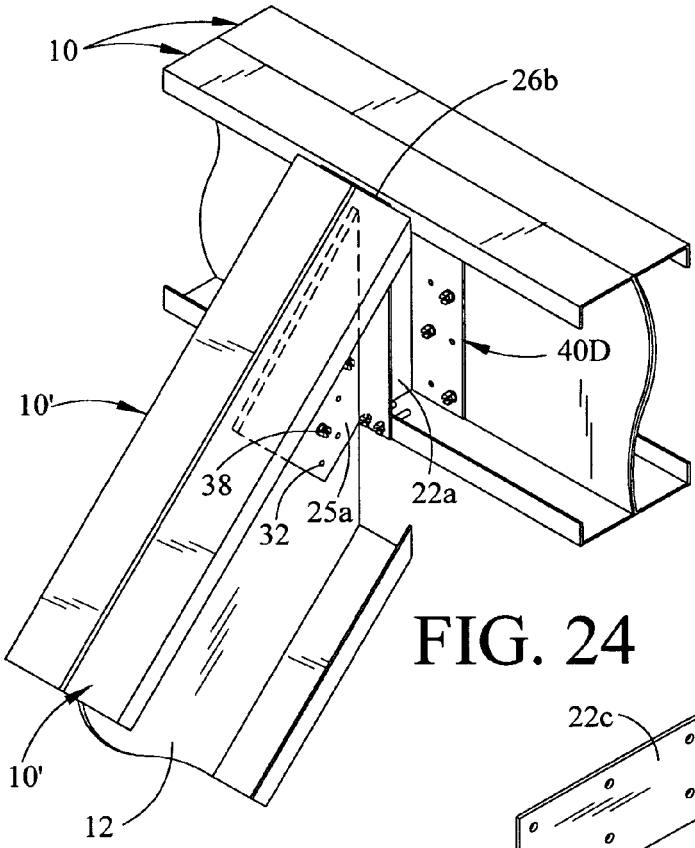
FIG. 24 is a perspective view of slide-in heavy duty right angle stud connector interconnecting a straight rafter to the roof ridge.

FIG. 24 illustrates slide-in heavy duty right angle rafter connector 40D in use to interconnect a roof rafter to a roof ridge. In the instance shown, the roof ridge is comprised of opposed first framing members 10 while the roof rafter is comprised of opposed second framing members 10'. Connector 40C is slid into the near first framing member 10 comprising the roof ridge and secured thereto. Second framing members 10' are positioned such that the end of the near member 10' abuts the top edges of lip flange 26*b* and the inside base 12 of member 10' lies against the back of angled top portion 25*a* of brace plate 22*a*. Brace plate 22*a* is secured to second members 10' by applying self-tapping screws 28 through the pre-drilled holes 32 formed in top portion 25*a*. Snap-in heavy duty rafter connector 40C is used similarly except that connector 40C can be inserted directly into position on first member 10 instead of being slid into position from the end of member 10.

As with right angle stud connectors 20, heavy duty right angle stud connectors 40 interconnect framing members 10 to form strong and durable joints while at the same time leaving sidewalls 14 of members 10 continuous and smooth, without fasteners or protrusions of any type, thereby allowing for the efficient and inexpensive application of wall coverings. Also like connectors 20, heavy duty right angle stud connectors 40 can be used to join any and all framing members which interconnect at right angles as well as those which interconnect at some other angle and framing members which demonstrate compound angles one to the other.

Universal Compact Right Angle Stud Connectors

FIGS. 25 through 36 illustrate a number of preferred embodiments of universal compact right angle stud connectors of the present invention and the manner of their use. While differing in detail from the right angle stud connectors described above, the compact right angle stud connectors comprise analogous components and function to join framing members in a corresponding manner.

Figure 25:
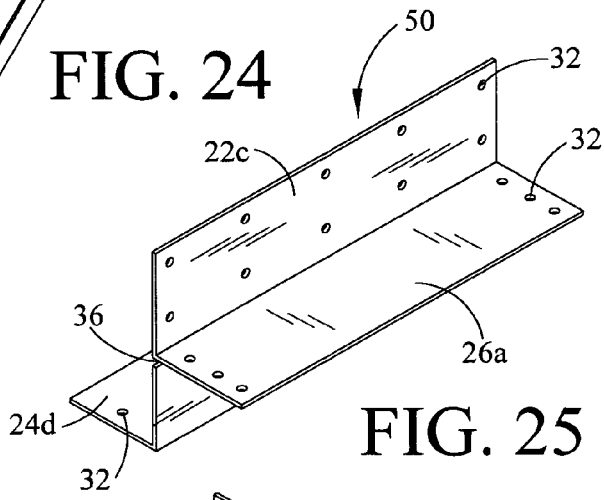
FIG. 25 is a perspective front view of a slide-in compact right angle stud connector.
Figure 26:
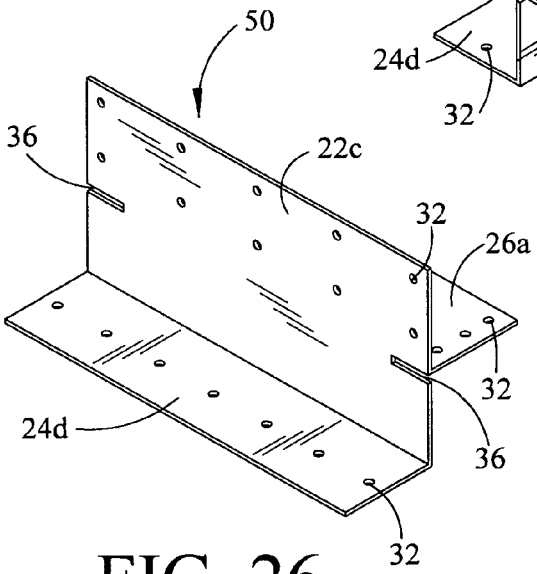
FIG. 26 is a perspective rear view of the slide-in compact right angle stud connector of FIG. 25.

Depicted in FIG. 25 from the front and in FIG. 26 from the rear is a universal slide-in compact right angle stud connector 50. Connector 50 comprises a brace plate 22*c*, a base flange 24*d* which extends backwards from the bottom of brace plate 22*c* perpendicular thereto, and a lip flange 26*a* which extends from the middle front of brace plate 22*c* perpendicular thereto. Groove 36 is formed in from the sides of brace plate 22*c* immediately below and along where lip flange 26*a* extends from brace plate 22*c*. Pre-drilled holes 32 are formed in series along the top portion of brace plate 22*c*, the length of base flange 24*d*, and the ends of lip flange 26*a*.

As with the other connectors, base flange 24*d* and lip flange 26*a* are spaced apart a distance that corresponds to the width of sidewalls 14 of framing member 10, and grooves 36 are cut to sufficient depth to accommodate the width of lips 16 of member 10. Also like the other connectors, compact right angle stud connector 50 is bent from a single piece of stamped sheet metal.

Figure 27:
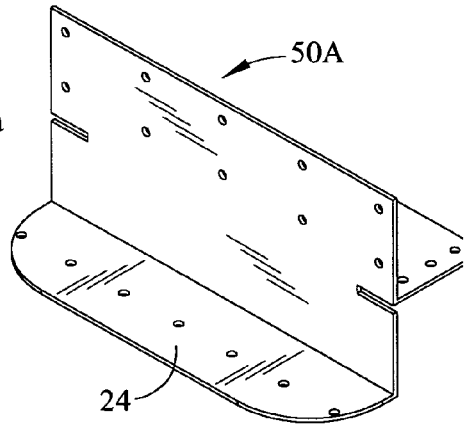
FIG. 27 is a perspective rear view of a snap-in compact right angle stud connector.

A universal snap-in compact right angle stud connector 50A is depicted in FIG. 27. Snap-in compact connector 50A is identical in all respects to slide-in compact connector 50 except that base flange 24 of connector 50A has radius cut outside corners allowing it to be inserted directly into position on first member 10. Slide-in connector 50, with base flange 24*d* having squared outside corners, must be slid into position from an end of first framing member 10.

Figure 28:
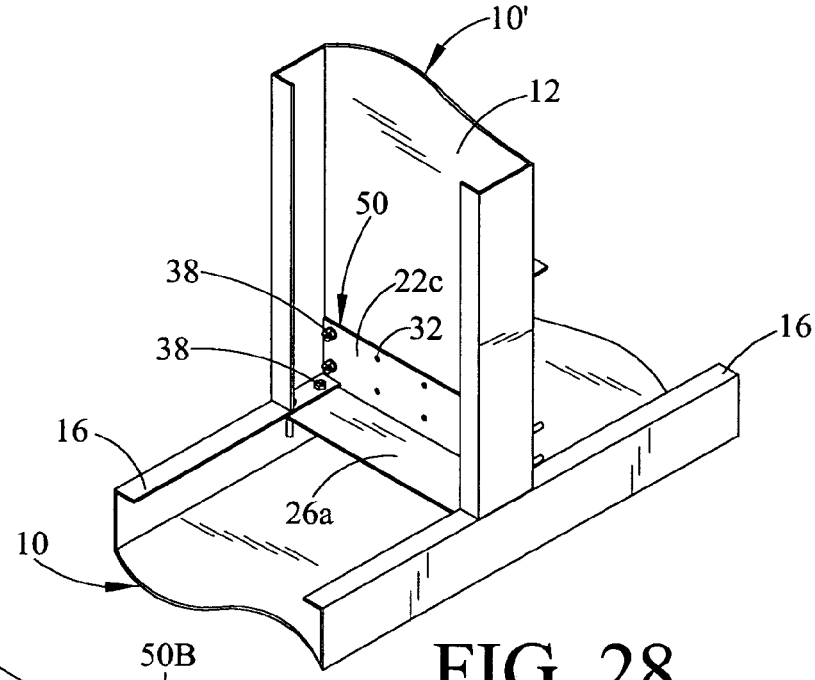
FIG. 28 is a perspective view of the slide-in compact right angle stud connector interconnecting two framing members.

Compact right angle stud connector 50 (or 50A) in use interconnecting second framing member 10' functioning as a wall stud with a first framing member 10 functioning, for example, as a top plate is shown in FIG. 28. Connector 50 is inserted by sliding from one end of first framing member 10 or, in the case of connector 50A, by twisting the connector into position on framing member 10, such that lips 16 of member 10 are received into grooves 36. Connector 50 (or 50A) is then secured to member 10 using screws 38 applied through lip flange 26*a* and base flange 24*d* (or in the case of connector 50A base flange 24) not shown. Second framing member 10' is positioned on connector 50 (or 50A) such that its end abuts lips 16 of member 10 and its base 12 (here the inside of base 12, but the outside would work as well) lies against the back side of brace plate 22*c*. Second member 10' is then secured to connector 50 (or 50A) through the application of screws 38 through pre-drilled holes 32 formed in brace plate 22*c*.

It will be appreciated by those skilled in the art that having base flange 24 and lip flange 26*a* extend from opposing sides of brace plate 22*c*, rather than from the same side as is the case in most of the previously described connectors, provides joints formed by compact connector 50 (and 50A) with additional strength in selective directions.

Figure 29:
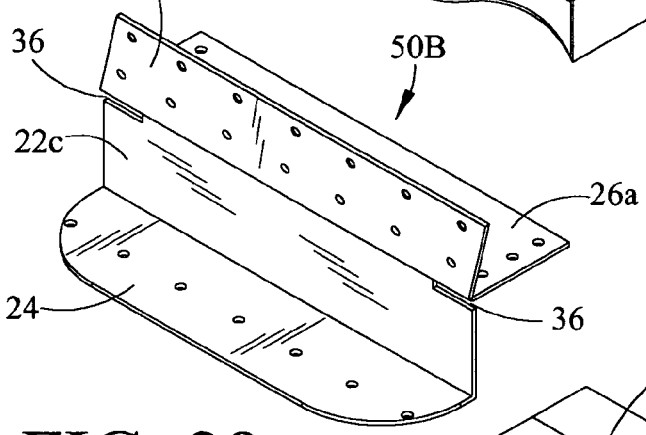
FIG. 29 is a perspective rear view of a snap-in compact straight rafter connector with angled brace plate.
Figure 30:
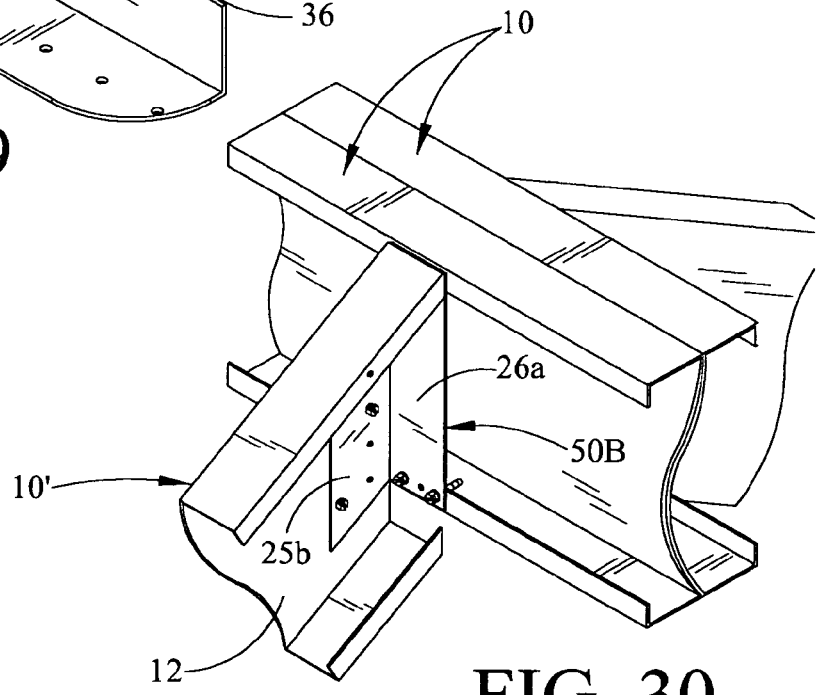
FIG. 30 is a perspective view of the snap-in compact straight rafter connector in use to interconnect a straight rafter and roof ridge.

A universal snap-in compact roof rafter connector 50B is shown from the rear in FIG. 29 and shown in use in FIG. 30. Referring to FIG. 29, rafter connector 50B is comprised of a brace plate 22*c* that is flat (not bent) having an angled top portion 25*b*, a base flange 24 with radius cut outside corners extending backwards from the bottom of brace plate 22*c*, a lip flange 26*a* extending forward from the middle of brace plate 22*c*, and lip receiving grooves 36 cut in from the sides of brace plate 22*c* directly below and along where lip flange 26*a* extends out from brace plate 22*c*. Referring to FIG. 30, compact roof rafter connector 50B is used by twisting it into position on a first framing member 10 which, together with an opposed framing member 10 forms a roof ridge, securing rafter connector 50B to member 10, positioning second framing member 10' functioning as a roof rafter such that the base 12 of member 10' lies adjacent to angled top portion 25*b* and the end of member 10' abuts lip flange 26*a* of connector 50B, after which member 10' is secured.

Figure 31:
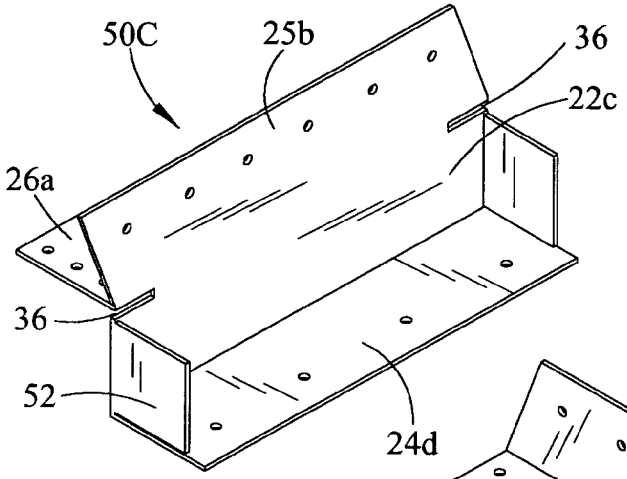
FIG. 31 is a perspective top view of a slide-in compact straight rafter connector.
Figure 32:
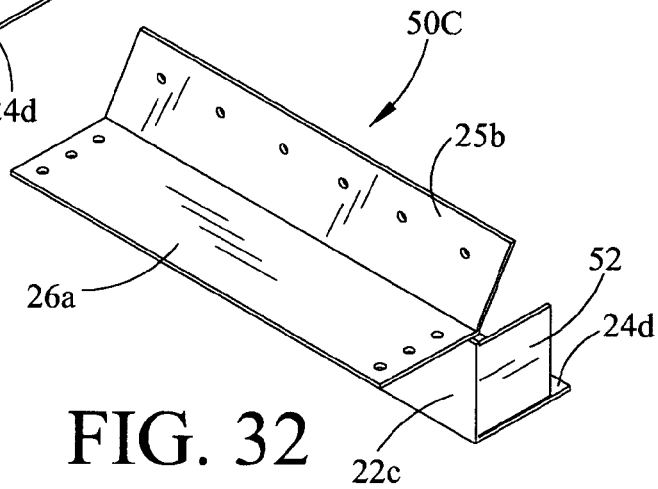
FIG. 32 is a perspective bottom view of the slide-in compact straight rafter connector.

A universal slide-in compact roof rafter connector 50C is shown from the top in FIG. 31 and from the bottom in FIG. 32. Roof rafter connector 50C is identical to roof rafter connector 50B except that the base flange 24*d* of rafter connector 50C has outside corners that are squared, requiring that it be slid rather than snapped into position, and rafter connector 50C has two walls 52, square in shape, extending out from the each end of the bottom portion of brace plate 22*c* and perpendicular thereto. Groove 36 which, as in previous connectors, is formed immediately below where lip flange 26*a* extends out from brace plate 22*c*, is in connector 50C immediately above where walls 52 extend.

Figure 33:
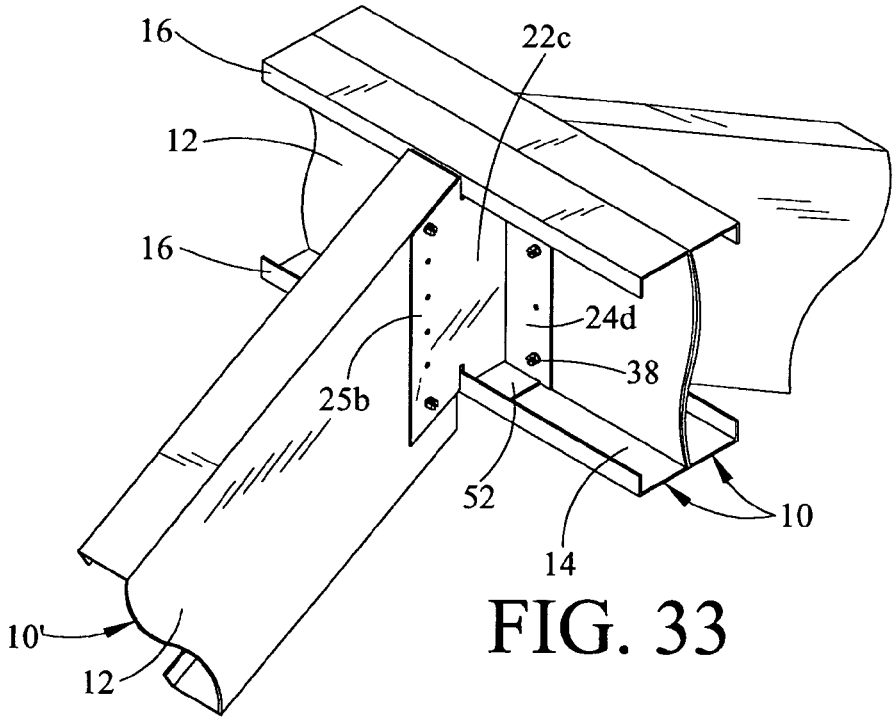
FIG. 33 is a perspective view of the slide-in compact straight rafter connector interconnecting a straight rafter and roof ridge.

FIG. 33 shows slide-in compact roof rafter connector 50C in use to join a roof rafter comprised of second framing member 10' to a roof ridge comprised of opposed first framing members 10. Rafter connector 50C is slid into position on first member 10 from the end thereof, with connector walls 52 lying adjacent to the inside of sidewalls 14 of member 10 and spanning the width of sidewalls 14. Connector 50C is secured to member 10 by applying screws 38 through base flange 24*d* and lip flange 26*a* into the base 12 and lips 16, respectively, of first member 10. Second member 10' is then positioned such that base 12 of member 10' lies adjacent to the front of angled top portion 25*b* of brace plate 22*c* and the end of member 10' abuts lip flange 26*a*. Second member 10' is secured to rafter connector 50C by applying screws 36 through the pre-drilled holes 32 formed in top portion 26*b* of brace plate 22*c*.

It will be appreciated that although rafter connector 50B is shown in FIG. 30 as attaching to the inside of base 12 of second member 10' while rafter connector 50C is shown in FIG. 33 as attaching to the outside of base 12 of second member 10', connector 50B can equally be secured to the outside base 12 of member 10' and connector 50C to the inside base 12 of member 10'. It will also be appreciated by those knowledgeable about the industry that a compact roof rafter connector having a base flange 24 with radius cut outside corners and walls 52 can be used with similar success and results and is within the scope and objects of the present invention.

Figure 34:
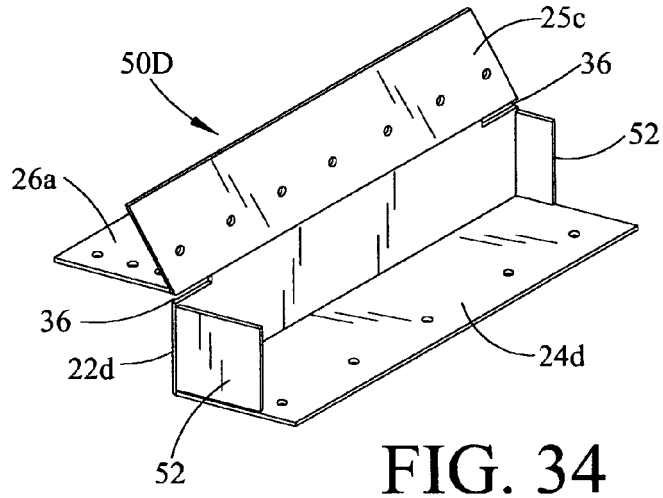
FIG. 34 is a perspective top view of a slide-in compact jack rafter connector.
Figure 35:
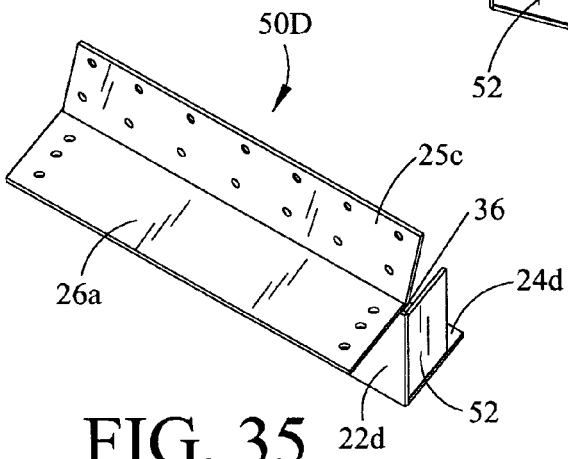
FIG. 35 is a perspective bottom view of the slide-in compact jack rafter connector.

A universal slide-in compact jack rafter connector 50D is illustrated from the top in FIG. 34 and from the bottom in FIG. 35. Jack rafter connector 50D is comprised of a brace plate 22*d* having a top portion 25*c* thereof. Top portion 25*c* is angled to be trapezoidal in shape in the same manner as in the roof rafter connectors previously described. Unlike in the roof rafter connectors, however, top portion 25*c* is also bent forward, towards lip flange 26*a*, along the line from which lip flange 26*a* extends. Jack rafter connector 50D also includes base flange 24*d* with squared outside corners, connector walls 52 and lip receiving grooves 36.

Figure 36:
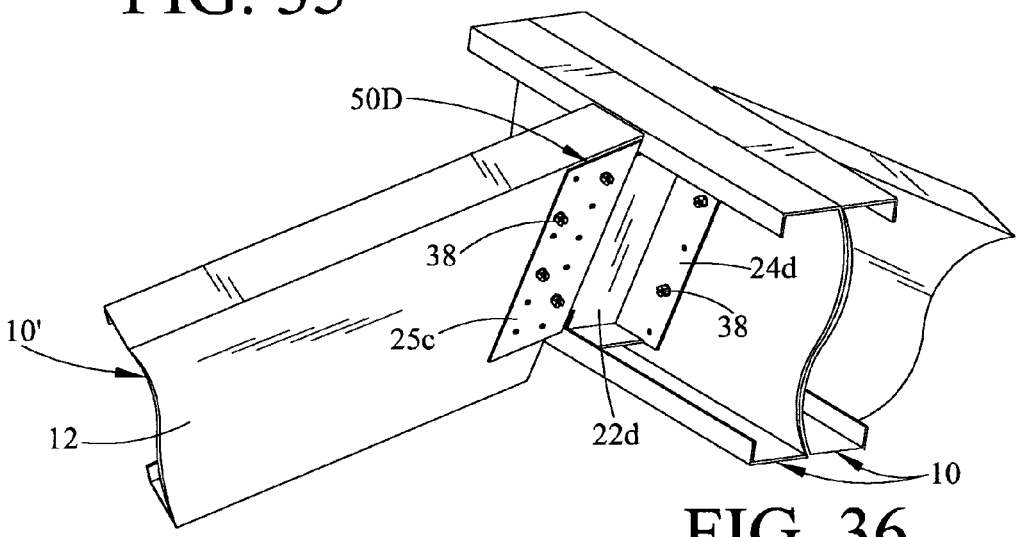
FIG. 36 is a perspective view of the compact jack rafter connector interconnecting a jack rafter and roof ridge.

FIG. 36 shows the slide-in compact jack rafter connector 50D in use to interconnect a second framing member 10' functioning as a jack rafter with two opposed first framing members 10 functioning as ridge or hip rafters. Connector 50D is slid into position from the end of member 10 and secured to member 10 using screws 38 applied through base flange 24*d* and lip flange 26*a* (not shown). Second member 10' is positioned such that its base 12 lies adjacent to the top portion 25*c* of brace plate 22*d* and the end of member 10' abuts lip flange 26*a*, and is secured by applying screws 38 through top portion 25*c* into base 12 of second member 10'.

As in previous examples, while compact jack rafter connector 50D is shown in FIG. 36 as attaching to the outside face of base 12 of member 10', rafter connector 50D can also be used to attach to base 12's inside face. Compact jack rafter connector 50D can also be made by substituting base flange 24*d* with radius cut outside corners for base flange 24, allowing connector 50D to be twisted into position. Compact jack rafter connector 50D can also be made without connector walls 52 without departing from the scope and objects of the present invention.

As seen in the figures that have accompanied the description of the compact connectors 50 of the present invention, connectors 50 interconnect framing members 10 to provide precise and strong joints in a framing system, leaving sidewalls 14 of members 10, which form the outside wall surface of the resulting structure, free of fasteners, bumps, or interruptions of any kind. Also like the previously described connectors, compact connectors 50 can be used to join any and all framing members which interconnect at right angles as well as those which interconnect at some other angle and framing members which demonstrate compound angles one to the other.

Whereas the connectors described above are universal in that they can be used, to a large extent interchangeably, to form a wide variety of different joints in a framed structure, the connectors described below, while still widely versatile, are directed to specific functions and uses.

Partition Wall Connectors

Figure 37:
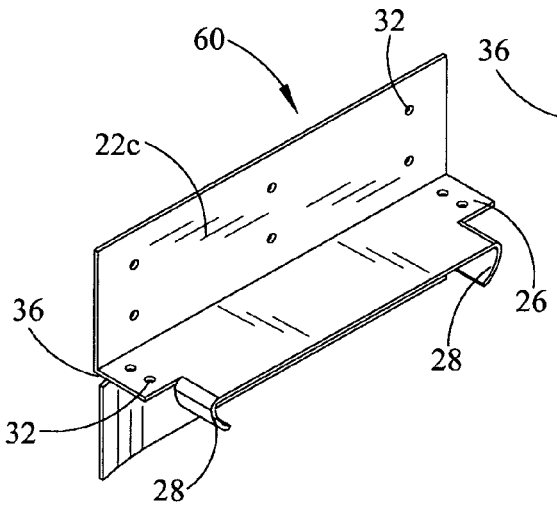
FIG. 37 is a perspective front view of a right angle partition wall connector.
Figure 38:
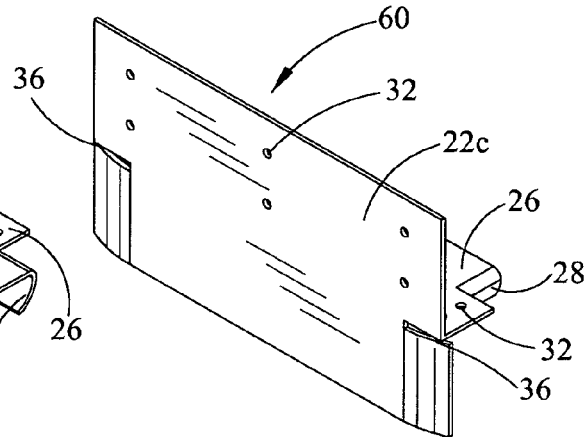
FIG. 38 is a perspective rear view of a right angle partition wall connector.

FIGS. 37 through 43 illustrate universal right angle partition wall connectors of the subject invention and the manner of their use. Front and rear views of a first preferred universal partition wall connector 60 is depicted in FIGS. 37 and 38, respectively. Partition wall connector 60 comprises a brace plate 22*c* rectangular in shape, lip flange 26 which extends out perpendicular to brace plate 22*c* from an intermediate point along the height of brace plate 22*c*, and lip receiving grooves 36 which extend in from the sides of brace plate 22*c* just below and along where flange 26 extends out from brace plate 22*c*. As in the case of universal right angle stud connector 20, lip flange 26 is slotted with the ends bent back and under to form locking clips 28. Pre-drilled holes 32 are formed in parallel rows along the top of brace plate 22*c* and along the ends of lip flange 26.

As is the case with the earlier described connectors, lip flange 26 is spaced from the bottom of brace plate 22*c* a distance which corresponds to the width of sidewalls 14 of framing member 10. Also like earlier described connectors, groove 36 is cut to a depth sufficient to accommodate the depth of lips 16 of member 10.

Figure 43:
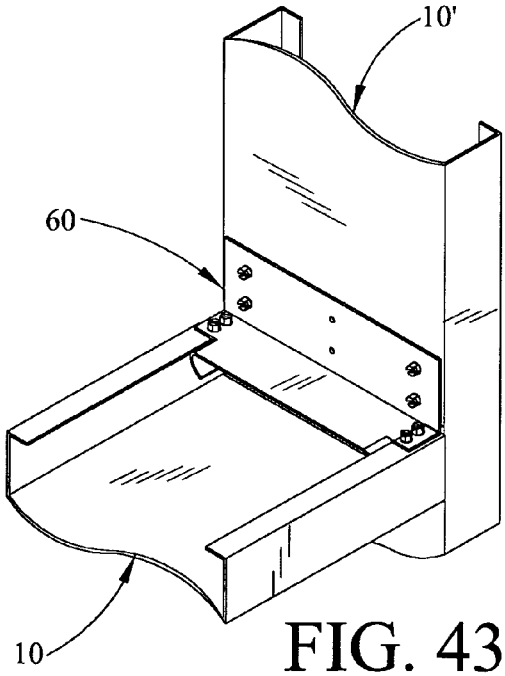
FIG. 43 is a perspective view of a right angle partition wall connector used to form a header or window sill.

Unlike the previously described connectors, partition wall connector 60 does not incorporate a base flange. However in lieu thereof, the lower portion of brace plate 22*c* is bent forward slightly, shown in FIGS. 37 and 38 along its outer aspect, causing brace plate 22*c* to act as a stop against sideways forces from the end of an attached framing member 10 when used, for example, as shown in FIG. 43.

Figure 39:
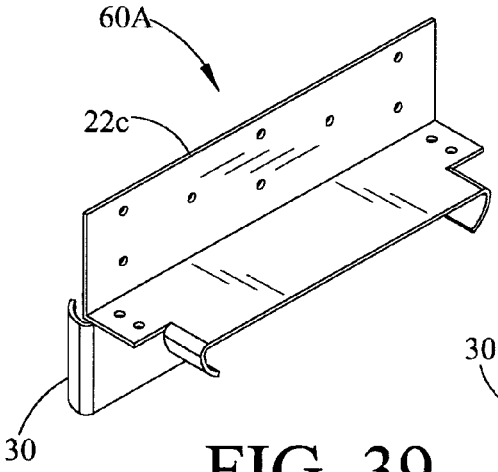
FIG. 39 is a perspective front view of a right angle partition wall connector having support tabs.
Figure 40:
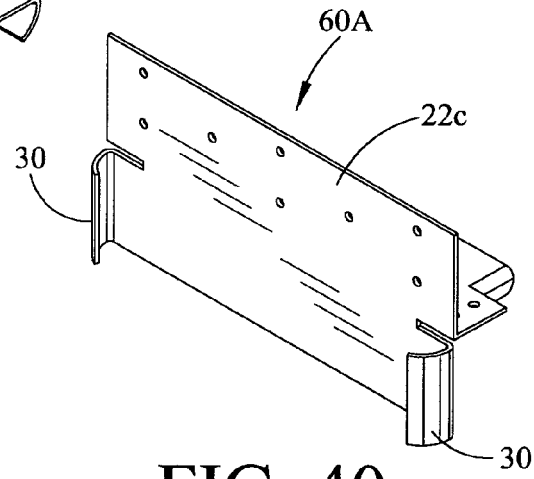
FIG. 40 is a perspective rear view of a right angle partition wall connector with support tabs.

Front and rear views of a second preferred universal right angle partition wall connector 60A is depicted in FIGS. 39 and 40, respectively. Partition wall connector 60A is identical to partition wall connector 60 except that connector 60A has in addition two support tabs 30 which extend from the bottom sides of brace plate 22*c* and are bent around the back thereof.

Like the other connectors, partition wall connectors 60 and 60A are formed by bending a single piece of stamped sheet metal. Because these connectors lack a base flange, they provide somewhat less joint strength as compared to previously described right angle stud connectors but are somewhat simpler to use and typically less expensive to manufacture.

Figure 41:
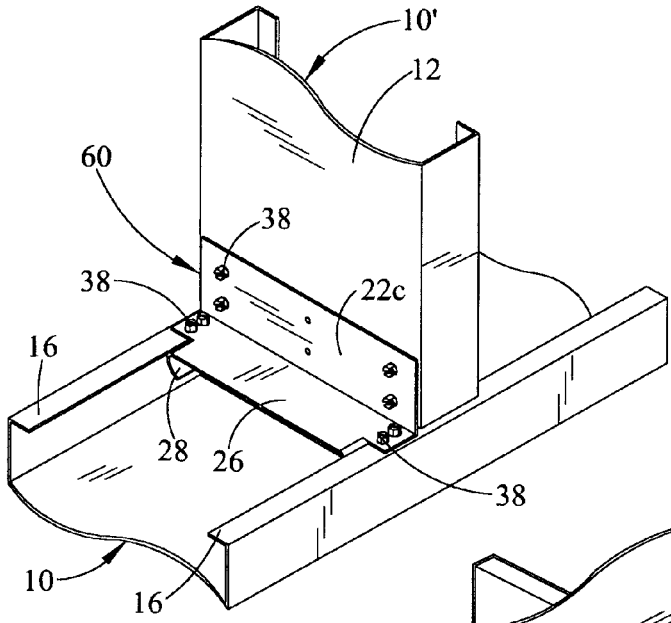
FIG. 41 is a perspective view of a right angle partition wall connector interconnecting a wall stud and a plate or rim joist.

FIG. 41 shows partition wall connector 60 (or 60A) joining a second framing member 10' functioning as a wall stud to a first framing member 10 functioning as a bottom plate or rim joist. Because they lack a base flange, connectors 60 can always be snapped or twisted into position along first framing member 10. Locking clips 28 hold connectors 60 in place on member 10 while connectors 60 are secured to member 10. Self-tapping screws 38 are used to secure lip flange 26 to lips 16 of member 10. Second framing member 10' is placed such that its end abuts lips 16 of first member 10 and its base 12 lies against the back of brace plate 22*c*. Self-tapping screws 38 are then used to secure brace plate 22*c* to base 12 of second member 10'. Alternatively, second framing member 10' can be placed such that its lips 16 lie against the back of brace plate 22*c* (in the case of connector 60 but not 60A) and self-tapping screws 38 are applied through brace plate 22*c* into lips 16 of member 10'.

Figure 42:
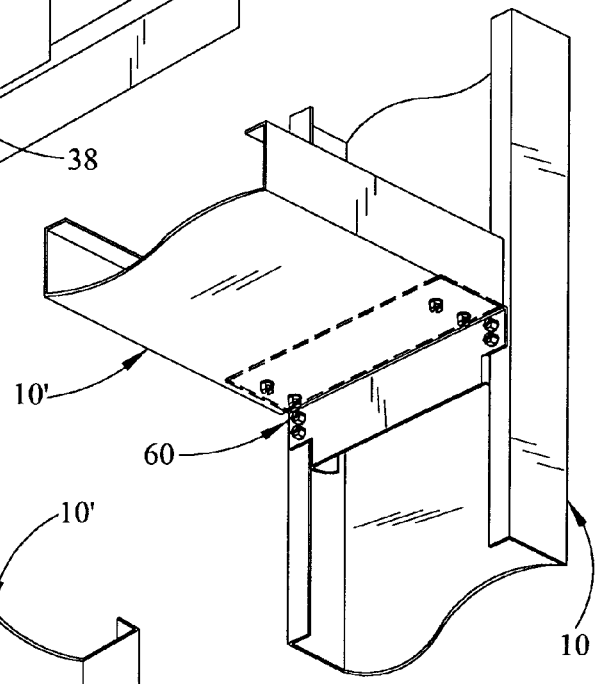
FIG. 42 is a perspective view of a right angle partition wall connector interconnecting a wall stud and a header.

FIG. 42 illustrates the use of connector 60 (or 60A) to interconnect a second framing member 10' functioning as a door header and a first framing member 10 functioning as a wall stud. FIG. 43 illustrates use of connector 60 (or 60A) to interconnect a second framing member 10' functioning as a header or window sill and a first framing member 10 functioning as a wall stud. It will be noted that connectors 60, like the other right angle stud connectors of the present invention, can be used to join an end of first framing member 10 with an intermediate aspect of a second framing member 10', or vise versa.

Though not shown in FIGS. 41 through 43, the presence of support tabs 30 in the case of partition connector 60A holds connector 60A in place on first framing member 10 prior to connector 60A being secured thereto, and also enhances the rigidity and strength of the resulting connection.

Right angle partition wall connectors 60 may be used to join many framing members which interconnect at right angles. Connectors 60 can also be manufactured to accommodate the interconnection of framing members which intersect at angles other than 90 degrees as well as those that demonstrate compound angles one to the other.

Corner Connectors

Figure 44:
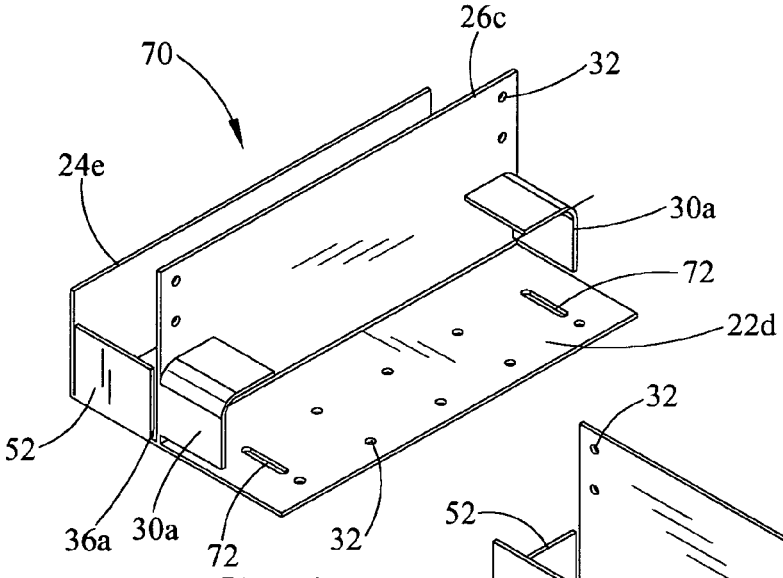
FIG. 44 is a perspective front view of a slide-in combination right angle/corner connector.
Figure 45:
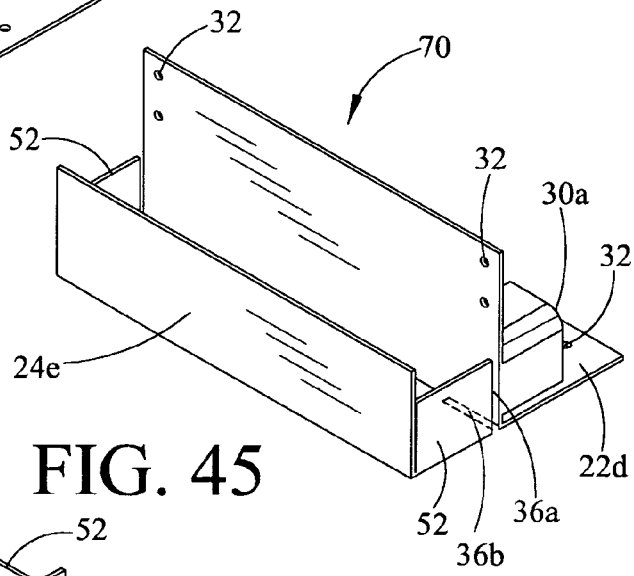
FIG. 45 is a perspective rear view of the slide-in combination right angle/corner connector of FIG. 44.

FIGS. 44 through 49 illustrate two preferred embodiments of universal slide-in right angle corner connectors of the subject invention and the manner of their use. Top and bottom views of a first slide-in preferred universal corner connector 70 are depicted in FIGS. 44 and 45, respectively. Right angle corner connector 70 comprises a brace plate 22*d* rectangular in shape, a base flange 24*e* which extends out from the bottom of brace plate 22*d* perpendicular thereto, a lip flange 26*c* which extends out from brace plate 22*d* in a spaced relationship to base flange 24*e* and parallel thereto, connector walls 52, square in shape, extending from the bottom of brace plate 22*d* perpendicular thereto, two L-shaped support tabs 30*a* extending up from the inside ends of lip flange 26*c* shaped bending inwards, two lip receiving gaps 36*a* formed by the tops of connector walls 52 and the inside bottom edges of lip flange 26*c*, two lip receiving grooves 36*b* (seen in FIG. 45) which extend inward from the sides of brace plate 22*d* immediately below where lip flange 26*c* extends out from brace plate 22*d*, pre-drilled holes 32 formed in parallel rows along the top aspect of brace plate 22*d* and along the outside edges of lip flange 26*c*, and adjusting slots 72 formed along each side of the top aspect of brace plate 22*d* replacing the outside rows of pre-drilled holes 32.

Unlike previously described connectors, no pre-drilled holes 32 are formed in base flange 24*e* and lip flange 26*c* extends out from brace plate 22*d* a substantial distance beyond base flange 24*e*.

Figure 46:
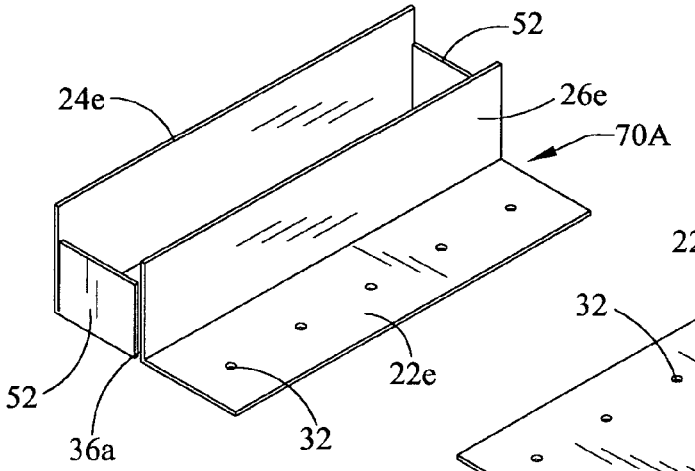
FIG. 46 is a perspective front view of an alternate slide-in combination right angle/corner connector.
Figure 47:
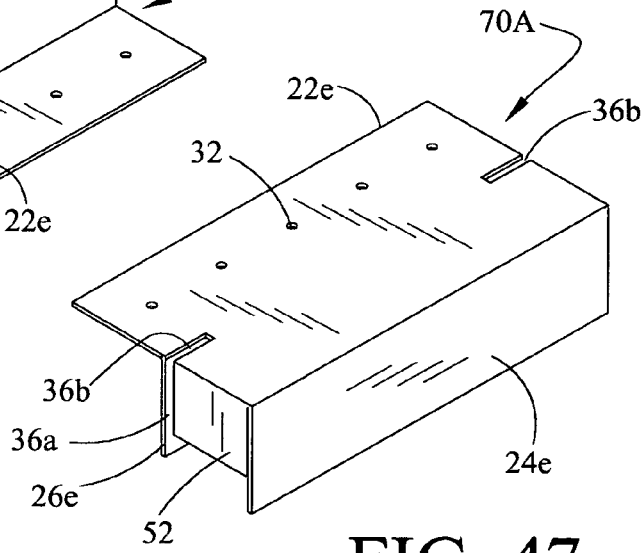
FIG. 47 is a perspective rear view of the alternate slide-in combination right angle corner connector of FIG. 46.

Top and bottom views of a second preferred universal slide-in right angle corner connector 70A are depicted in FIGS. 46 and 47, respectively. Corner connector 70A is comprised of a brace plate 22*e*, a base flange 24*e* extending from the bottom of brace plate 22*e* perpendicular thereto, a lip flange 26*e* extending out from an intermediate point along the height of brace plate 22*e* in spaced relationship to base flange 24*e* and parallel thereto, and connector walls 52 square in shape extending out from the ends of the bottom aspect of brace plate 22*e* perpendicular thereto. Lip receiving gaps 36*a* are formed by the top edge of connector walls 52 and the bottom edge of lip flange 26*e*, and lip received grooves 36*b* (seen in FIG. 47), cut to a depth sufficient to accommodate lips 16 of member 10, are formed in from the sides of brace plate 22*e* immediately below the line from which lip flange 26*e* extends.

Unlike lip flange 26*c* of corner connector 70, lip flange 26*e* of corner connector 70A extends out from brace plate 22*e* about the same distance as base flange 24*e*. Corner connector 70A also lacks the support tabs 30*a* and adjusting slots 72 of the somewhat more complex corner connector 70. Pre-drilled holes 32 are formed in a single row along the top aspect of brace plate 22*e*, and not in lip flange 26*e* as in corner connector 70.

Like previously described connectors, base flange 24*e* and lip flange 26*c* (or 26*e* in the case of corner connector 70A) are spaced apart by a distance that corresponds to the width of sidewalls 14 of framing member 10, and lip receiving grooves 36*b* are of sufficient depth to accommodate the depth of lips 16. As will be seen, lip receiving gaps 36*a* accommodate lips 16 of second framing member 10' and, because they receive lips 16 until lips 16 abut brace plate 22*d*, gaps 36*a* must be cut to the depth of brace plate 22*d*.

Figure 48:
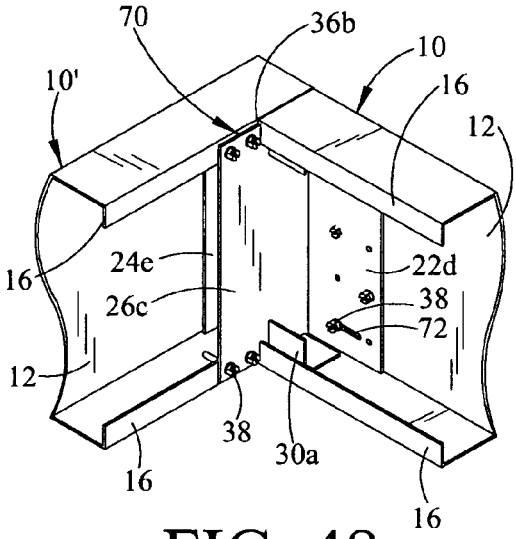
FIG. 48 is a perspective view of the slide-in combination right angle/corner connector of FIG. 44 used as a corner connector in a floor system.
Figure 49:
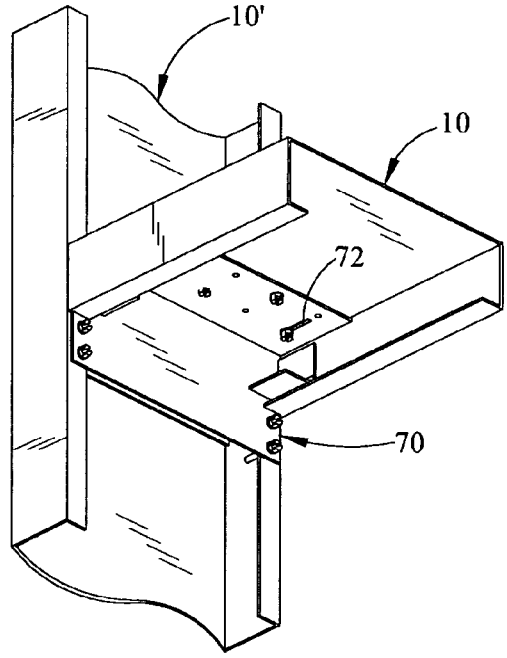
FIG. 49 is a perspective view of the slide-in combination right angle/corner connector of FIG. 44 used as a right angle stud connector in a wall system.

Illustrated in FIGS. 48 and 49 is the manner of use of right angle corner connector 70, in FIG. 48, to connect two floor joists to form a corner of a floor system, and in FIG. 49, to connect a header to a wall stud or to form blocking between adjacent walls studs.

Referring first to FIG. 48, corner connector 70 is positioned in first framing member 10 by sliding the upper aspect of connector 70 over the end of member 10 such that base flange 24*e* of connector 70 sits on top of the inside face of base 12 of framing member 10, the ends of lips 16 of member 10 are received within lip receiving grooves 36*b*, and the tops of support tabs 30*a* press up against the bottom of lips 16 of member 10. Connector 70 is adjustably secured to first member 10 by applying self-tapping screws 38 through the slots 72 formed along the edges of brace plate 22*d*.

Next an end of second member 10' is slid over the exposed lower aspect of connector 70, such that gaps 36*a* (not shown) receive lips 16 of member 10', until the end of member 10' abuts the lower aspect of brace plate 22*d* and the inside base 12 of member 10' lies adjacent to the bottom of base flange 24*e*. Second member 10' is secured to connector 70 by applying self-tapping screws 38 through pre-drilled holes 32 along the edges of lip flange 26*c*.

Because the screws applied through slots 72 are not yet tightened, first member 10 can be slid back and forth relative to corner connector 70 and second member 10' until the corner is properly squared, as for example when squaring door and window openings. Screws 38 in slots 72 are then tightened and additional screws 38 are applied through holes 32 formed in brace plate 22*d* to fully secure connector 70 to first framing member 10.

FIG. 49 demonstrates the use of connector 70 to join a header or blocking (first member 10) to a wall stud (second member 10'). Adjusting slots 72 can be used in this configuration to fine tune stud 10' relative to the floor and ceiling of the structure.

Though not illustrated, alternative right angle corner connector 70A is used in the same manner as connector 70 except that connector 70A secures second framing member 10' through lip receiving gaps 36*a* and not by the use of fasteners. Due to the absence of adjusting slots 72, corner connector 70A also cannot facilitate squaring in the manner corner connector 70A does. Though not illustrated, it will be appreciated that right angle corner connector 70A can be manufactured with support tabs 30*a* and adjusting slots 72, and right angle stud connector 70 can be manufactured without support tabs 30*a* and without adjusting slots 72, without departing from the spirit or scope of the present invention.

Accordingly, corner connectors 70 interconnect framing members 10 to form right angle joints while leaving sidewalls 14 of members 10 free of fasteners, bumps or other interruptions, and allowing for easy and inexpensive application of wall covering. Like earlier described connectors, corner connectors 70 can be used to join a variety of framing members which interconnect at right angles and can also be manufactured to accommodate framing members which demonstrate angles other than 90 degrees and compound angles.

Blocking Connectors

FIGS. 50 through 53 illustrate a blocking connector 80 used to block wall studs.

Figure 50:
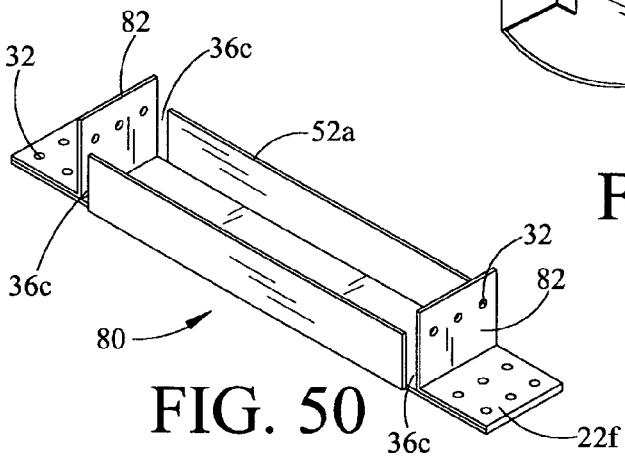
FIG. 50 is a perspective top view of a blocking connector.
Figure 51:
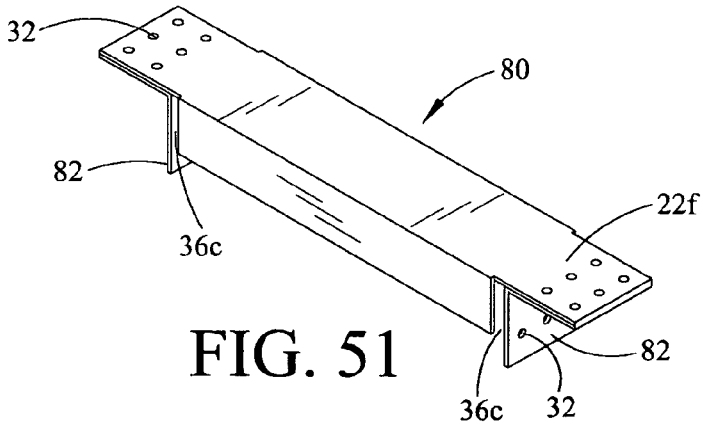
FIG. 51 is a perspective bottom view of the blocking connector.

Top and bottom views of blocking connector 80 are shown in FIGS. 50 and 51, respectively. Blocking connector 80 is comprised of a narrow rectangular brace plate 22*f*, two connector walls 52*a* one extending along most of each side of brace plate 22*f* perpendicular thereto, two sidewall flanges 82 one extending out from each end of brace plate 22*f* spaced apart from the edge thereof and perpendicular thereto, pre-drilled holes 32 formed in each sidewall flange 82 and in the ends of brace plate 22*f*, and four sidewall receiving gaps 36*c* formed by the side edges of connector walls 52*a* and sidewall flanges 82.

Connector walls 52*a* are spaced apart by a distance that corresponds to the inside width of sidewalls 14 of member 10, and sidewall flanges 82 are spaced apart by a distance that corresponds to the outside width of base 12 of member 10. Accordingly, blocking connector 80 fits snugly inside framing member 10 as can be seen in FIG. 52.

Figure 52:
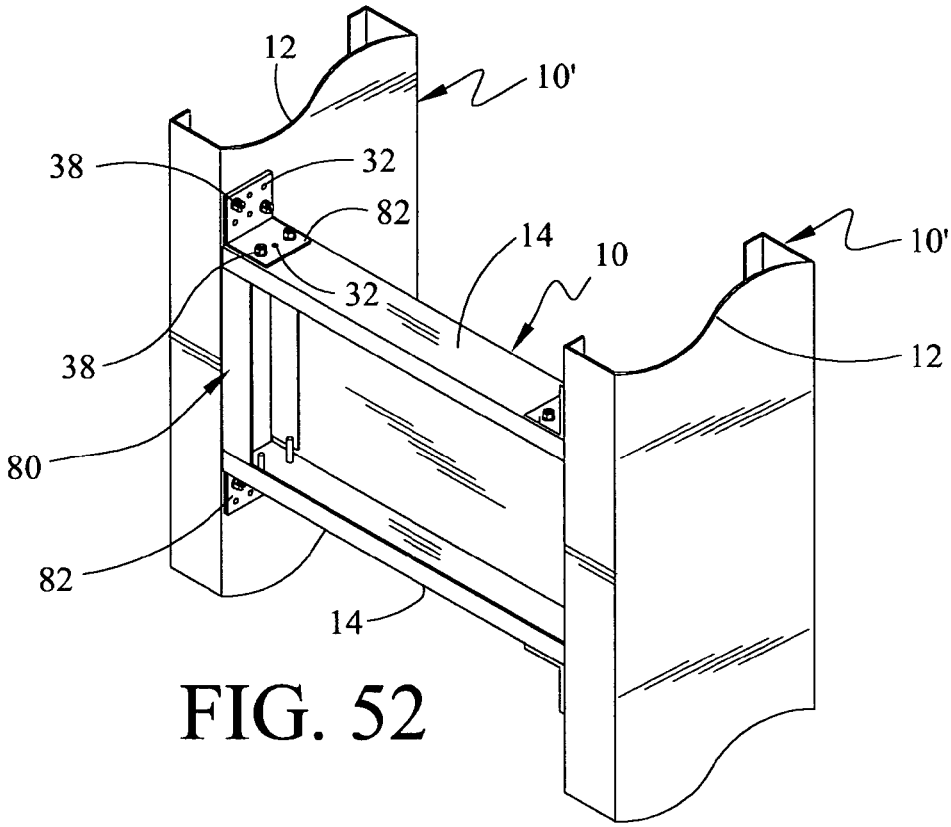
FIG. 52 is a perspective view of the blocking connector interconnecting blocking and a wall stud.
Figure 53:
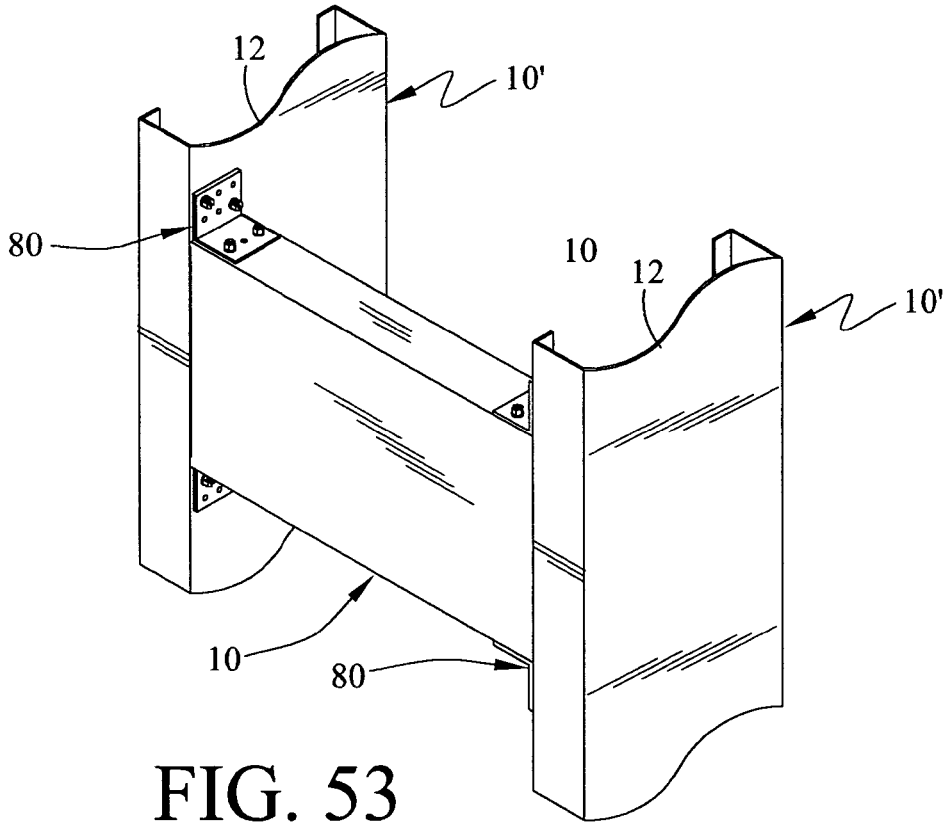
FIG. 53 is a perspective view of two blocking connectors in use blocking wall studs.

FIGS. 52 and 53 illustrate the manner of use of blocking connector 80 to block between adjacent wall studs in a partition or weight bearing wall. Connector 80 is slid over an end of a first framing member 10 such that the ends of sidewalls 14 of member 10 are received into sidewall receiving gaps 36*c*, the end of member 10 abuts brace plate 22*f*, and the inside surface of each sidewall flange 82 lies adjacent to the outside surface of an end of each sidewall 14. Connector 80 is secured to member 10 by applying self-tapping screws 38 through pre-drilled holes 32 in sidewall flanges 82 and sidewalls 14. The bottom of brace plate 22*f* is then positioned along some aspect of base 12 of second framing member 10' and secured to member 10' by screws 38 applied through pre-drilled holes 32 formed in the ends of brace plate 22*f*.

FIGS. 52 and 53 show two blocking connectors 80 securing a first framing member 10 functioning as blocking to the outside face and inside face, respectively, of bases 12 of adjacent wall studs 10'. The configuration shown in FIGS. 52 and 53 differ only in the manner in which blocking member 10 faces relative to wall stud members 10'. It will be appreciated that blocking connectors 80 can also be used to secure blocking to two inside faces of base 12 of wall stud 10' or to two outside faces of base 12 of wall stud 10'.

Accordingly, blocking connectors 80 interconnect framing members 10 to form right angle joints appropriate for partition and weight bearing walls while leaving sidewalls 14 of members 10 free of fasteners, bumps or other interruptions, and allowing for easy and inexpensive application of wall covering. Like the other connectors of the present invention, blocking connectors 80 can also be manufactured to accommodate the interconnection of framing members which demonstrate compound angles one to the other.

Combination Filler/Mounting and End Cap/Mounting Connectors

Figure 54:
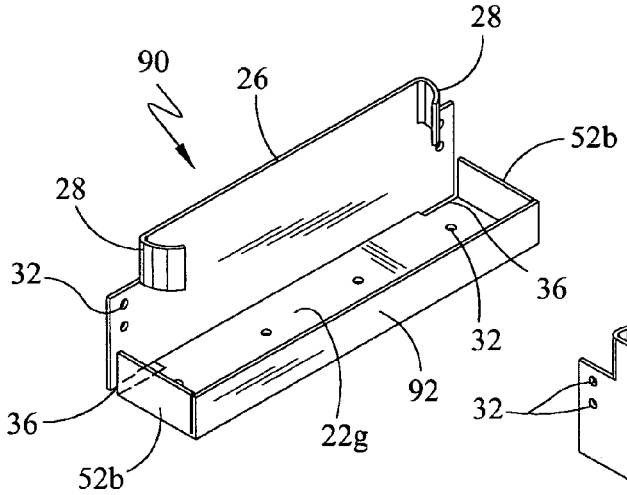
FIG. 54 is a perspective top view of a slide-in combination filler/mounting connector.
Figure 55:
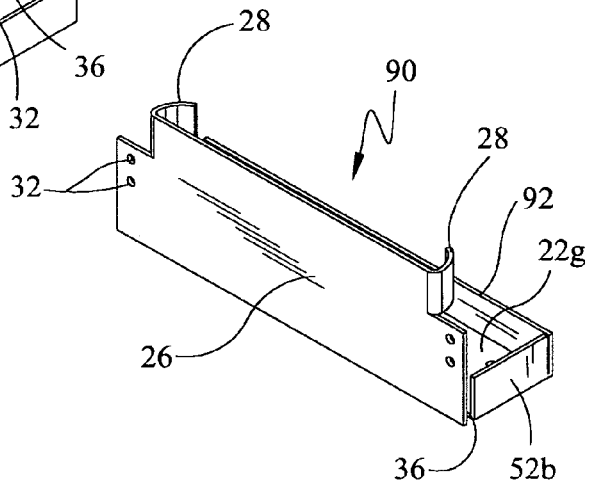
FIG. 55 is a perspective bottom view of the slide-in combination filler/mounting connector of FIG. 54.

A universal combination filler/mounting connector 90 is shown from the top in FIG. 54 and from the bottom in FIG. 55. Connector 90 is comprised of a brace plate 22*g* rectangular in shape, lip flange 26 extending from the edge of one of the long sides of brace plate 22*g* perpendicular thereto, two sidewalls 52*b* extending from each of the short sides of brace plate 22*g* perpendicular thereto, and a base wall 92 extending from the long side of brace plate 22*g* opposite lip flange 26, again perpendicular to brace plate 22*g*.

Lip flange 26 and base wall 92 are spaced apart by a distance that corresponds to the width of sidewalls 14 of framing member 10. The side ends of lip flange 26 are split and L-shaped locking clips 28 extend up and inward from the outside ends of lip flange 26. Lip receiving grooves 36 are formed between one side of sidewalls 52*b* and the inside edges of lip flange 26. Pre-drilled holes 32 are formed in brace plate 22*g* and the inside edges of lip flange 26.

Figure 56:
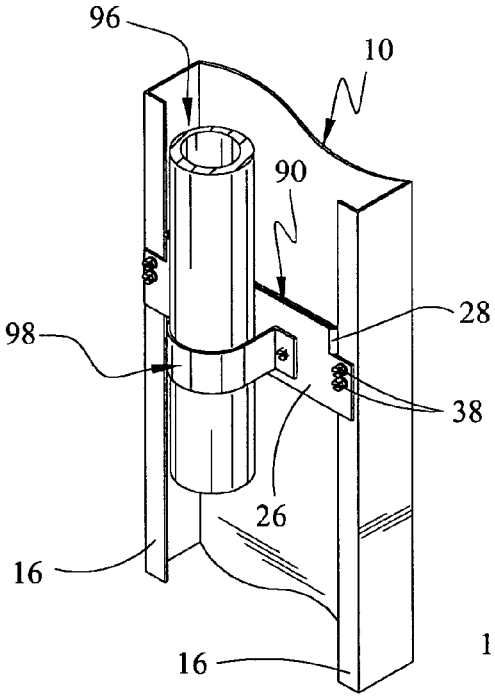
FIG. 56 is a perspective view of the slide-in combination filler/mounting connector of FIG. 54 used to mount a conduit to a framing member.

Combination filler/mounting connector 90 is shown in use as a mounting connector in FIG. 56. Combination connector 90 is positioned within framing member 10 by either twisting connector 90 into position, or sliding connector 90 from an available end of member 10, with lips 16 of member 10 being received by grooves 36 of connector 90. Locking clips 28 which press against the inside surface of lips 16 hold connector 90 in place along member 10. Connector 90 is secured to framing member 10 by screws 38 applied through the pre-drilled holes 32 formed in the ends of lip flange 26 into lips 16 of member 10. Mounting connector 90 is depicted as mounting a conduit 96 held in place on connector 90 by a connector bracket 98. Mounting connector 90 can also be used to mount pipes and other fixtures.

Figure 57:
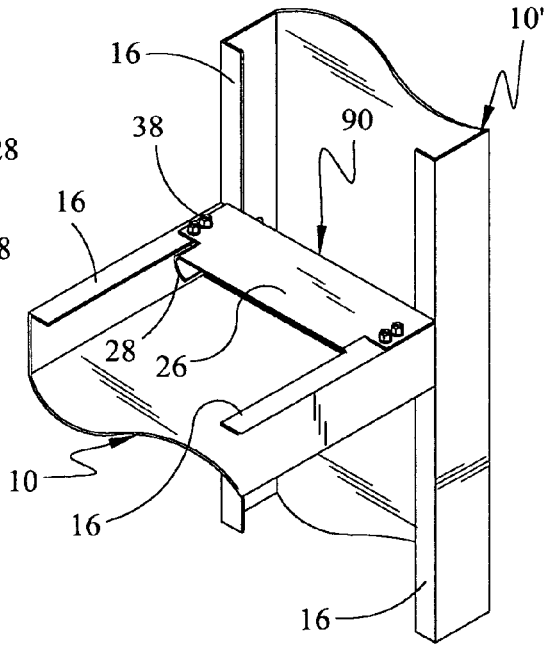
FIG. 57 is a perspective view of a slide-in combination filler/mounting connector of FIG. 54 to fill between wall studs.

Combination filler/mounting connector 90 is shown in use with a framing member to fill between wall studs in FIG. 57. Connector 90 is placed with the outside of brace plate 22*g* against lips 16 of upright wall stud member 10' and secured thereto by screws 38 (not shown) applied from the inside of brace plate 22*g* into lips 16 of member 10'. An end of filler member 10 is inserted into connector 90 such that lips 16 of member 10' are accommodated in grooves 36 and between lip flange 26 and locking clips 28. Sidewalls 52*b* and base wall 92 fit snugly within sidewalls 14 and base 12, respectively, of member 10. Connector 90 is secured to filler member 10' by screws 38 applied through the ends of lip flange 26 into lips 16 of member 10'.

Two preferred embodiments of a combination end cap/mounting connector of the present invention are illustrated in FIGS. 58 through 61. A first universal slide-in combination end cap/mounting connector 90A is shown from the top in FIG. 58A and from the bottom in FIG. 58B. Combination filler/mounting connector 90A is comprised of brace plate 22*g*, sidewalls 52 which extend from the edge of each short side of brace plate 22*g* perpendicular thereto, base wall 24*e* extending from one of the long sides of brace plate 22*g* perpendicular thereto, and lip end tabs 26*d* one extending in from each side of the other available long side of brace plate 22*g* perpendicular thereto. Pre-drilled holes 32 are formed in parallel rows in brace plate 22*g*.

Figure 58A:
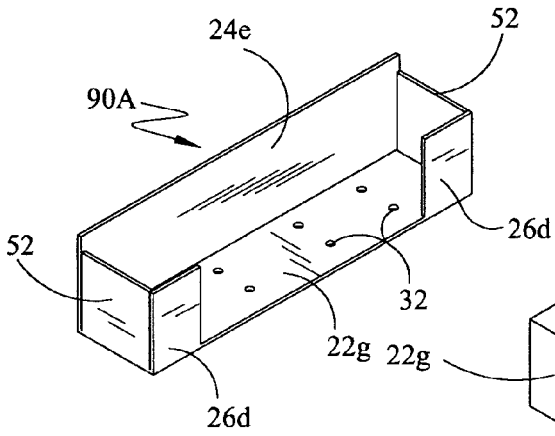
FIG. 58A is a perspective top view of a slide-in combination end cap/mounting connector.
Figure 58B:
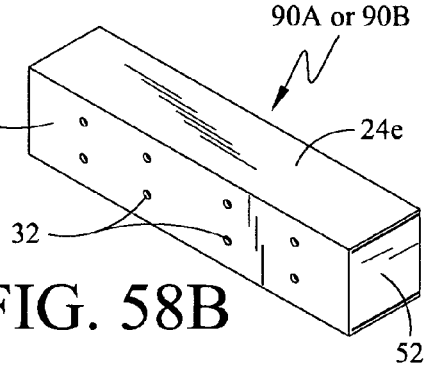
FIG. 58B is a perspective bottom view of the slide-in combination end-cap/mounting connector of FIG. 58A or FIG. 59.
Figure 59:
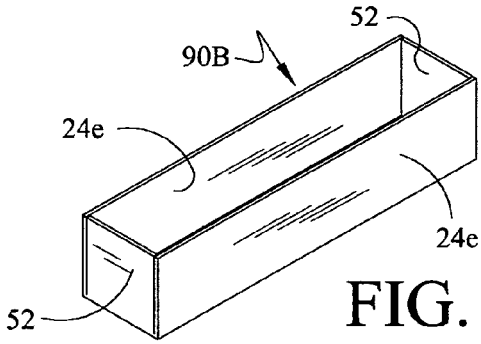
FIG. 59 is a perspective top view of an alternate slide-in combination end-cap/mounting connector.

A second universal slide-in combination end cap/mounting connector 90B is shown from the top in FIG. 59 and from the bottom in FIG. 58B. Combination end cap/mounting connector 90B is identical to connector 90A except that connector 90B has two opposed base walls 24*e* rather than the one wall 24*e* with the opposed dual lip tabs 26*d* as exhibited by connector 90A.

In the case of both combination end cap/mounting connectors, their outside dimensions are such that the connectors 90A and 90B fit snugly inside framing member 10 with sidewalls 52 adjoining sidewalls 14 of member 10 and opposed base walls 24*e*, in the case of connector 90A, and opposed base wall 24*e* and lip tabs 26*d*, in the case of connector 90B, adjoin the inside faces of base 12 and lips 16 of member 10.

Figure 60:
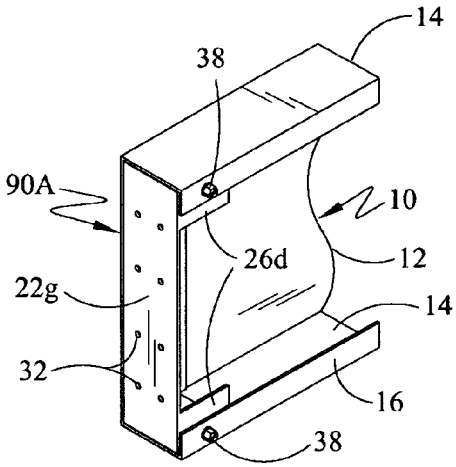
FIG. 60 is a perspective view of the combination end-cap/mounting connector of FIG. 58A in use as an end cap.
Figure 61:
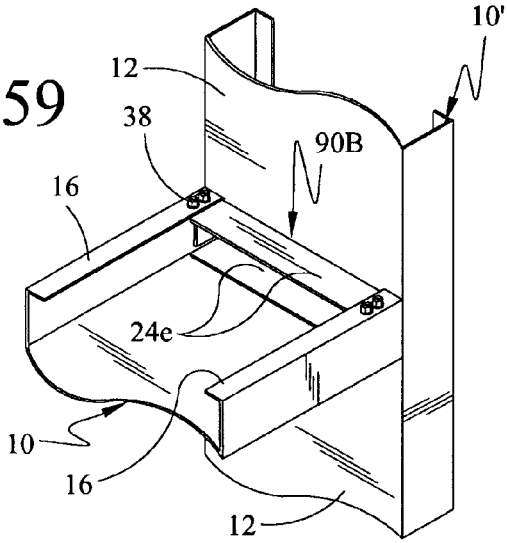
FIG. 61 is a perspective view of the combination end-cap/mounting connector of FIG. 58A in use as an end cap connector.

Combination end cap/mounting connectors 90A and 90B are shown in use as end cap connectors in FIGS. 60 and 61. Referring first to FIG. 60, connector 90A is inserted into one end of a first framing member 10 such that the bottom of brace plate 22*g* caps the end of member 10. Connector 90A is secured at the end of member 10 by applying screws 38 through lips 16 of member 10 into lip taps 26*d* of connector 90A. Member 10, now capped, can be secured to a second framing member 10' through connector 90A by applying screws 38 through the pre-drilled holes 32 formed in brace plate 22*g* into base 12 of member 10' as shown in FIG. 61. The connector shown in FIG. 61 is combination end cap/mounting connector 90B, which is inserted within and secured to framing member 10 and 10' in an analogous fashion.

It will be appreciated by those skilled in the arts of carpentry and construction that combination filler/mounting connector 90 and end cap/mounting connectors 90A and 90B have similar functions and applications and, in addition to those applications illustrated, can be used to tie the ends of framing members 10 to concrete, steel I-beams, and other hard surfaces.

Not shown is combination end cap/mounting connectors 90A and 90B in use as mounting connectors. When used for mounting, connectors 90A and 90B are inserted into a framing member 10 as shown in FIG. 60. Connectors 90A or 90B are then slid along member 10 and secured at the desired position by applying screws 38 through lips 16 of member 10 into, respectively, lip tabs 26*d* or base wall 24*e*.

Connectors 90A and 90B function identically except that the use of discontinuous lip tabs 26*d* along the top of connector 90A makes accessing pre-drilled holes 32 in brace plate 22*g* easier rendering connector 90A more suitable for use as an end cap connector in most circumstances. The continuous base wall 24*e* along the top of connector 90B provides a better surface for mounting conduits, pipes and the like, making connector 90B more suitable as a mounting connector in most circumstances.

Figure 62:
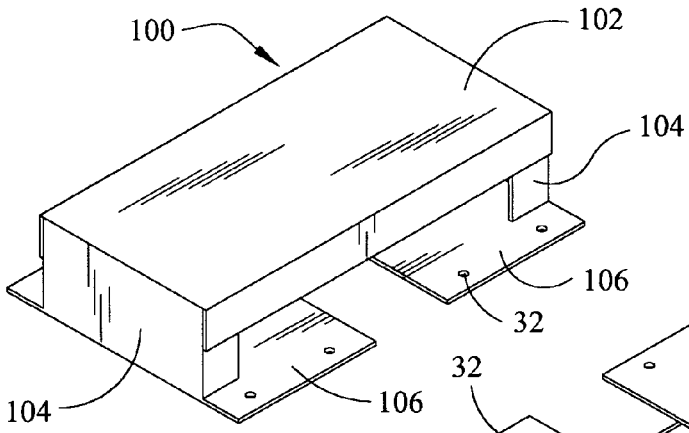
FIG. 62 is a perspective top view of a slide-in mounting connector.
Figure 63:
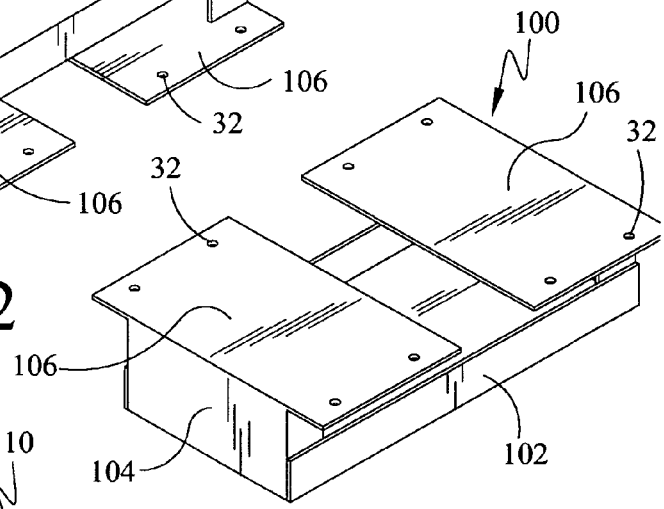
FIG. 63 is a perspective bottom view of the slide-in mounting connector of FIG. 62.

Illustrated in FIG. 62 from the top and in FIG. 63 from the bottom is a slide-in mounting connector 100. Mounting connector 100 is comprised by a mounting plate 102 rectangular in shape having a length that corresponds to the inside width of base 12 of framing member 10, two spacer posts 104 rectangular in shape one extending from the bottom of each side of mounting plate 102 and perpendicular thereto, and two base flanges 104 rectangular in shape, one secured to each spacer post 104 such that the bottom surfaces of base flanges 106 are spaced apart from the top surface of mounting plate 102 by a distance that corresponds to the inside width of sidewalls 14 of framing member 10. Pre-drilled holes 32 are formed in the corners of each base flange 106. Base flanges extend beyond the width of mounting plate 102 such that holes 32 can be accessed from behind mounting plate 102.

Figure 64:
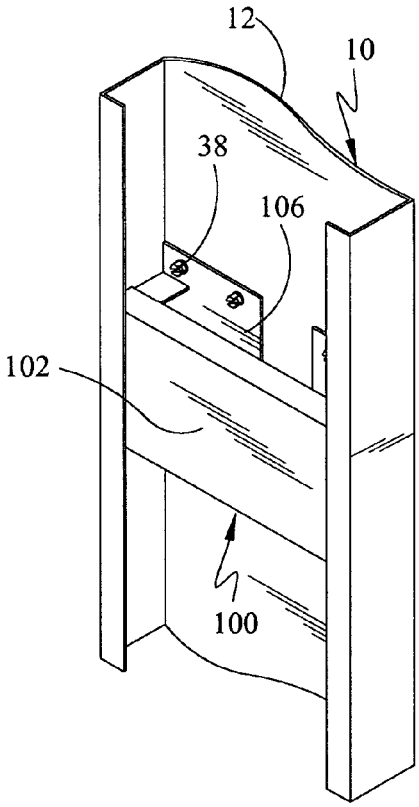
FIG. 64 is a perspective view of the slide-in mounting connector of FIG. 62 secured in position inside a framing member.

FIG. 64 shows mounting connector 100 in use in framing member 10, shown here as a wall stud. Mounting connector 100 is positioned within member 10 by sliding connector 100 from one end of member 10. Mounting connector 100 fits snugly inside member 10 with the bottom of base flanges 106 resting on the inside face of base 12 of member 10, the outside edges of spacer posts 104 resting along the inside face of sidewalls 14, and the outside top surface of mounting face 102 abutting the bottom surface of lips 16.

Mounting connector 100 is secured to framing member 10 by applying self-tapping screws 38 through the pre-drilled holes 32 formed in the exposed aspect of base flanges 106 into the inside face of base 12 of member 10. Mounting face 102 is now available for mounting pipes, electrical conduit, and the like.

It will be appreciated that mounting connector 100, and the combination filler/mounting and end cap/mounting connectors 90 described earlier, are secured to framing members 10 in a manner which leaves sidewalls 14 of framing members 10 smooth and free of fasteners, bumps, or other interruptions. And like most of the previously described connectors, combination connectors 90 can be used to join most framing members which interconnect at right angles and can be manufactured to cap, mount to, and interconnect framing members which demonstrate non-square and compound angles.

Column/Header Connectors

Figure 65:
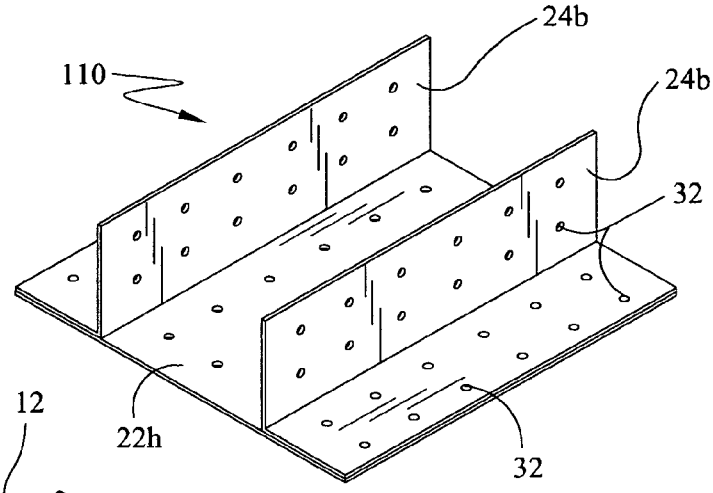
FIG. 65 is a perspective view of combination column/header connector.

Depicted in FIG. 65 is a universal combination column/header connector 110 of the present invention. Column/header connector 110 is comprised of a brace plate 22*h* rectangular in shape having a height that corresponds to the inside width of base 12 of framing member 10, and two base flanges 24*b* extending parallel to one another out from brace plate 22*h* perpendicular thereto and equally spaced from the edges of brace plate 22*h*. Pre-drilled holes 38 are formed in parallel rows along the lengths of base flanges 24*b* and all aspects of brace plate 22*h*. As with the other connectors of the present invention, combination column/header connector 110 is formed by bending a single piece of stamped sheet metal.

Figure 66:
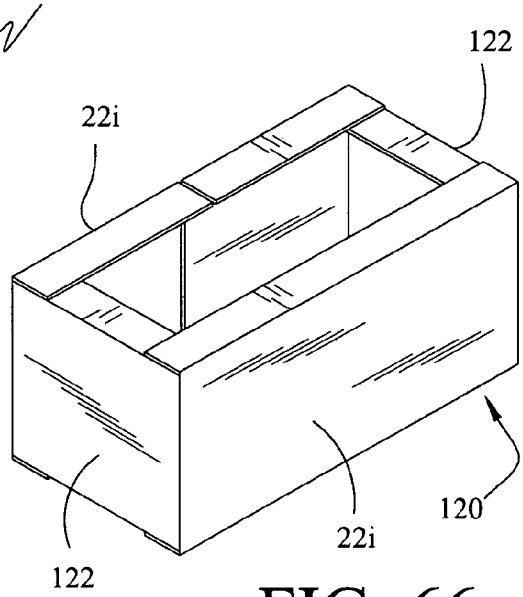
FIG. 66 is a perspective view of combination column/header filler.
Figure 67:
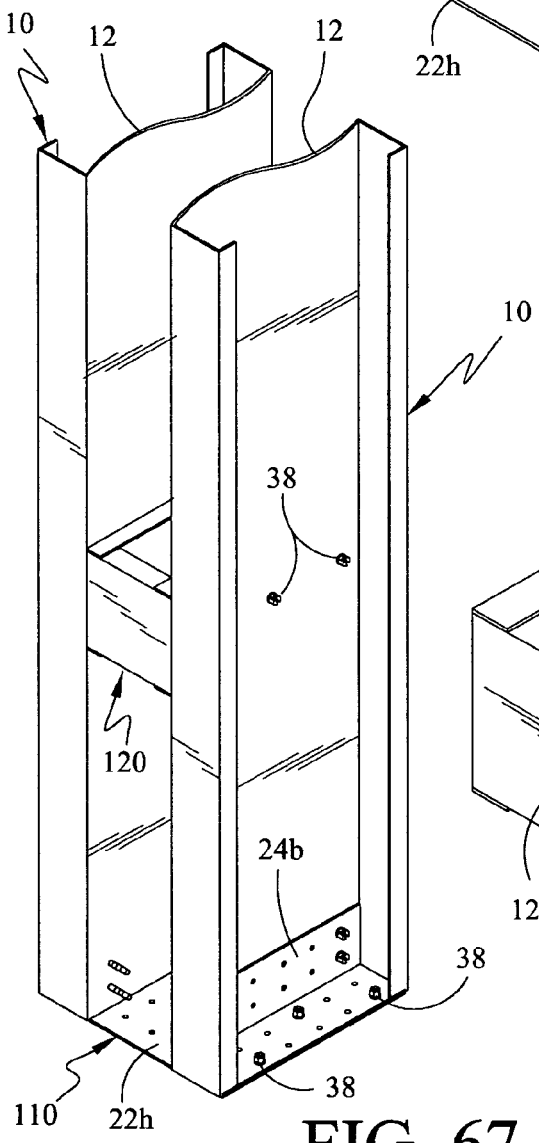
FIG. 67 is a perspective view showing the combination column/header connector of FIG. 65 used together with combination column/header filler of FIG. 66 and two framing members to form a column.

Illustrated in FIG. 66 is a combination column/header filler 120 intended for use with the combination column/header connector 110 shown in FIG. 67. Filler 120, formed by bending a single piece of stamped sheet metal into a filler of substantially block-shaped configuration, comprises two opposed brace plates 22*i* joined to two opposed filler walls 122. The length of filler 120 corresponds generally with the width of base 12 of framing member 10 and the width of filler 120 corresponds with the distance between base flanges 24*b* on column/header connector 110.

FIG. 67 shows combination column/header connector 110 and combination column/header filler 120 in use to build a column secured to the floor or foundation. Connector 110 is positioned on the floor or foundation such that the back side of base plate 22*h* lies atop the floor and base flanges 24*b* project upwards. Connector 110 is secured to the floor by screws 38 applied through base plate 22*h* into the floor. The ends of two framing members 10 are slid over base flanges

24*b*, with the outside faces of bases 12 facing one another, such that the inside bases 12 of member 10 adjoin the inside opposed faces of base flanges 24*b*. The ends of members 10 are then secured to connector 10 by applying screws 38 through base flanges 24*b* into bases 12 of members 10. Finally, filler 120 is sandwiched between the outside faces of base 12 of the two framing members 10 and secured therein by the use of screws 38 applied through base 12 from its inside face into brace plates 22*i* of filler 120.

Alternatively, framing members 10 can be positioned on combination column/header connector 110 such that the bottom of base 12 of members 10 lie against base flanges 24*b* of connector 110, or such that the bottom of base 12 of one member 10 lies against one base flange 24*b* while the top of base 12 of the other member 10 lies against the other base flange 24*b*.

Figure 68:
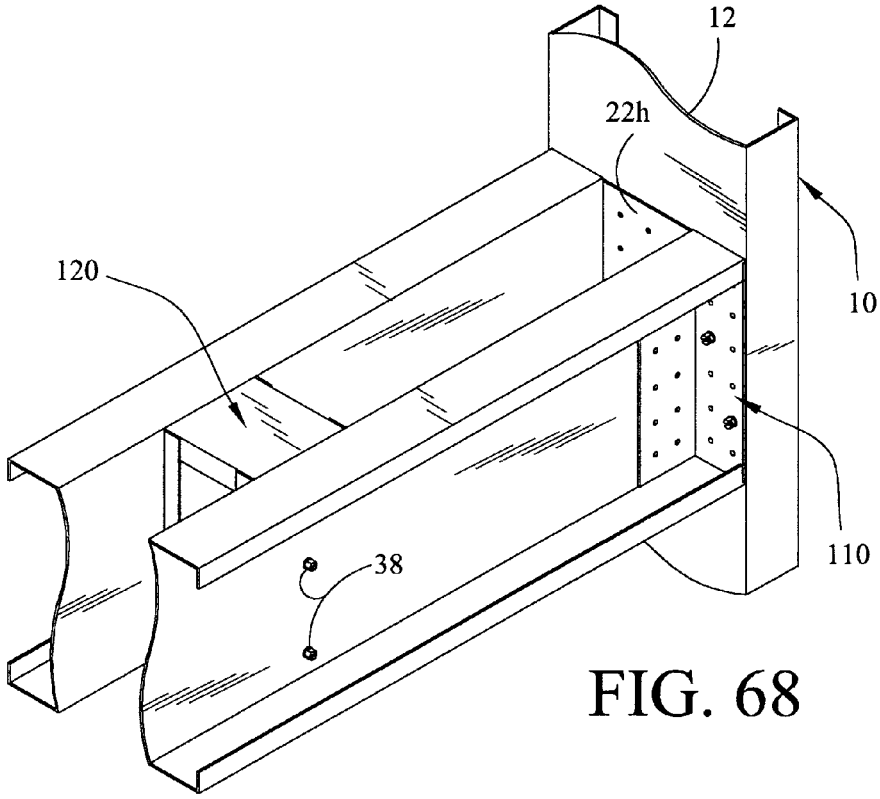
FIG. 68 is a perspective view showing the combination column/header connector of FIG. 65 used together with combination column/header filler of FIG. 66 and two framing members to form a header secured to a wall stud.

FIG. 68 shows combination column/header connector 110 and combination column/header filler 120 in use to build a header secured to a wall stud. Connector 110 and filler 120 are used in the same manner as when building the column shown in FIG. 67 except that, as a first step, instead of securing the back side of base plate 22*h* to the floor, the back side of base plate 22*h* is secured to the outside face of base 12 of a framing member 10 functioning as a wall stud.

Accordingly, combination column/header connector 110 and combination column/header filler 120 can be used together to build columns and headers from framing members 10 while leaving the sidewalls 14 of members 10 smooth, free of fasteners, bumps or other interruptions. Like other connectors, connector 110 can be manufactured to build columns and headers that exhibit non-right angles and compound angles with respect to adjacent framing members.

Hip Connectors

Figure 69:
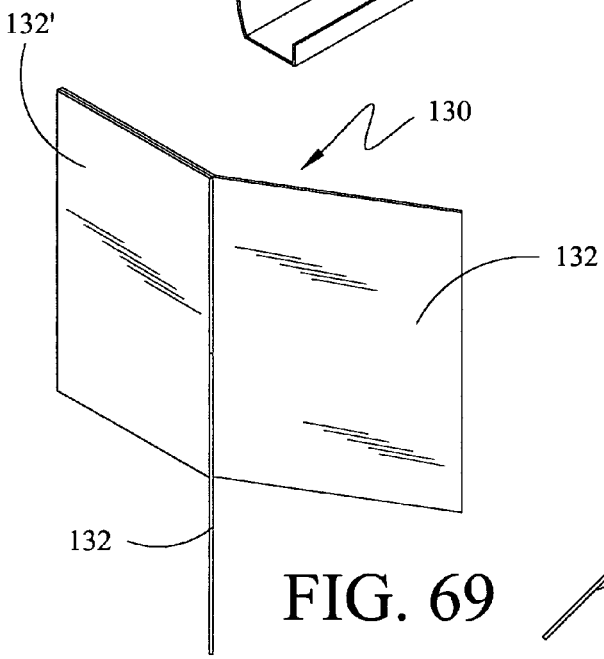
FIG. 69 is a perspective front view showing a hip to ridge connector.
Figure 70:
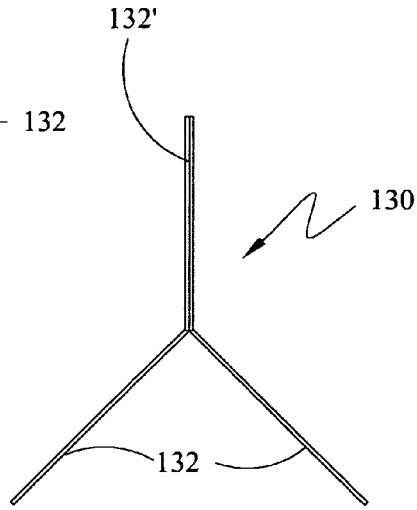
FIG. 70 is a perspective top view showing the hip to ridge connector of FIG. 69.
Figure 71:
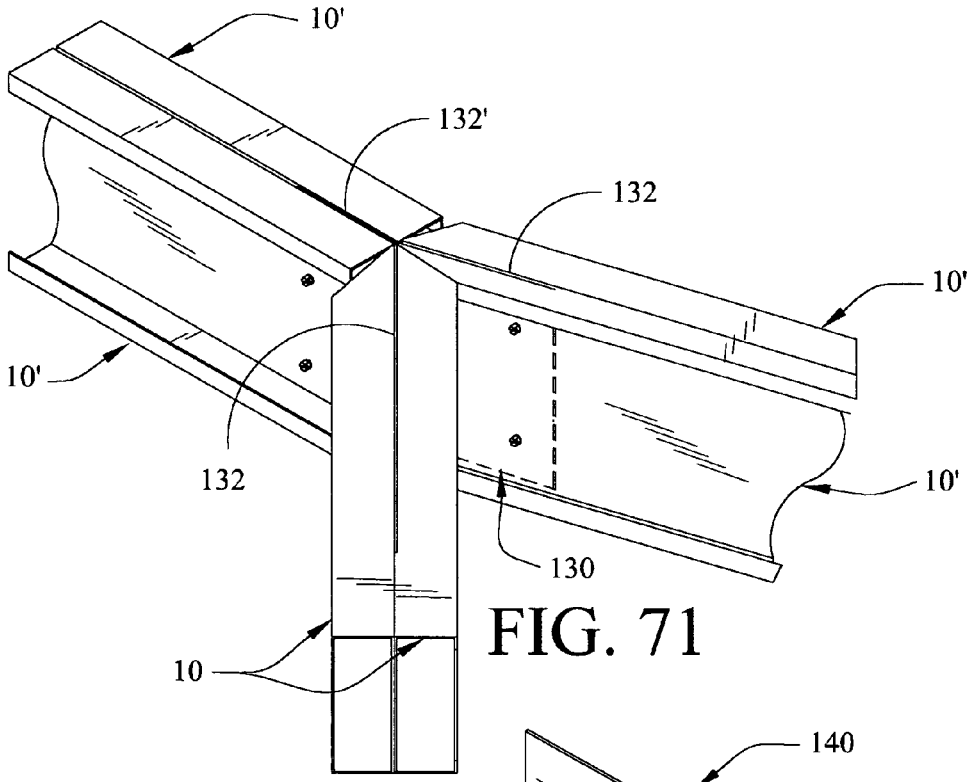
FIG. 71 is a perspective view showing the hip to ridge connector in use to interconnect two roof hips and a roof ridge.

Illustrated in FIGS. 69 through 71 is a hip to ridge connector 130 of the present invention and its manner of use.

FIG. 69 shows the hip to ridge connector 130 from the front, while FIG. 70 shows connector 130 from the top. Connector 130 comprises three brace plates 132, rectangular in shape, forming obtuse angles one to the other which angles correspond to the angles the hip rafters make with each other and with the roof ridge. One brace plate 132' of the three brace plates 132 that comprise connector 130 demonstrates a double thickness. This is due to connector 130, like the other connectors of the present invention, being folded from a single piece of stamped sheet metal. Brace plates 132 of connector 130 are sized to fit snugly within the inside face of base 12 of framing member 10.

FIG. 71 shows hip to ridge connector 130 in use interconnecting two hip rafters, each of which are formed of opposed framing members 10, to a roof ridge formed of opposed framing members 10'. Self-tapping screws 38 are applied from the inside face of base 12 of members 10 and 10' to secure members 10 and 10' to connector 130 and to each other. While double thick brace plate 132' is shown in FIG. 71 sandwiched between framing member 10' to comprise the roof ridge, brace plates 132 and 132' can be used interchangeably. Because the angles between brace plates 132 must correspond to the angles between the hip rafters and the roof ridge, which varies between structures, connector 130 is fabricated or bent to correlate to the structure design.

Figure 72:
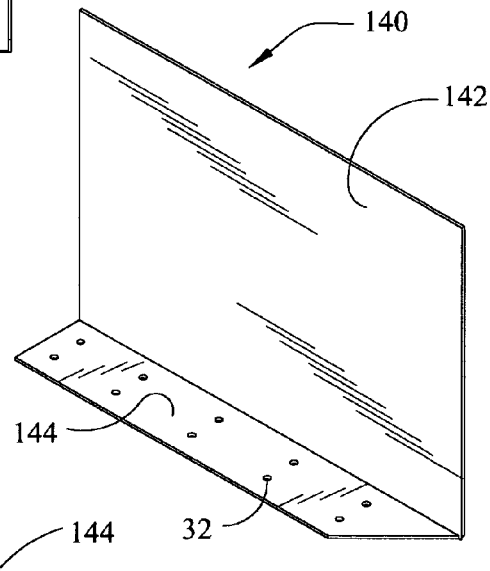
FIG. 72 is a perspective front view of a top plate to hip connector.
Figure 73:
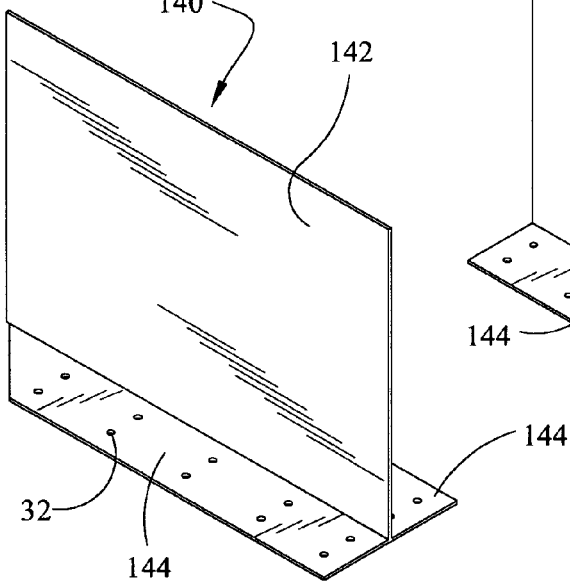
FIG. 73 is a perspective rear view of the top plate to hip connector of FIG. 72.
Figure 74:
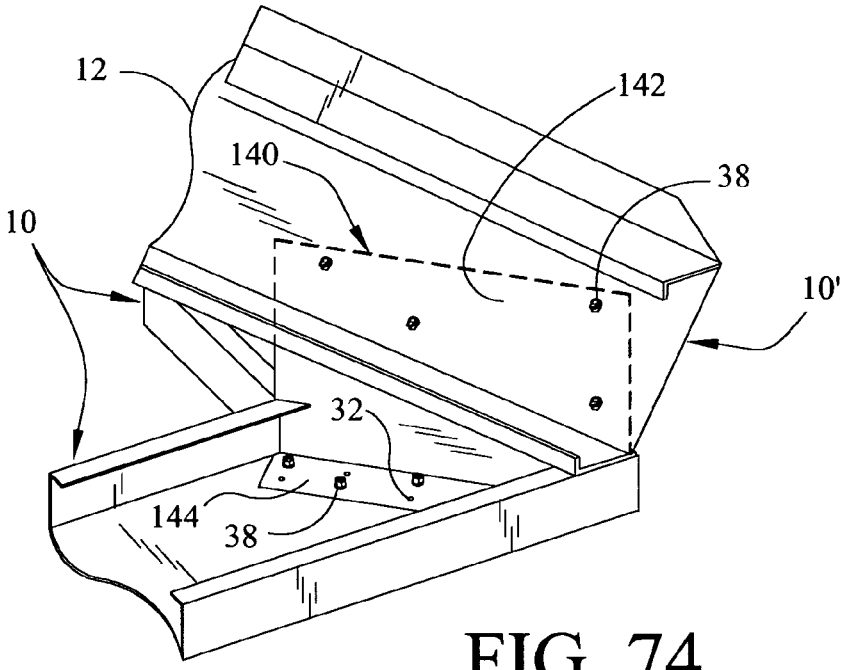
FIG. 74 is a perspective view of the top plate to hip connector in use to interconnect the top plate with a roof hip.

FIGS. 72 through 74 illustrate a top plate to hip connector 140 and its manner of use.

Top plate to hip connector 140 is shown in FIG. 72 from the front and in FIG. 73 from the rear. Connector 140 is comprised of a brace plate 142, rectangular in shape, and two opposed base flanges 144 which extend from the bottom of brace plate 142 perpendicular thereto. Pre-drilled holes 32 are formed in rows along the length of base flanges 144. One end of base flange 144 is beveled to a 45 degree angle to accommodate a top plate joint as demonstrated in FIG. 74. The width of brace plate 142 corresponds with the length of a right angle joint cut made through base 12 of member 10.

Top plate to hip connector 140 is shown in use in FIG. 74 to interconnect a hip rafter formed of two opposed second framing members 10' to a top plate corner formed of two adjoined first framing members 10. As depicted, connector 140 is inserted into or sandwiched between first framing members 10 at the point members 10 are joined to form a right angle, with the beveled edge of base flanges 144 abutting the outside corner. Connector 140 is secured to members 10 by applying screws 38 through pre-drilled holes 32 formed in base flanges 144. The ends of opposed second framing members 10', with the outside face of bases 12 facing one another, are then positioned to sandwich the exposed upper aspect of brace plate 142. Screws 38 are applied through the inside face of bases 12 of members 10', from the outside thereof, through bases 12 and the top aspect of brace plate 142.

Hip to ridge connector 130 can also be fabricated to accommodate framing members interconnecting at angles other than the typical angles illustrated. Though not illustrated here, it will be appreciated by those skilled in the art of framing that both hip to ridge connector 130 and top plate to ridge connector 140 can equally function as roof valley connectors. As with the other connectors of the subject invention, hip to ridge connector 130 and top plate to hip connector 140 interconnect framing members that form top plates, hip rafters and roof ridges, leaving sidewalls 14 of framing members 10 smooth and fastener free.

Truss Connectors

Three varieties of truss connectors of the present invention, and their manners of use, are shown in FIGS. 75 through 86.

Figure 75:
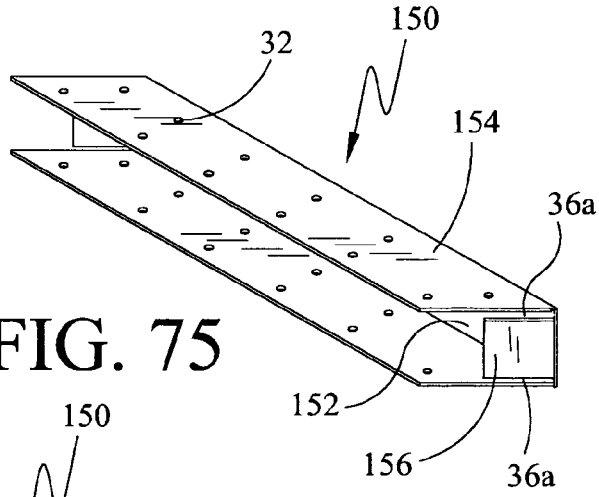
FIG. 75 is a perspective front view of a truss end cap connector.
Figure 76:
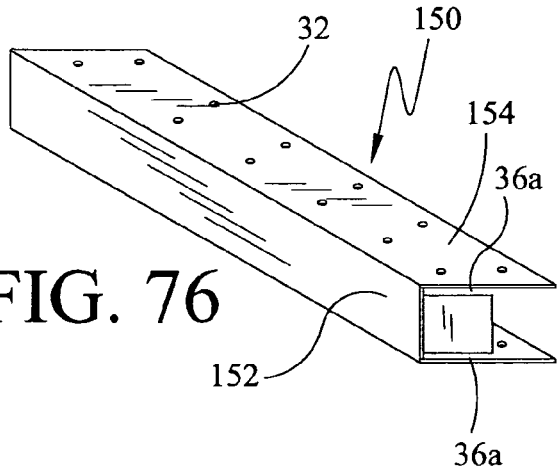
FIG. 76 is a perspective rear view of the truss end cap connector of FIG. 75.

Illustrated in FIG. 75 is a universal truss end cap connector 150 viewed from the front, and FIG. 76 shows the same connector 150 from the rear. Truss end cap connector is comprised of an end cap 152 rectangular in shape, two flanges 154 trapezoidal in shape which extend from the long sides of end cap 152 perpendicular thereto, and two sidewalls 156, substantially square in shape, which extend from the short sides of end cap 152 angled to follow the angle of the sides of trapezoidal flanges 154. Four sidewall receiving gaps 36*a* are formed by the intersection of sidewalls 156 and flanges 154. Pre-drilled holes 32 are formed in rows in flanges 154.

Truss end cap connector 150 is sized such that flanges 154 fit snugly over truss member 10 adjoining base 12 of member 10 on the one side and lips 16 of member 10 on the other, while sidewalls 156 fit snugly inside sidewalls 14 of member 10. Accordingly, the width of end cap 152 of connector 150 will correspond to the outside width of sidewall 14 of member 10 while the length of end cap 152 of connector 150 will depend upon the width of base 12 of member 10 but will vary depending upon the angle formed by the ends of truss member 10.

Figure 77:
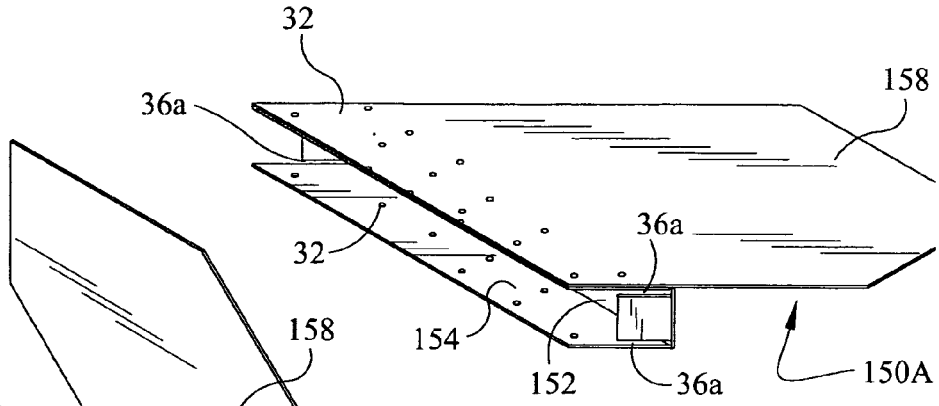
FIG. 77 is a perspective front view of a truss bottom connector.
Figure 78:
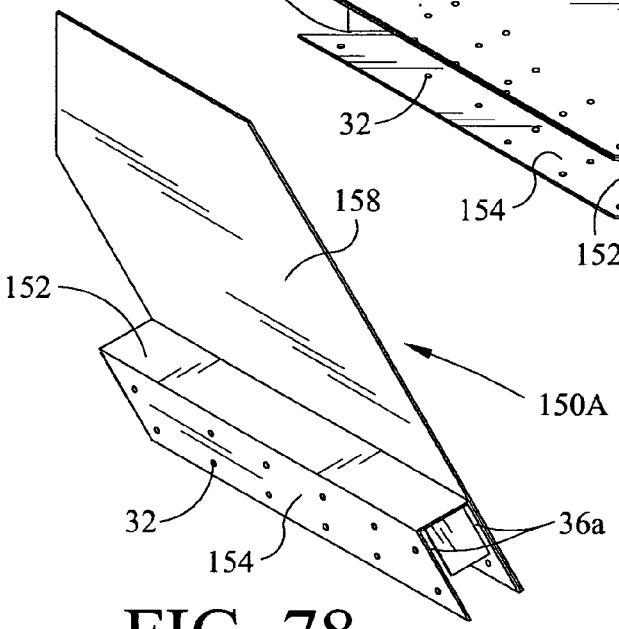
FIG. 78 is a perspective rear view of the truss bottom connector of FIG. 77.

A universal truss bottom connector 150A is shown from the front in FIG. 77 and from the rear in FIG. 78. Truss bottom connector 150A is identical to truss end cap connector 150 except that a brace plate 158 is substituted for one of the two flanges 154. Brace plate 158 is substantially trapezoidal in shape and extends out from end cap 152 in two directions, in one direction to form a flange that mirrors flange 154, and in the other to form a plate with one of its corners angle cut. Pre-drilled holes 32 are formed in rows in flange 154 and in the flange aspect of brace plate 158. Depicted in FIGS. 77 and 78 is a right-handed truss bottom connector 150A. Not shown is a left-handed truss bottom connector 150A which would be the mirror image of the right-handed connector 150A depicted in FIGS. 77 and 78.

Figure 79:
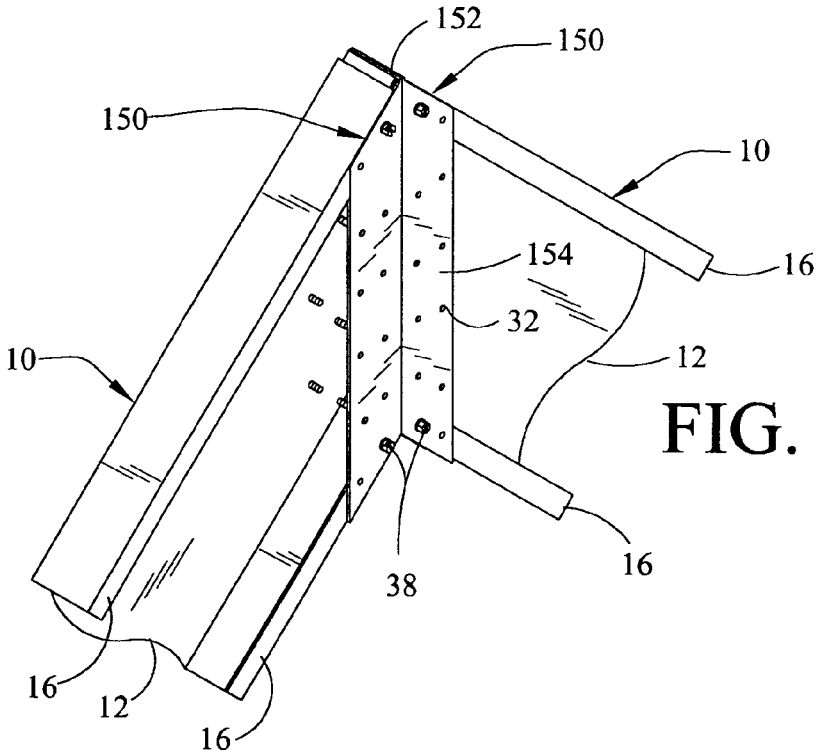
FIG. 79 is a perspective view of two truss end cap connectors of FIG. 75 capping and interconnecting two roof trusses.

Two truss end cap connectors 150 are shown in FIG. 79 capping and interconnecting the ends of two framing members 10 to form a roof ridge in a truss roof. The ends of truss members 10 are angle cut to form an angle dictated by the building design. Two end cap connectors 150 are positioned such that the outside faces of end caps 152 of each connector 150 lie adjacent to one another and are secured to each other using fasteners (not shown) applied from the inside faces of end caps 152 into the opposing end caps 152. End cap connectors 150 are then secured to and join framing members 10 by sliding connectors 150 over the cut ends of member 10 such that the inside faces of flanges 154 lie against the outside surface of lips 16 and the ends of sidewalls 14 of members 10 are received inside sidewall receiving gaps 36*a* of connector 150 until the ends of members 10 abut end caps 152. Truss end cap connectors 150 are secured to the truss members 10 by applying self-tapping screws 38 through pre-drilled holes 32 formed in the ends of flanges 154 into lips 16 and bases 12 of members 10.

An alternative and equally useful sequence of assembly comprises the steps of connecting one end cap connector 150 to one framing member 10, connecting a second end cap connector 150 to the first end cap connector 150, and finally securing a second framing member 10 to the second end cap connector 150.

Figure 80:
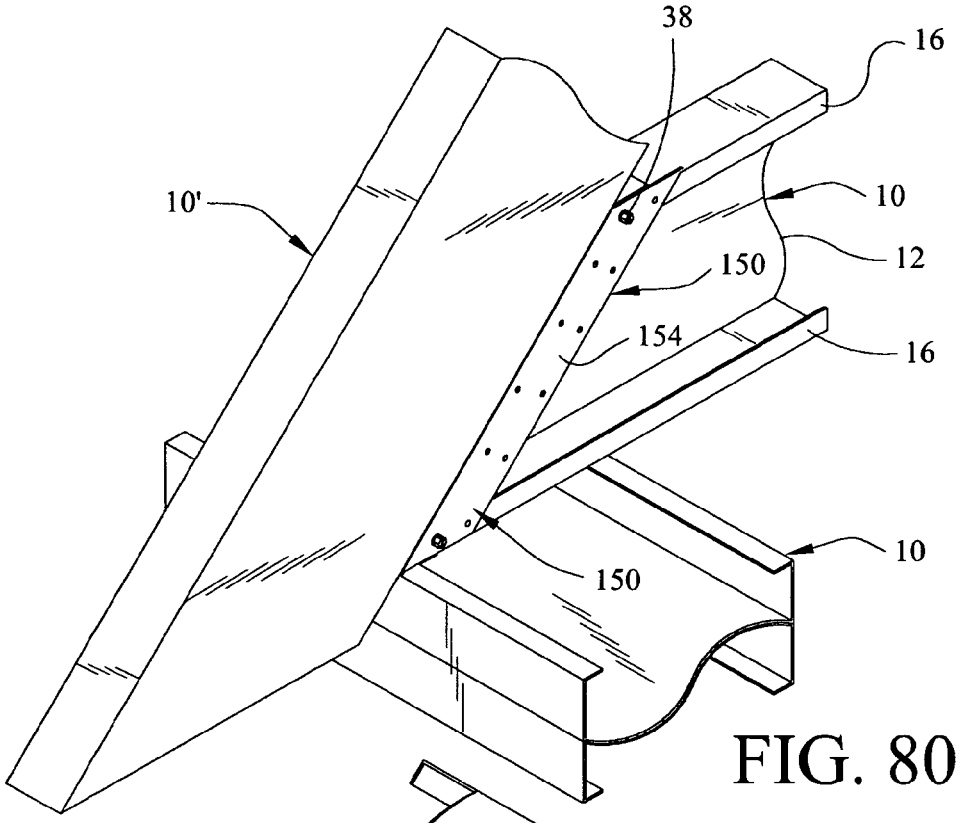
FIG. 80 is a perspective view of the truss end cap connector of FIG. 75 capping and interconnecting a ceiling joist to a straight roof rafter.

Truss end cap connector 150 is shown in FIG. 80 interconnecting a first framing member 10 functioning as a ceiling joist and a second framing member 10' functioning as a roof rafter. The end of ceiling joist member 10 has been angle cut to accommodate roof rafter member 10. Truss end cap connector 150 is slid over the end of member 10 and secured thereto using screws 38 applied through the ends of flanges 154 into lips 16 and base 12 (not shown) of member 10. Second member 10' is then positioned with one of its sidewalls 14 lying adjacent to the outside face of end cap 152 of connector 150. Connector 150 is secured to rafter member 10' by applying fasteners (not shown) through the inside face of end cap 152 into sidewall 14 of member 10'.

Though not illustrated here, it will be appreciated by those skilled in the art of building framing that truss end cap connector 150 can be used to tie the ends of framing members 10, at any angle, to concrete, steel I-beams, and other hard surfaces.

Figure 81:
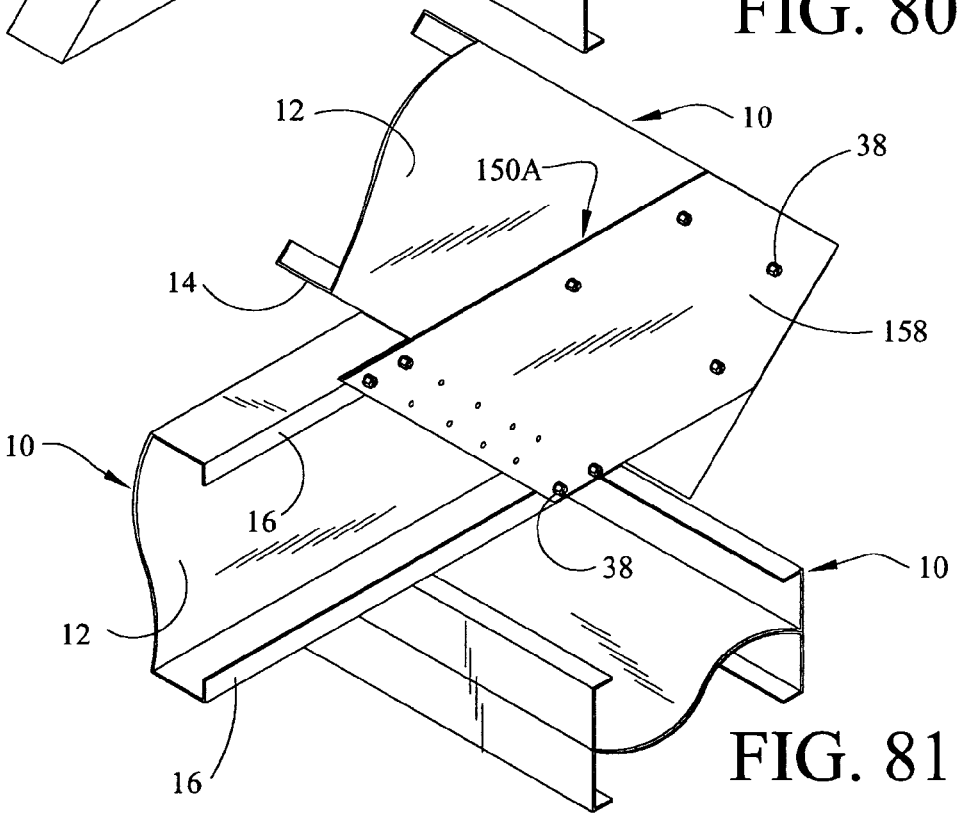
FIG. 81 is a perspective view of the truss bottom connector of FIG. 77 interconnecting a ceiling joist and straight roof rafter.

The manner of use of truss bottom connector 150A is demonstrated in FIG. 81, where connector 150A is shown joining a first framing member 10 functioning as a ceiling joist with a second framing member 10' functioning as a roof rafter. The end of ceiling joist member 10 is angle cut to accommodate roof rafter member 10'. Truss bottom connector 150A is inserted over the cut end of member 10 and secured thereto by applying screws 38 through the pre-drilled holes 32 formed in the ends of flange 154 into base 12 of member 10 (not shown) and through the pre-drilled holes 32 formed in the ends of brace plate 158 into lips 16 of member 10. Roof rafter member 10' is then positioned such that the outside face of one sidewall 14 of member 10' rests against the outside face of end cap 152 of bottom connector 150A and base 12 of member 10' lies adjacent to the inside face of the upper aspect of brace plate 158. Rafter member 10' is secured to connector 150A by applying screws 38 through brace plate 158 into base 12 of member 10'.

Figure 82:
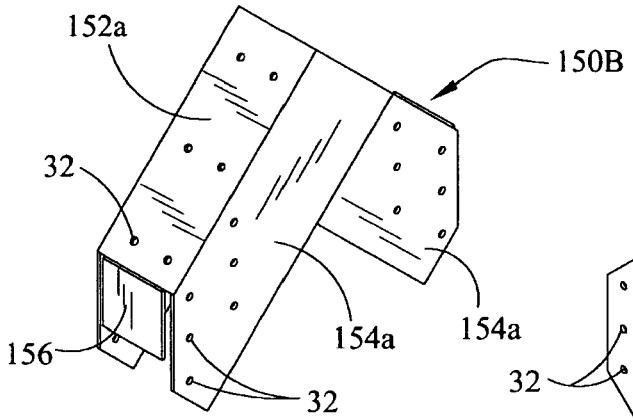
FIG. 82 is a perspective front view of a truss center brace connector.
Figure 83:
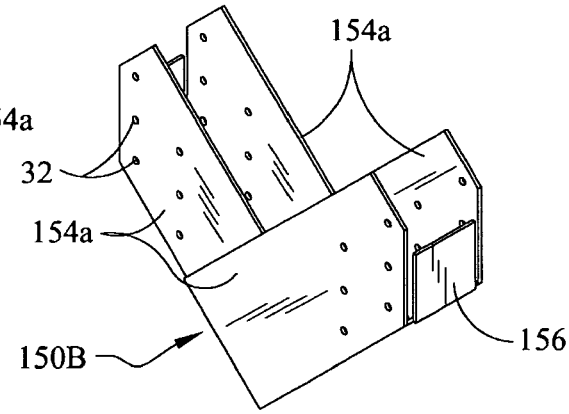
FIG. 83 is a perspective rear view of the truss center brace connector of FIG. 82.

Depicted from the front in FIG. 82 and from the rear in FIG. 83 is a universal truss center brace connector 150B. Connector 150B is comprised of an end cap 152*a* demonstrating a substantially inverted V configuration, two flanges 154*a* one extending from each long side of end cap 152*a* perpendicular thereto, and two sidewalls 156 one extending at an angle from each short side of end cap 152*a*. Pre-drilled holes 32 are formed in rows along end cap 152*a* and flanges 154*a*.

Truss center brace connector 150B is substantially truss end cap connector 150 folded to demonstrate a V-shaped configuration. Like the other connectors of the present invention, connector 150B is folded from a single piece of stamped sheet metal. The lines seen along flanges 154*a* indicates where a fold of the sheet metal used to form connector 150B ends.

Figure 84:
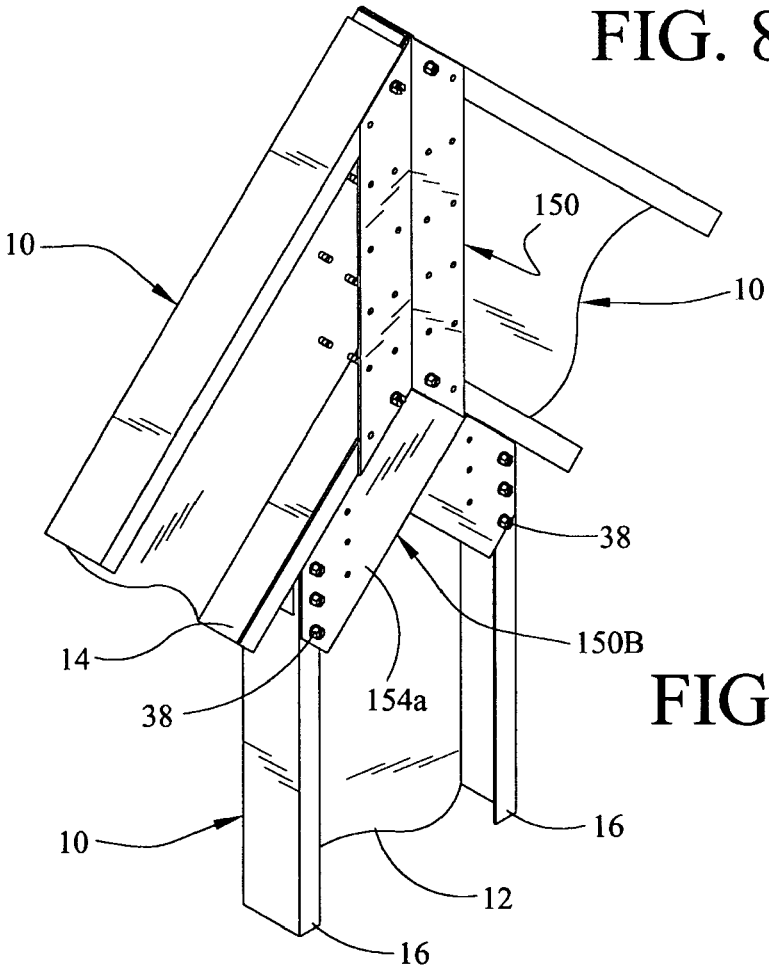
FIG. 84 is a perspective view of two truss end cap connectors of FIG. 75 and the truss center brace connector of FIG. 82 in use.

Truss end cap connectors 150 and truss center brace connector 150B are shown in use in FIG. 84 to join three framing members in a truss roof. Two truss end cap connectors 150 are used to join two first framing members 10 in the same manner as depicted in and described with respect to FIG. 79. One end of a second framing member 10' is cut to demonstrate a point. Truss center brace connector 150B is inserted over the cut end of member 10' such that flanges 154*a* lie against lips 16 of member 10' on the one side and base 12 of member 10' on the other. Connector 150B is secured to member 10' by applying screws 38 through flanges 154*a* into lips 16 and base 12 of member 10', respectively. The outside surface of end cap 152*a* of connector 150B is then positioned to lie against sidewalls 14 of members 10 and is secured thereto by fasteners (not shown) applied through the inside surface of end cap 152*a* of connector 150B into sidewalls 14 of member 10.

Figure 85:
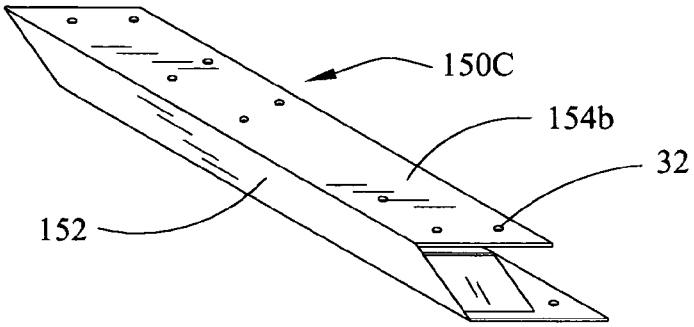
FIG. 85 is a perspective view of a truss end cap connector having compound angles.
Figure 86:
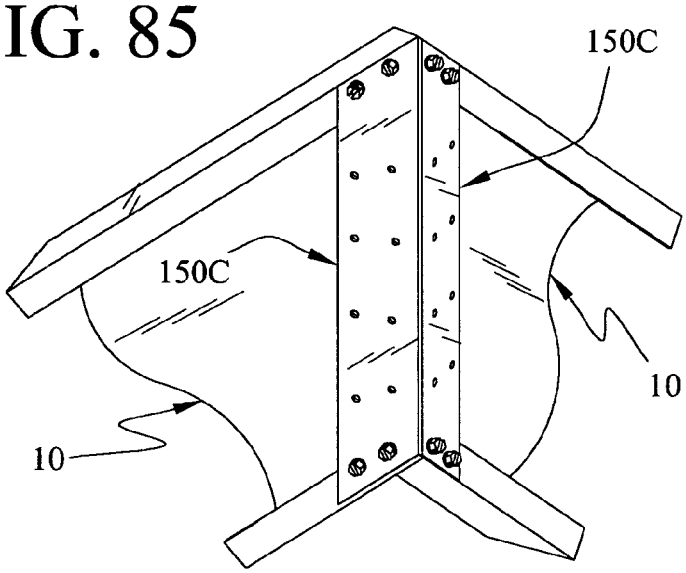
FIG. 86 is a perspective view of two truss end cap connectors of FIG. 85 in use to interconnect two roof trusses at compound angles.

Illustrated in FIGS. 85 and 86 is a universal hip truss connector 150C demonstrating compound angles and its manner of use. Hip truss connector 150C is identical to truss end cap connector 150 except that flanges 154*b* of connector 150C, instead of extending from end cap 152 at right angles thereto, extend to form some acute angle with end cap 152 that corresponds to the angle formed by the hip trusses that connector 150C will be used to interconnect. Hip truss connectors 150C are used as shown in FIG. 86 in a manner analogous to truss end cap connectors 150 shown in FIG. 79. While roof truss members 10 joined by truss end cap connector 150 demonstrate a simple angle in respect to each other, roof truss members 10 joined by hip truss connectors 150C demonstrate a compound angle in respect to each other.

The truss connectors of the present invention function to join and secure a variety of truss members 10 used to construct a truss roof leaving the sidewalls 14 of truss members 10 smooth and free of interruptions of any type. As illustrated in FIGS. 85 and 86, truss connectors 150 can be fabricated to interconnect truss members at a variety of angles including compound angles.

False Wall Construction

FIGS. 87 through 94 illustrate the components for and method of assembly of a false wall of the present invention.

Figure 87:
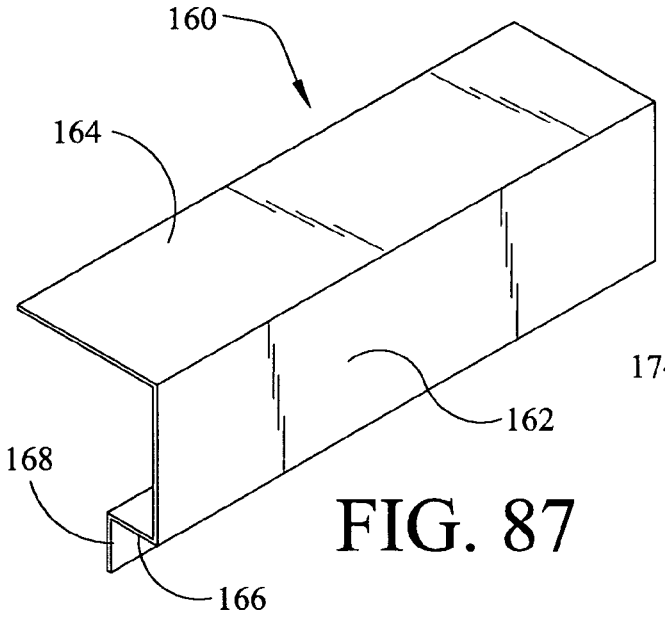
FIG. 87 is a perspective view of a track for a false wall.

Depicted in FIG. 87 is a single track 160 for the false wall assembly. Track 160 is comprised of a first wall face 162 rectangular in shape, a second wall face 164 identical in size and shape to first wall face 162 and joined with first wall face 162 along their respective long sides to form a right angle, a first lip 166 extending from the opposite long side of first wall face 162 perpendicular thereto in an inward direction, and a second lip 168 extending from the available edge of first lip 168 perpendicular thereto in an outward direction.

Figure 88:
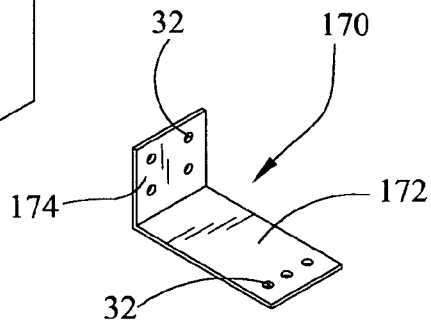
FIG. 88 is a perspective view of a bracket support for the track of FIG. 87.

Depicted in FIG. 88 is a bracket support 170 used to support and reinforce track 160 in the false wall assembly. Bracket 170 is comprised of a bracket plate 172, rectangular in shape, and a bracket flange 174, square in shape, extending from one of the short sides of bracket plate 172 perpendicular thereto. Pre-drilled holes 32 are formed in both bracket plate 172 and bracket flange 174.

Figure 89:
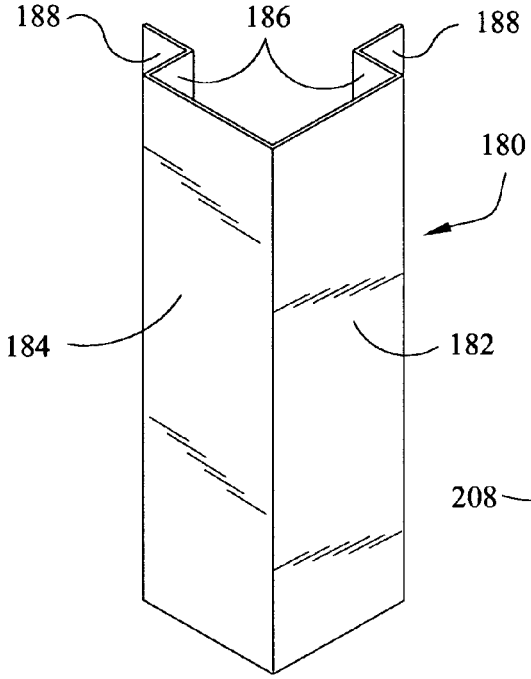
FIG. 89 is a perspective view of a double track for a false wall outside corner.

A double track 180 for forming the outside corner and base of the false wall assembly of the present invention is shown in FIG. 89. Double track 180 is comprised of two rectangular wall faces, 182 and 184, identical in size and shape and joined along their long sides to form a right angle, two first lips 186, one extending from the available long side of each wall face 182 and 184 at right angles to faces 182 and 184 in an inward direction, and two second lips 188 one extending from the available edge of each lip 186 at right angles to lips 186 in an outward direction.

Figure 90:
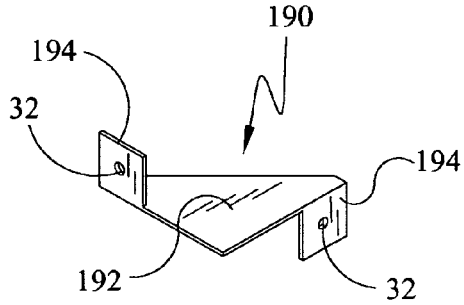
FIG. 90 is a perspective view of a support connector for the double track of FIG. 69.

FIG. 90 shows a support connector 190 used to support and connect double track 180 in the false wall assembly. Support connector 190 is comprised of a connector plate 192 triangular in shape and two connector flanges 194 which extend at right angles and in opposite directions from the bottom sides of triangular shaped plate 192. A single pre-drilled hole 32 is formed in each connector flange 194.

Figure 91:
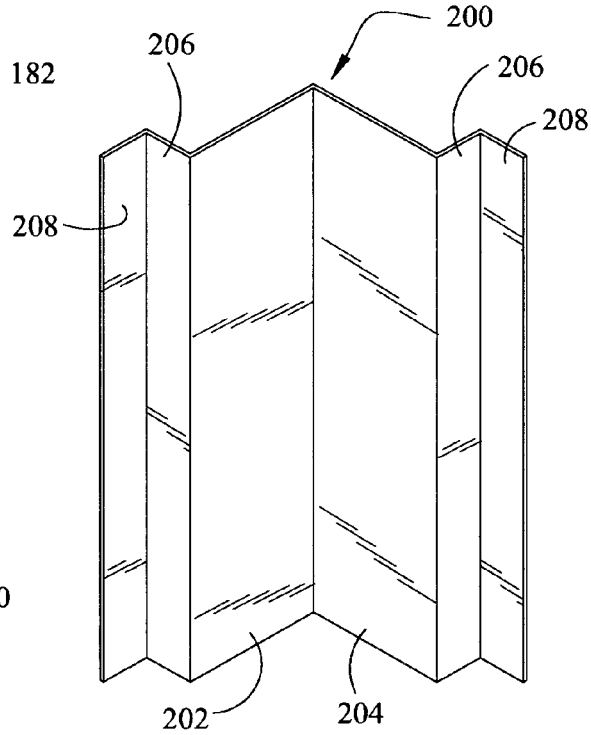
FIG. 91 is a perspective view of a double track for a false wall inside corner.

Illustrated in FIG. 91 is a double track 200 for forming the inside corner of the false wall assembly. Double track 200 comprises a first face 202 rectangular in shape, a second wall face 204 identical in size and shape to first wall face 202 extending from one of the long sides thereof to form a right angle, two first lips 206 one extending from the available side of each wall face 202 and 204 perpendicular thereto and in an outward direction, and two second lips 208 one extending from the available edge of each first lips 206 perpendicular thereto and in an inward direction. Double track 200 is identical to double track 180 shown in FIG. 89 except that first lips 186 and second lips 188 of double track 180 extend first inward and then outward, whereas first lips 206 and second lips 208 of double track 200 extend first outward and then inward.

Figure 92:
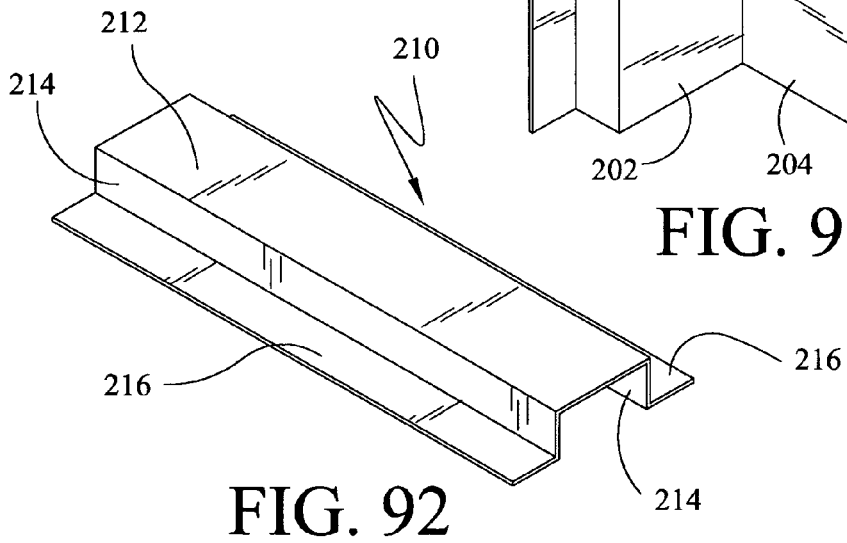
FIG. 92 is a perspective view of a hat channel.

A hat channel 210 is shown in FIG. 92. Hat channel 210 is comprised of a channel base 212 rectangular in shape, two channel sidewalls 214 one extending from each of the long sides of channel base 212 perpendicular thereto, and two channel lips 216 one extending from the available side of each channel sidewall 214 perpendicular thereto and in an outward direction.

Figure 93:
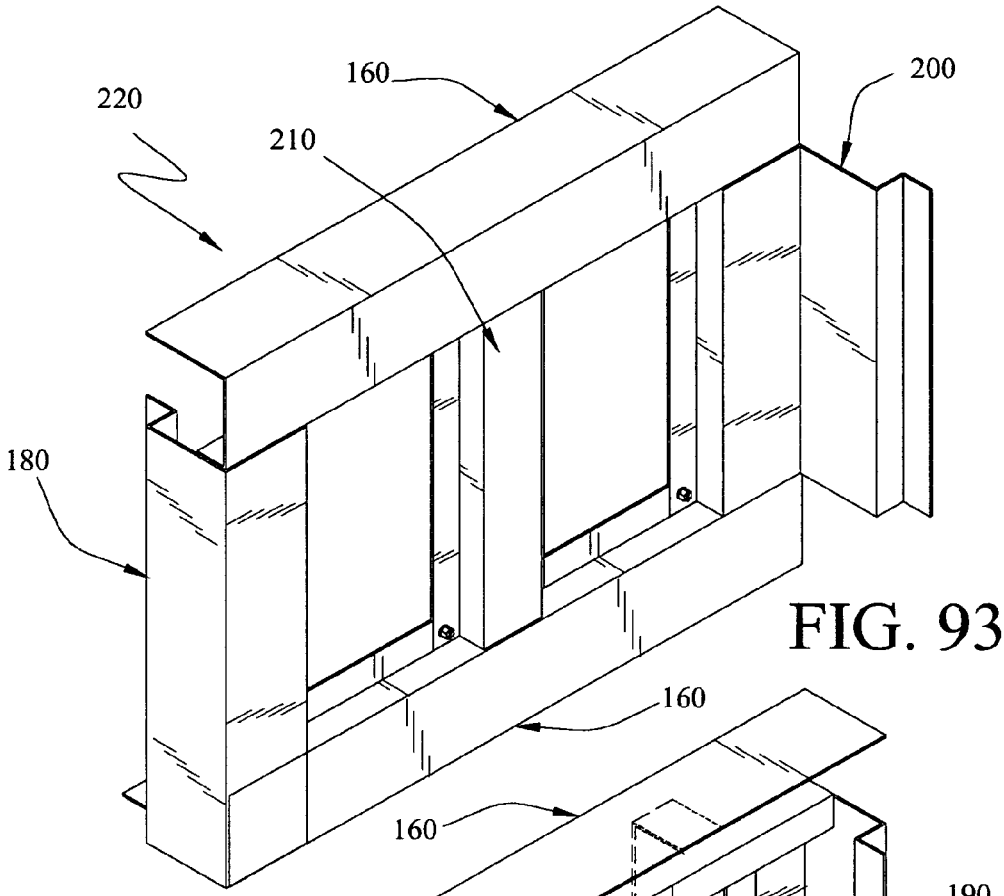
FIG. 93 is a perspective front view of a false wall assembly.
Figure 94:
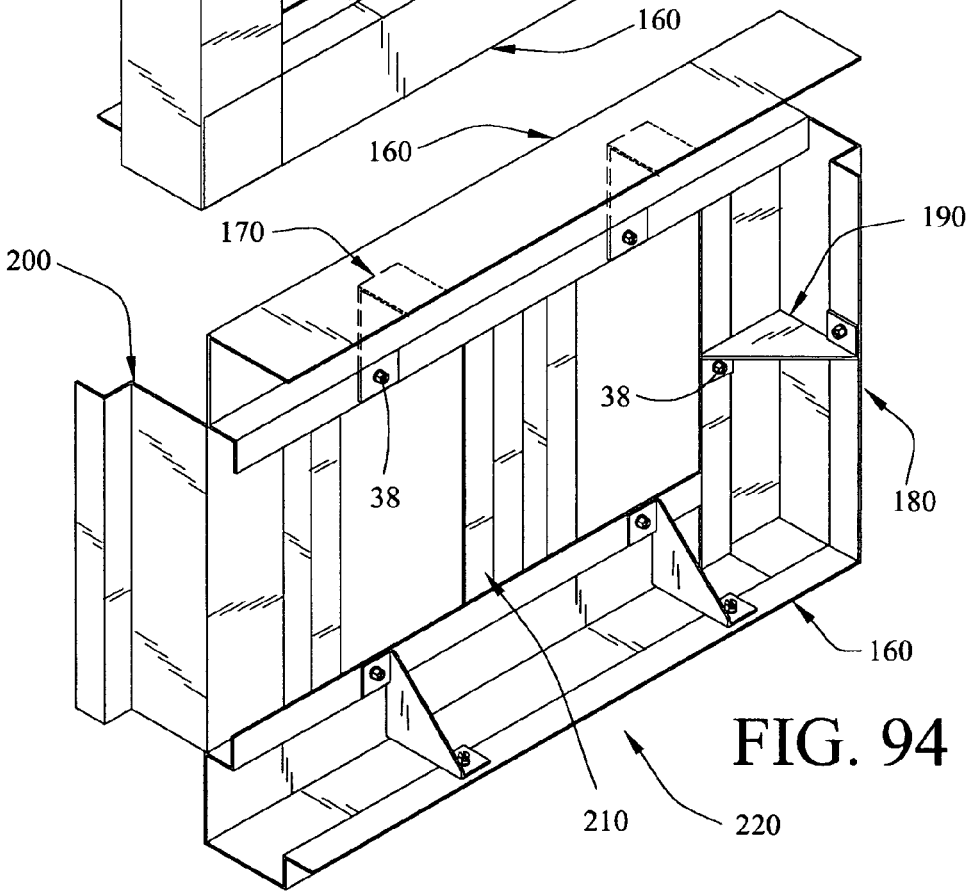
FIG. 94 is a perspective rear view of the false wall assembly of FIG. 93.

A false wall assembly 220 of the present invention is illustrated from the front in FIG. 93 and from the rear in FIG. 94. Single track 160 forms the top aspect of assembly 220 and is supported and reinforced by support brackets 170. Double tracks 180 forms the bottom aspect and outside corner (on the left in FIG. 93 and on the right in FIG. 94) of assembly 220 and are supported by support connectors 190. Hat channel 210 forms the support seen in the middle of assembly 220. Double track 200 forms the inside corner (on the right of FIG. 93 and on the left in FIG. 94) of false wall assembly 220. Screws 38 are applied through bracket supports 170 and support connectors 190 but also through the ends of the outside lips of the tracks and channel components to secure the component one to the other.

It will be appreciated by those skilled in the art that tracks 160, 180 and 200 and channel 210 can be joined in an almost infinite variety of ways to form false walls of different sizes and configurations, all such false walls being within the scope and objects of the present invention. Tracks 160, 180 and 200 can be manufactured to exhibit angles such that the resulting false wall will present at an angle or, where appropriate, will exhibit compound angles.

Through the use of track and channel components having lips through which the components may be joined together, false wall assembly 220 is constructed leaving the outside faces of assembly 220 smooth and fastener free. Like the outside surface of framed structures employing the connectors of the present invention, the outside surface of false wall assembly 220 can be covered quickly and inexpensively as a result of its surface being continuous and uninterrupted.

Hollow Wall Construction

Figure 95:
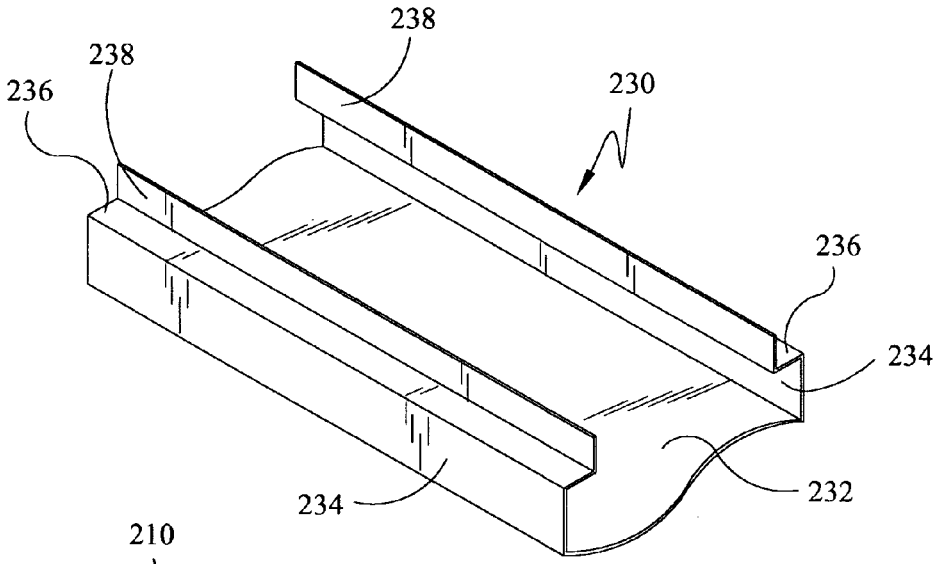
FIG. 95 is a perspective view of a hollow wall track.
Figure 96:
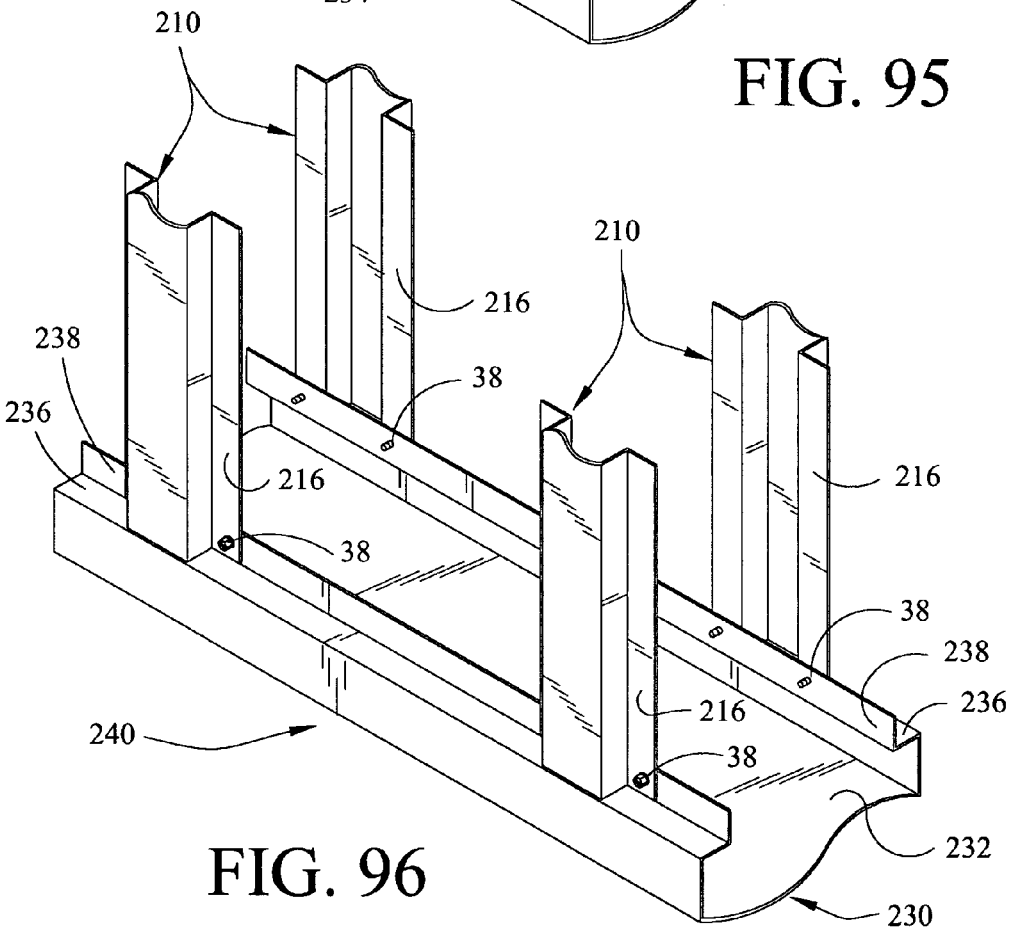
FIG. 96 is a perspective view of a hollow wall assembly comprising the hollow wall track of FIG. 95 and the hat channels of FIG. 92.

Components and the method for construction of a hollow wall having a smooth outside surface are illustrated in FIGS. 95 and 96.

Depicted in FIG. 95 is a hollow wall track 230. Track 230 is comprised of a track base 232, two track sidewalls 234 one extending from each side of track base 232 perpendicular thereto, two first lips 236 one extending from the available side of each sidewall 234 perpendicular thereto in an inward direction, and two second lips 228 one extending from the available edge of each first lip 236 perpendicular thereto in an outward direction. Hollow wall track 230 is substantially framing member 10 with a second lip 238 extending outward from and perpendicular to each first lip 236 (16 in member 10).

A hollow wall assembly 240 is shown in FIG. 96. Assembly 240 is comprised of hollow wall track 230 with track base 232 positioned face down, and a plurality of hat channels 210 (depicted in and described with respect to FIG. 92) secured thereto and extending from either side thereof. Hat channels 210 are positioned with respect to hollow wall track 230 such that the ends of hat channels 210 abut the top of first lips 236 of wall track 230 and the ends of the outside lips 216 of hat channels 210 lie against the outside face of second lips 238 of track 230. Hat channels 210 are secured to wall track 230 by applying screws 38 through the ends of outside lips 216 of hat channel 210 into the outside lips 238 of hollow wall track 230. Not shown is a second hollow wall track 230 which forms the top of hollow wall assembly 240 and which is secured to hat channels 210 in the same manner as the track 230 shown.

As with false wall assembly 220, the components 210 and 230 that comprise hollow wall assembly 240 can be fabricated in different sizes and to demonstrate different angles, thereby providing for hollow walls of different dimension as well as hollow walls exhibiting angles and compound angles.

Due to the hollow wall assembly components being secured one to the other with fasteners applied to component lips and not component surfaces, hollow wall assembly 240 of the present invention provides hollow walls having smooth and continuous outside surfaces that are easy and inexpensive to cover.

Smooth-faced Framing Tracks and Track Connectors

Smooth-faced framing tracks and specially configured connectors for use with these tracks are illustrated in FIGS. 97 through 109.

Figure 97:
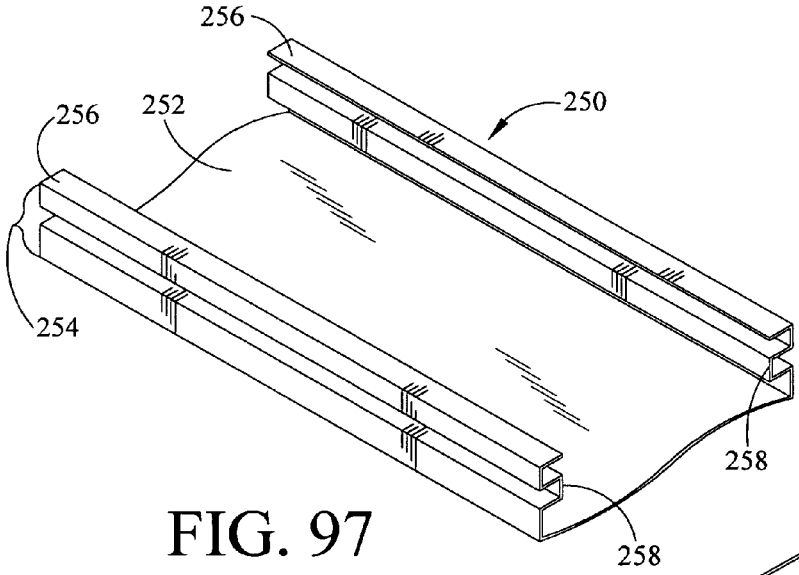
FIG. 97 is a perspective view of a smooth-faced framing track having recess channels along its sides.

Depicted in FIG. 97 in perspective view is a universal smooth-faced framing track 250. Track 250, which can function in the manner of a track or stud, is comprised of a track base 252, two track sidewalls 254 one extending from each side of track base 252 perpendicular thereto, two recess channels 258 one extending along the length of each track sidewall 254 and projecting inward therefrom, and two track lips 256 one extending from the top of each sidewall 254 perpendicular thereto and projecting inward therefrom. Recess channels 258 are spaced apart from both track base 252 and track lips 256 and extend inward from track sidewalls 254 to the same extent as do track lips 256.

Figure 98:
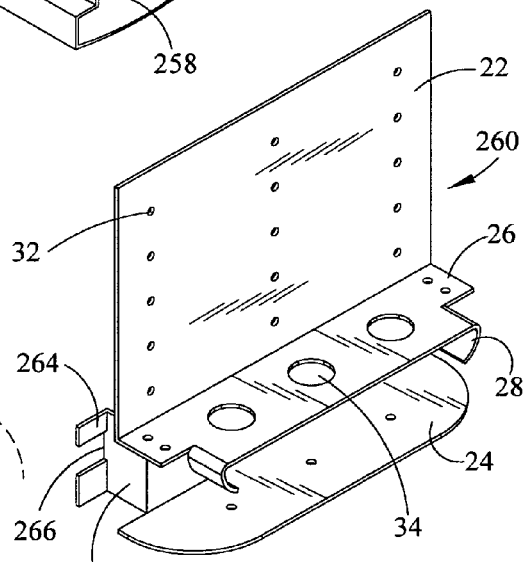
FIG. 98 is a front perspective view of a first snap-in right angle track connector.

FIG. 98 is a front perspective view of a first universal snap-in right angle track connector 260. Right angle track connector 260 is closely analogous to snap-in right angle stud connector 20 shown in FIGS. 2 through 11, but has been specially adopted to accommodate framing track 250. Snap-in track connector 260 comprises a brace plate 22 generally rectangular in configuration, a base flange 24 extending from the bottom of brace plate 22 perpendicular thereto, a lip flange 26 extending out from brace plate 22 perpendicular thereto and spaced apart from base flange 24 by a distance that approximates the distance between track base 252 and track lip 256 of framing track 250 shown in FIG. 97, sidewalls 262 which extend from the bottom portion of brace plate 22 perpendicular thereto and in an opposite direction from base flange 24 and lip flange 26, and two sidewall extensions 264 one extending out from the available side of each sidewall 262, each sidewall extension 264 exhibiting a rectangular shaped extension cutout 266. A plurality of pre-drilled holes 32 are formed in parallel series along the top portion of brace plate 22, the edges of lip flange 26, and the length of base flange 24. A plurality of access cutouts 34 are formed along the length of lip flange 26, allowing access to the pre-drilled holes 32 formed in base flange 24. Locking clips 28 extend down and inward from the outside edges of lip flange 26.

Base flange 24 is shown with radius cut edges, but can also be fabricated to demonstrate right-angle corners as exhibited by many of the stud connectors described earlier.

It should be noted that, as compared to snap-in right angle stud connector 20, the lower portion of brace plate 22 of track connector 260 is narrower than the top portion thereof in order to accommodate recess channels 258 of smooth-faced framing track 250. Similarly, extension cutouts 266 are positioned and sized to fit recess channels 258.

Figure 99:
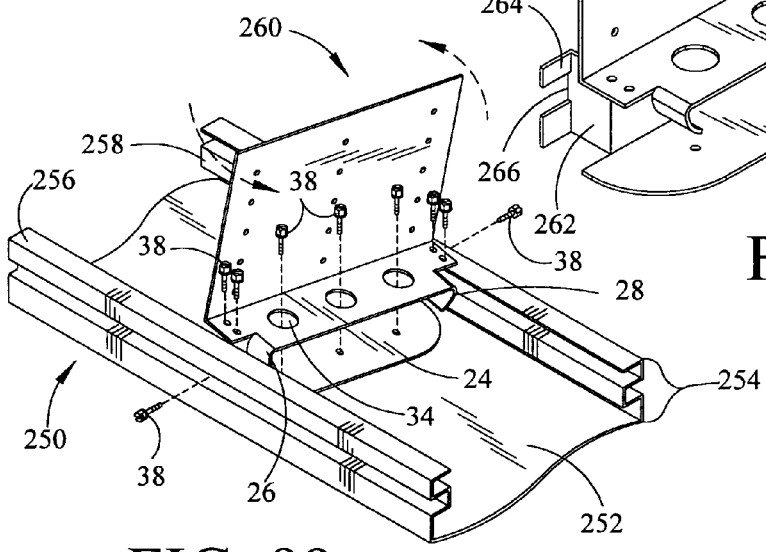
FIG. 99 illustrates in perspective view the manner of inserting and securing the snap-in right angle track connector of FIG. 98 within the smooth-faced framing track of FIG. 97.

FIG. 99 illustrates the manner of insertion and securing of right angle track connector 260 within smooth faced framing track 250. Like stud connector 20, track connector 260 is snapped into position on framing track 250 by inserting one end of connector 260 with locking clip 28 under a lip 256 of track 250 and then rotating connector 260 at the same time as tilting connector 260 forward from the top until both track lips 256 are locked between locking clips 28 and the edges of lip flange 26. Once locked in position, base flange 24 abuts the inside of track base 252 while extension cutouts 266 (not shown) receive recess channels 258. Track connector 260 is secured in position within track 250 by applying a plurality of self tapping screws 38 through the top of lip flange 26 into track lips 256, through the top of base flange 24 into track base 252 as facilitated by access cutouts 34, and from the sides through recess channels 258 of track 250 into sidewalls 262 (also not shown) of connector 260. Because track sidewalls 254 include a recessed channel 258, screws 38 can be applied from the outside of track 250 inwards without leaving a screw head protruding from the smooth face of track sidewall 254 (as shown in FIG. 100).

Figure 100:
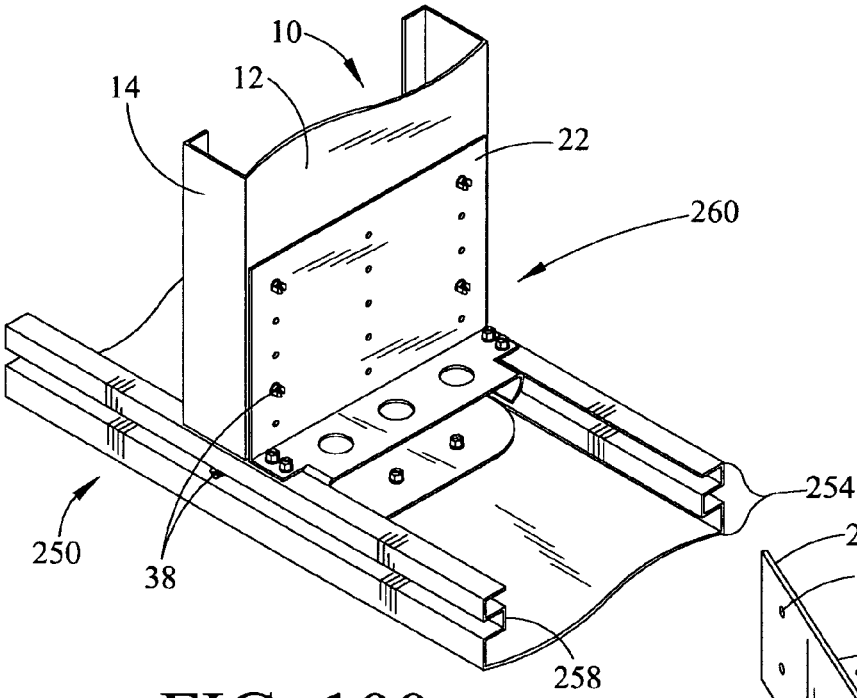
FIG. 100 illustrates in perspective view the snap-in right angle track connector of FIG. 98 interconnecting the smooth-faced framing track of FIG. 97 and a framing stud.

FIG. 100 illustrates track connector 260 interconnecting smooth-faced framing track 250 with a framing stud 10. Track connector 260 has been inserted and secured within track 250 in the manner illustrated in and discussed with respect to FIG. 99. Stud 10 is placed with the underside of base 12 adjacent to the back of brace plate 22 of connector 260, and then secured in place using screws 38 applied from the front of brace plate 22 into base 12 of stud 10. As will be appreciated from examining FIG. 100, the use of track 250 and track connector 260 allows for fasteners to be applied in three directions while still leaving the sidewalls 254 and 14 of track 250 and stud 10, respectively, free of fastener heads or other protrusions that can make the application of wall covering difficult and expensive.

Figure 101:
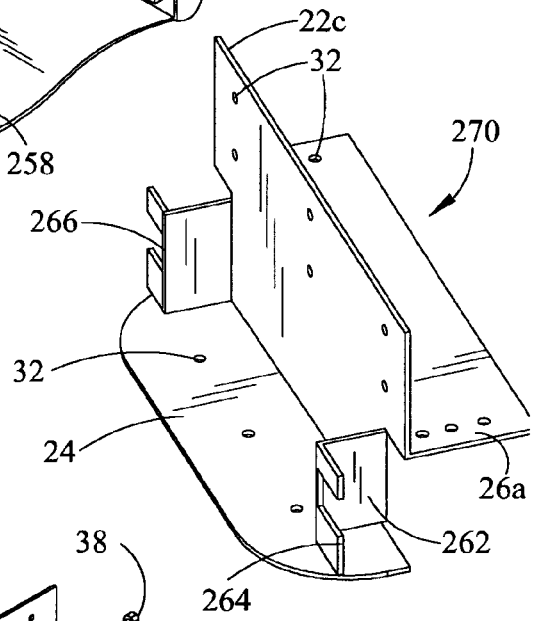
FIG. 101 is a perspective rear view of a compact right angle track connector with reverse base flange.

Illustrated in FIG. 101 in perspective rear view is an alternative universal snap-in right angle track connector 270. Compact right angle track connector 270 with reverse base flange is analogous to snap-in compact right angle stud connector 50A illustrated in FIG. 27 except that connector 270 has been specially adopted to accommodate framing track 250. Track connector 270 comprises a compact brace plate 22*c*, of base flange 24 which extends from the bottom of brace plate 22*c* perpendicular thereto, a lip flange 26*a* which extends from an intermediate point along the length of brace plate 22*c* perpendicular thereto and in an opposite direction from base flange 24, two connector sidewalls 262 one extending from the bottom portion of each side of brace plate 22*c* perpendicular thereto and in the same direction as base flange 24, two sidewall extensions 264 one extending from the available edge of each sidewall 262 perpendicular thereto and in an outward direction, and each sidewall extension 264 exhibiting extension cutouts 266 rectangular in shape.

Although base flange 24 exhibits radius cut edges, track connector 270 can equally employ a base flange that demonstrates right angle corners.

As with track connector 260, base flange 24 and lip flange 26*a* are spaced apart by a distance that approximates the distance between track base 252 and track lip 256 of framing track 250, the lower portion of brace plate 22*c* is narrow relative to the top portion thereof in order to accommodate recess channels 258 of track 250, and extension cutouts 266 are shaped and positioned to receive recess channels 258. Pre-drilled holes 32 are formed along the upper portion of brace plate 22*c*, along the length of base flange 24, and along the edges of lip flange 26*a*.

Figure 102:
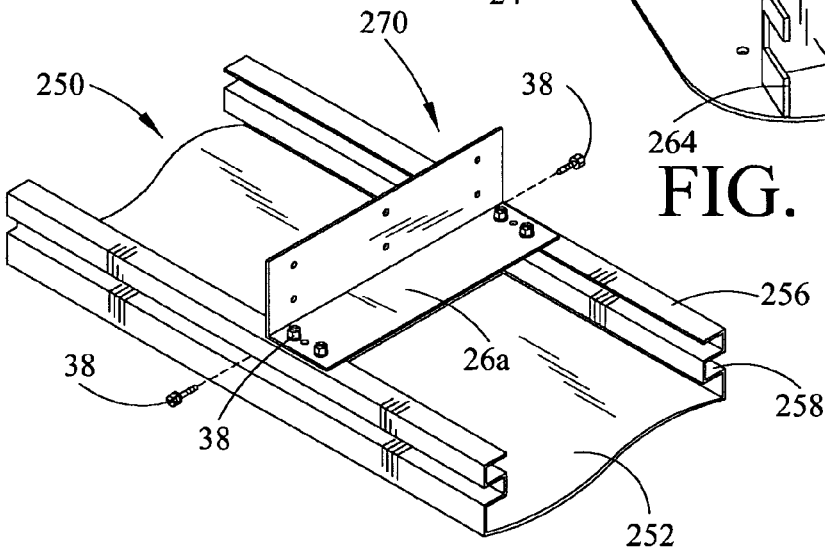
FIG. 102 is a perspective view of the snap-in compact right angle track connector of FIG. 101 positioned and secured within the smooth-faced framing track of FIG. 97.

Depicted in FIG. 102 is snap-in compact right angle track connector 270 secured within framing track 250. Track connector 270 is snapped into and locked within framing track 250 by twisting and bending in the same manner as was described for track connector 260 in the context of FIG. 99. Once locked into position, base flange 24 (not shown) lies adjacent to and on top of the inside portion of track base 252, the edges of lip flange 26*a* abut the top of track lips 256, and extension cutouts 266 (also not shown) receive recess channel 258. Track connector 270 is secured within track 250 by applying self tapping screws 38 from the top of lip flange 26*a* into track lips 256, and from the sides of track 250 through recess channels 258 into sidewalls 262 (not shown) of connector 270.

Figure 103:
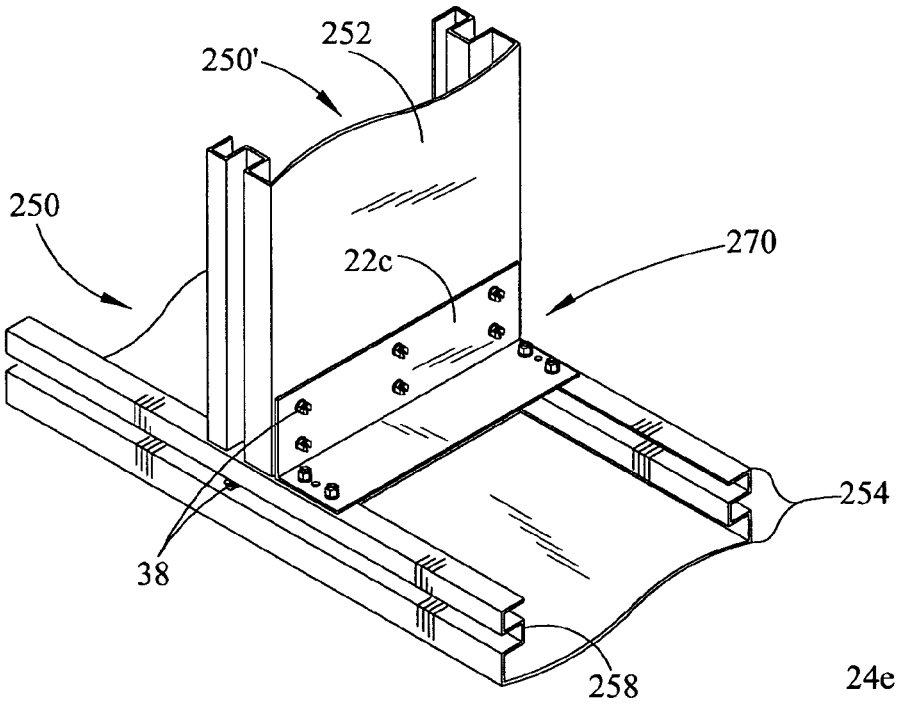
FIG. 103 is a perspective view of the compact right angle track connector interconnecting two smooth-faced framing tracks.

Compact right angle track connector 270 interconnecting two smooth-faced framing tracks 250 and 250' is illustrated in FIG. 103. Track connector 270 has been snapped into and secured within track 250 in the manner shown in FIG. 102. A second track 250' is positioned such that the bottom of track base 252 lies adjacent to the backside upper portion of brace plate 22*c* of connector 270. Self tapping screws 38 are inserted through pre-drilled holes 32 formed in brace plate 22*c* into track base 252 of track 250'.

As was the case with right angle track connector 260, compact right angle track connector 270 with reverse base flange functions as illustrated in FIG. 103 to interconnect two framing tracks 250 with fasteners applied in three dimensions while still leaving sidewalls 254 of both tracks smooth and free of any protrusions or other interruptions.

FIG. 100 shows track connector 260 interconnecting framing track 250 with stud member 10. FIG. 103 demonstrates track connector 270 interconnecting two framing tracks 250 and 250'. It will be appreciated by those skilled in the art of metal framing that both track connectors 260 and 270 may be used to interconnect either two framing tracks 250 as illustrated in FIG. 103, or one framing track 250 with a stud member 10 as illustrated in FIG. 100.

While connectors 260 and 270 have been specially configured to interface with smooth-faced framing track 250 with its recess channels 258 formed along its sidewalls, all the right angle stud connectors of the subject invention are easily adopted for use with track 250. It has already been noted that the bottom aspect of brace plates 22 and 22*c* of track connectors 260 and 270, respectively, are narrow relative to their top aspect in order to accommodate recess channels 258. Each of the right angle stud connectors described earlier can be fabricated to demonstrate a brace plate having a similarly narrowed bottom aspect such that they fit snugly within track 250. Explained in other terms, each of the right angle stud connectors described previously can be modified such that bottom aspect of the brace plate that lies between the lip flange and base flange extends out only until where the inner aspect of groove 36 presently shown on these connectors end. It will be appreciated, however, that only those stud connectors having sidewalls can be secured to framing track 250 through fasteners applied through recess channels 258. Accordingly, right angle stud connectors adopted for use with framing track 250 will sometimes, though not always, interconnect tracks and studs in three dimensions whereas the specially configured track connectors of the present invention will in all circumstances be capable of doing so.

Figure 104:
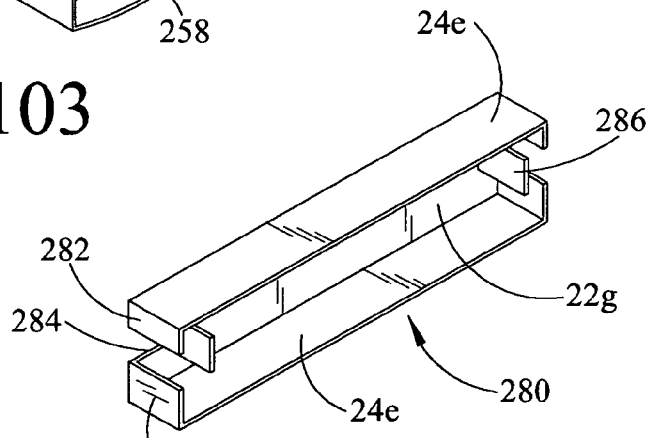
FIG. 104 is a perspective view of an end cap track connector.

A universal end cap track connector 280 is illustrated in perspective view in FIG. 104. End cap track connector 280 is analogous to combination end-cap/mounting stud connector 90B illustrated in FIGS. 58B and 59, but has been modified to fit framing track 250. Track connector 280 is comprised of an elongated rectangular brace plate 22*g*, two base flanges 24*e* one extending from each available long side of brace plate 22*g* perpendicular thereto and extending in the same direction, four sidewall flanges 282 one extending from each available short side of base flange 24*e*, two brace plate cutouts 284 one extending inward from the middle of each short side of brace plate 22*g*, and two channel flanges 286 one extending from the inside aspect of each brace plate cutout 284 perpendicular to brace plate 22*g* and in the same direction as base flanges 24*e*. Brace plate 22*g* is sized so that end cap connector 280 will fit snugly inside framing track 250, with sidewall flanges 282 abutting the inside of track sidewalls 254, brace plate cutouts 284 sized and positioned to receive recess channels 258 of track 250, and channel flanges 286 to lie adjacent to the inside aspect of recess channels 258.

Figure 105:
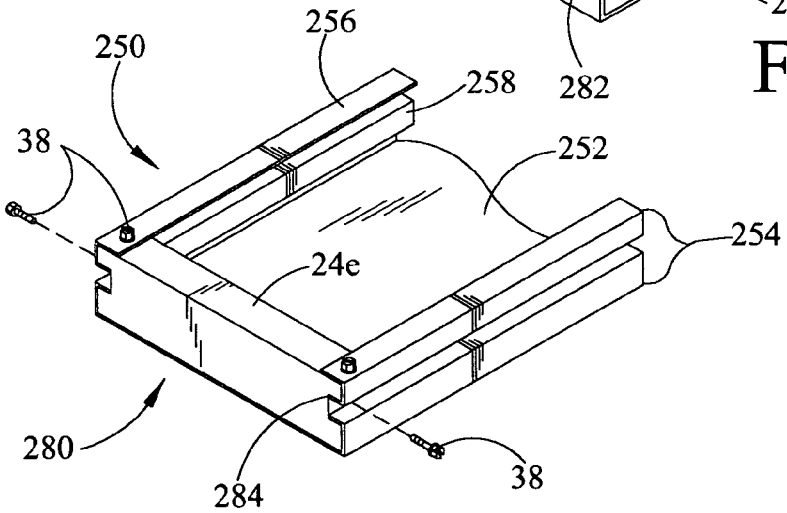
FIG. 105 is a perspective view of the end cap track connector of FIG. 104 in use as an end cap.

Depicted in FIG. 105 is the manner of insertion and securing of end cap track connector 280 within the end of framing track 250. Track connector 280 is slid into one of the available ends of framing track 250 with the outside of one base flange 24*e* (not shown in this figure) lying on top of the inside surface of track base 252, the outside of the other base flange 24*e* lying adjacent to and abutting the inside surface of track lips 256, brace plate cutouts 284 receiving and encircling the inside surfaces of recess channels 258, the outside surface of channel flanges 286 (not shown) lying adjacent to the inside inward aspect of recess channels 258, and the outside surfaces of sidewall flanges 282 (also not shown) lying adjacent to the inside aspects of track sidewalls 254. End cap track connector 280 is secured at the end of smooth-faced framing track 250 utilizing self tapping screws 38 applied from the top of track lips 256 into the outside edges of base flange 24*e* and also from the sides of connector 280 through recess channels 258 into channel flanges 286 of connector 280. It will be appreciated that the recess channels 258 in framing track 250 combined with counterpart elements found on track connector 280 permit connector 280 to be secured within track 250 in two dimensions while leaving the track sidewalls 254 of framing track 250 free of fastener heads or other protrusions.

Although not illustrated here, end cap track connector 280, like its counterpart end cap stud connectors 90A and 90B illustrated in FIGS. 58 through 61 above, and also like truss end cap stud connector 150 illustrated in FIGS. 75 and 76 above, is particularly useful to tie a stud in the case of connectors 90 and 150, or a track in the case of connector 280, to concrete, a steel I-beam, or any hard surface.

Figure 106:
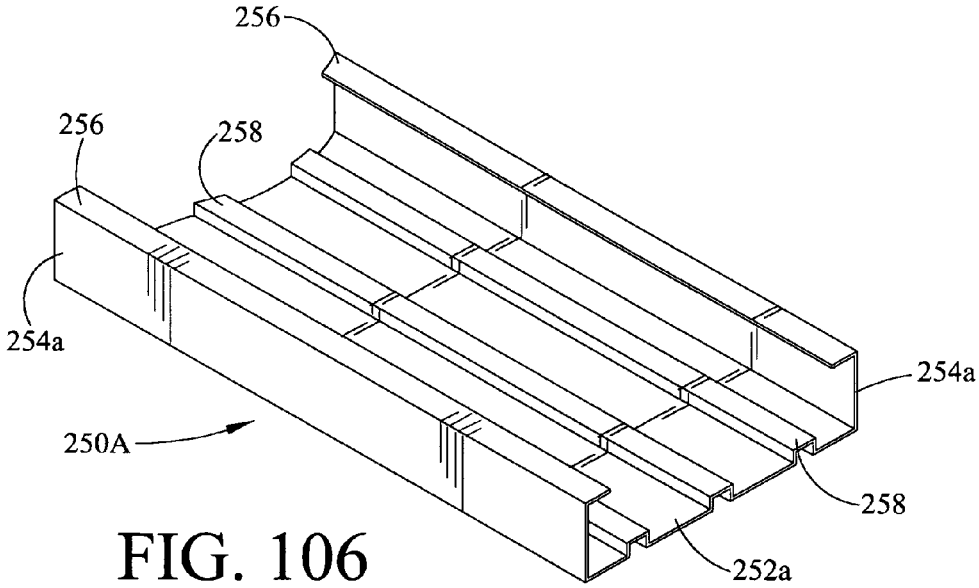
FIG. 106 is a perspective top view of an alternative smooth-faced framing track having recess channels along its base.

A top perspective view of an alternative universal smooth-faced framing track 250A is illustrated in FIG. 106. Smooth-faced framing track 250A is comprised of a track base 252*a* having three recess channels 258 running the length thereof, two sidewalls 254*a* extending in parallel fashion perpendicular from each long slide of base 252*a*, and two track lips 256 one extending from each available side of track sidewall 254*a* perpendicular therefore and inward therefrom. Recess channels 258 of framing track 250A perform the same function as recess channels 258 of framing track 250, to wit permitting the application of screws or other fasteners such that the fastener head will not protrude from the outside surface once the fastener has been fully inserted. In the case of track 250A, recess channels 258 are formed along the track base 252*a* to allow the application of fasteners from the bottom while leaving the bottom surface of track base 252*a* smooth. In the case of track 250, recess channels 258 are formed along the sidewalls 254 to allow the application of fasteners from the sides while leaving the outside surface of sidewalls 254 smooth.

Figure 107:
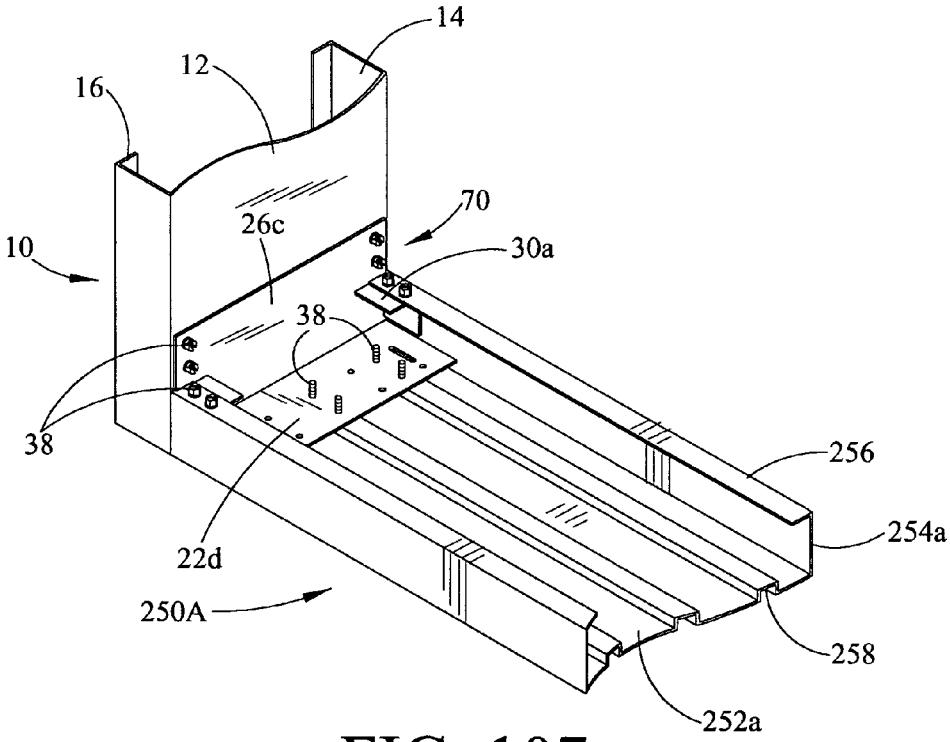
FIG. 107 is a perspective view of a slide-in combination right angle corner connector of FIG. 44 interconnecting the alternative smooth-faced framing track of FIG. 106 and a framing stud.

Smooth-faced framing track 250A is shown being interconnected with a stud member 10 in FIG. 107 utilizing slide-in combination right angle corner connector 70 (illustrated in and described with respect to FIGS. 44 and 45 above). Corner connector 70 has been slid into an available end of track 250A and secured there using self tapping screws 38 applied from the top of lips 256 of track 250A into tabs 30*a* of connector 70 and also from the bottom of track base 252*a* through recess channels 258 into brace plate 22*d*. Because track base 252*a* is recessed along each recess channel 258, fasteners can be applied through base 252*a* of recess channels 258 without the screw head protruding from the bottom thereof. Though not shown, fasteners can also be applied from the top through the pre-drilled holes 32 formed in brace plate 22*d* where brace plate 22*d* lies atop recess channels 258, down through brace plate 22*d* and into recess channels 258. When using fasteners of an appropriate length, the tips of such fasteners also will not protrude from the bottom of track base 252*a*.

Stud member 10 is then positioned such that its base 12 lies adjacent to the back of lip flange 26*c* and is secured in position using self-tapping screws 38 applied from the front of lip flange 26*c* into base 12 of member 10. Though not illustrated in here, stud member 10 can also be positioned such that its lips 16 abut the bottom edges of lip flange 26*c* and screws 38 secure connector 70 to member 10 through lip flange 26*c* and lips 16 (in the manner illustrated in FIG. 48 above).

Although only right angle stud connector 70 is shown joining framing track 250A to a stud member 10, all the right angle stud connectors of the present invention can be used in like manner with smooth-faced framing track 250A. Because the right angle stud connectors of the present invention are designed to leave the sidewalls 254*a* of framing track 250A fastener free, the use of right angle stud connectors with track 250A results in interconnected tracks or interconnected tracks and studs having smooth-faced sidewalls and bases. It will be appreciated, however, that the distance between the base and lip flange of a stud connector, when used with framing track 250A, will approximate the distance between track lips 256 and track base 252*a* as measured from the raised aspect of recess channels 258 in base 252*a*. When stud connectors are used with stud members 10, that same distance is measured from the bottom of base 12 of member 10.

Figure 108:
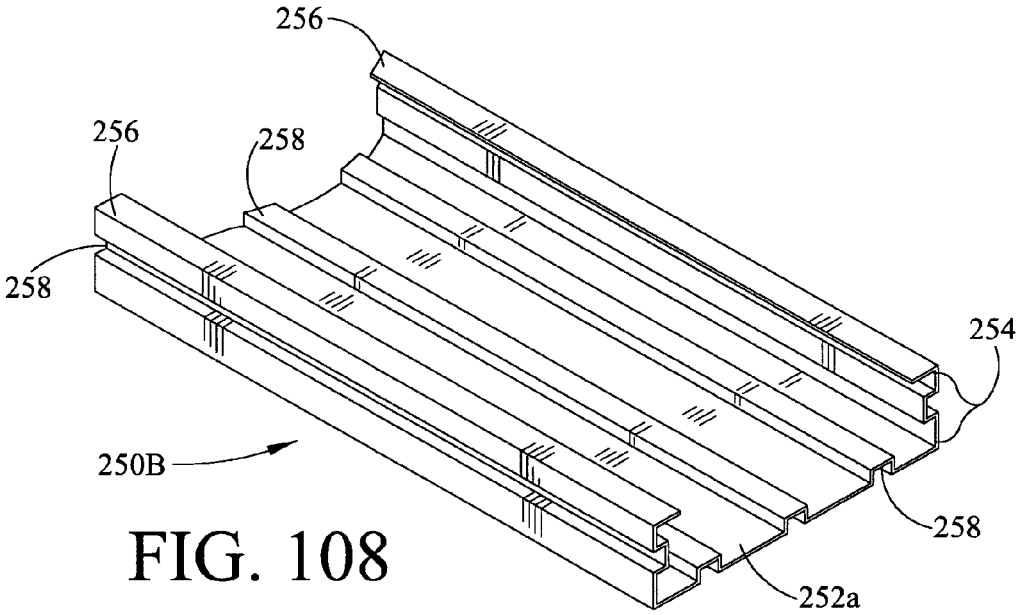
FIG. 108 is a perspective view of a further alternative smooth-faced framing track having recess channels along both its sides and its base.

A further alternative universal smooth-faced framing track is illustrated in perspective view in FIG. 108. Smooth-faced framing track 250B is comprised of a track base 252*a* having three recessed channels 258 running along its length, two sidewalls 254 extending in parallel fashion one from each long side of base 252*a* perpendicular thereto and each having a single recess channel 258 extending along its length, and two lips 256 one extending from the available long side of each sidewall 254 perpendicular thereto and projecting inward. In essence, smooth-faced framing track 250B is a framing track that combines the sidewall configuration of framing track 250 with the base configuration of framing track 250A, thereby allowing fasteners to be applied from the outside of both sidewalls 254 and track base 252*a* while leaving the outside surfaces of sidewalls 254 and base 252*a* free of fastener heads and other interruptions.

Figure 109:
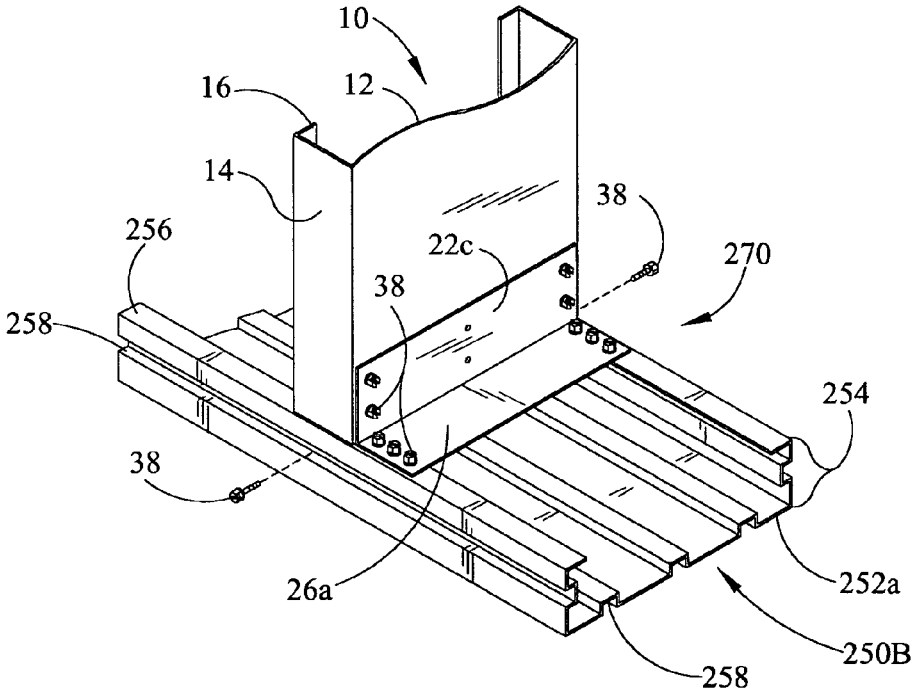
FIG. 109 is a perspective view of the compact right angle track connector of FIG. 101 interconnecting the smooth-faced framing track of FIG. 108 and a framing stud.
Figure 110:
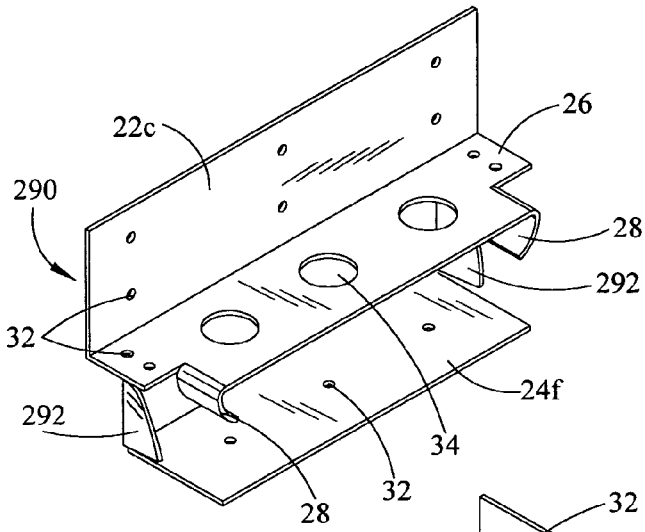
FIG. 110 is a perspective front view of a press-in right angle track/stud connector.
Figure 111:
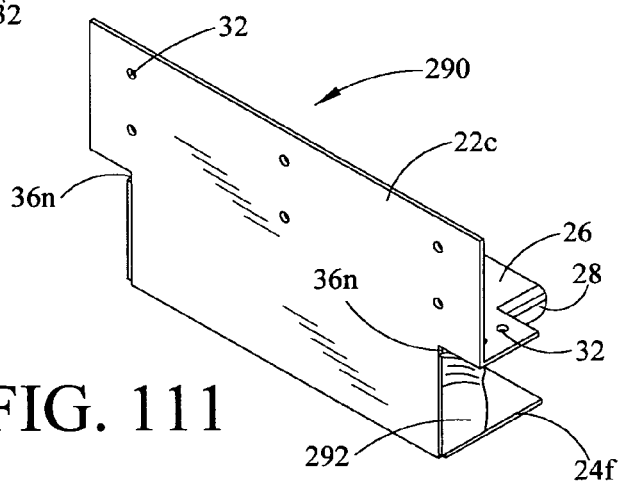
FIG. 111 is a perspective rear view of a press-in right angle track/stud connector.

Compact right angle track connector 270 with reverse base flange is shown interconnecting framing track 250B with stud member 10 in FIG. 109. Connector 270 is snapped into position along framing track 250B with reverse base flange 24 (not shown in this figure) lying on top of the raised aspects of recess channels 258 formed in track base 252*a* and extension cutouts 266 (also not shown) receiving and encircling the raised aspects of recess channels 258 formed in sidewalls 254. Connector 270 is secured in position within framing track 250B using self tapping screws 38 applied in a first direction from the top through lip flange 26*a* into track lips 256, in a second direction from the sides through recessed channels 258 formed in sidewalls 254 of track 250B into sidewalls 262 of connector 270, and in a third direction from the bottom (not shown) through recess channels 258 formed in base 252*a* of track 250B into reverse base flange 24.

Stud member 10 is then positioned behind connector 270 and secured thereto using screws 38 applied through brace plate 22*c* into the base 12 of member 10. Stud member 10 can alternatively be positioned such that its lips 16 abut the back of brace plate 22*c* and secured thereto using screws 38 applied through brace plate 22*c* into stud lips 16. It will be appreciated that framing track 250B is now interconnected to stud member 10, using fasteners in three dimensions, while leaving sidewalls 254 and 14 of track 250B and member 10, respectively, and of base 252*a* of track 250B, smooth and fastener free.

Track connectors 260, 270, and 280, like the stud connectors of the present invention, can be fabricated to interconnect tracks, or to interconnect tracks and studs, at angles other than 90 degrees and at compound angles one to the other.

As already discussed with respect to framing track 250 above, all the right angle stud connectors of the present invention can be adopted for use with framing track 250B simply by fabricating the bottom aspect of the brace plate narrower to accommodate access channels 258 formed in the sidewalls 254 of framing track 250B. Only those stud connectors having sidewalls will be secured in three dimension also through the sidewall access channels 258, the remaining stud connectors being secured in two dimensions through their base and lip flanges only.

In addition, although not illustrated herein, it will be appreciated that tracks 250 can be manufactured in modified form such that track sidewalls 254 extend at some angle other than 90 degrees relative to track base 252. These angled tracks 250 can be used together with track connectors modified to accommodate the angled tracks to join stud members and tracks at angles other than 90 degrees.

Combination Track/Stud Connector

A combination track and stud connector, and its manner of use, is illustrated in FIGS. 110 through 114. A universal press-in right angle track/stud connector 290 is shown in perspective view from the front in FIG. 110 and from the rear in FIG. 111. Track/stud connector 290 comprises a brace plate 22*c* with its bottom aspect narrower than its top aspect, a base flange 24*f* having a narrowed width commensurate with the bottom aspect of brace plate 22*c* and extending from the bottom thereof perpendicular thereto, a lip flange 26 extending from brace plate 22*c* perpendicular thereto and spaced apart from base flange 24*f* by a distance that approximates the distance between the base of a stud or track and the lip of the same stud or track, locking clips 28 extending downwards and inwards from the outside edges of lip flange 26, two sidewalls 292 one extending from the bottom aspect of each edge of brace plate 22*c* perpendicular thereto and in the same direction as base flange 24*f* and lip flange 26, a plurality of pre-drilled holes 32 extending in series along the upper aspect of brace plate 22*c*, the outside edges lip flange 26, and the length of base flange 24*f*, and a plurality of access cutouts 34 formed within lip flange 26 permitting access to the pre-drilled holes formed in base flange 24*f*.

Connector sidewalls 292 demonstrate a generally trihedral configuration with curved outside edge and an upper aspect that tapers outwards relative to the connector center. Connector 290 also exhibits two notches 36*n* (visible in FIG. 111 but not FIG. 110) formed along the edge of brace plate 22*c* at a point immediately above where the top of sidewalls 292 and immediately below where lip flange 26 extend out from brace plate 22*c*. Notches 36*n* are analogous to and serve the same function as grooves 36 found in many of the stud connectors of the present invention, to wit, to receive and secure the outside edges of lips 16 of stud member 10.

Figure 112:
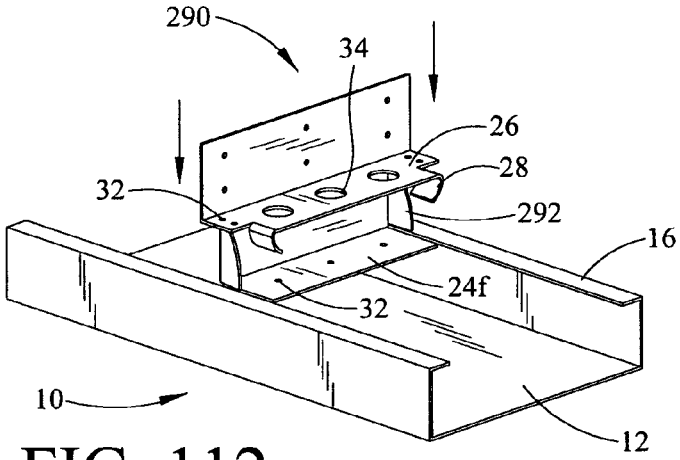
FIG. 112 illustrates in perspective view the manner of inserting the press-in right angle track/stud connector into a framing stud.

FIG. 112 illustrates the manner of insertion of right angle track/stud connector 290 into a stud member 10. Connector 290 is inserted straight downwards into member 10 until base flange 24*f* lies adjacent to and on top of the inside surface of base 12 of member 10. During insertion, the upper aspect of sidewalls 292, which taper away from the connector center, contact and push outwards against the inner edge of lips 16 of member 10 until connector 290 is fully inserted. At this point connecter 290 is locked within member 10 by the sandwiching of lips 16 between the top of sidewall 292 and the outside aspect of locking clips 28 and the outside edges of lips 16 encircled by notches 36*n* (shown in FIG.

111). Once locked into position, track/stud connector 290 can be easily and safely secured to member 10 by applying screws through pre-drilled holes 32 formed in the edges of lip flange 26 and in base flange 24*f* accessed through access cutouts 34.

Figure 113:
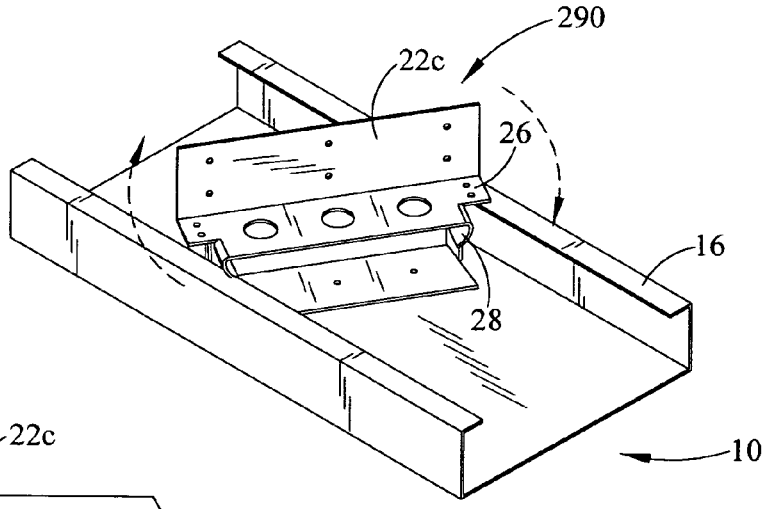
FIG. 113 illustrates in perspective view the manner of removing the press-in right angle track/stud connector from a framing stud.

The manner of removal of right angle track/stud connector 290 from member 10 is illustrated in FIG. 113. As described with respect to FIG. 112, connector 290 locks in position within member 10 through the sandwiching of lips 16 between lip flange 26 and locking clips 28 and with its edges accommodated within notches 36*n*. Removal of connector 290 is achieved by bending back on the top of brace plate 22*c* of connector 290 and rotating connector 290 until connector 290 unlocks and can be lifted directly upwards.

Figure 114:
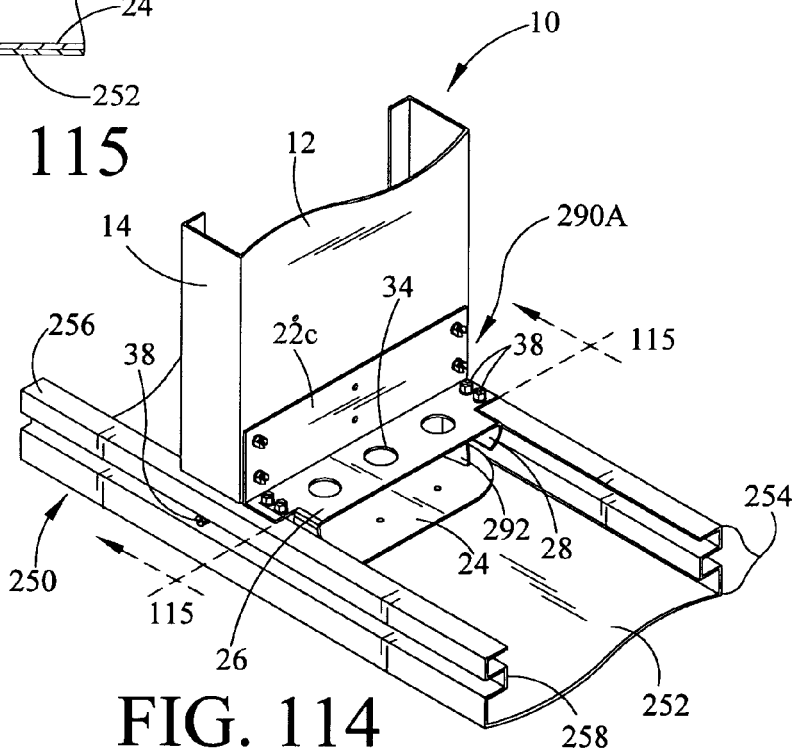
FIG. 114 is a perspective view of a snap-in right angle track/stud connector interconnecting the smooth-faced framing track of FIG. 97 and a framing stud.

A snap-in universal right angle track/stud connector 290A is shown in FIG. 114 interconnecting smooth-faced framing track 250 with framing member 10. Snap-in track/stud connector 290A is identical to press-in track/stud connector 290 except that connector 290A demonstrates a wider base flange 24 which extends out beyond the edges of the narrowed bottom aspect of brace plate 22*c*. Although base flange 24 is shown radius cut, a base flange exhibiting square cut outside corners is equally useful.

Snap-in track/stud connector 290A is inserted into the framing track 250 in the same manner as the snap-in stud connectors earlier described, by twisting and bending the top of connector 290A forward relative to track 250, until base flange 24 lies atop the inside surface of the track base 252 of track 250 and track lips 256 are sandwiched between lip flange 26 and locking clips 28. Self tapping screws 38 are inserted from the top through the pre-drilled holes formed along the edges of lip flange 26 into track lips 256 of track 250, from the top through base flange 24 into track base 252 utilizing access cutouts 34, and from the sides through recess channels 258 formed in track sidewalls 254 into sidewalls 292 of track/stud connector 290A.

Stud member 10 is then positioned behind connector 290A such that the bottom of base 12 of member 10 lies adjacent to the back of brace plate 22*c* of connector 290A, and is secured to connector 290A through the application of self-tapping screws 38 applied through brace plate 22*c* into base 12 of member 10. Stud member 10 can instead be secured with its lips abutting the back of brace plate 22*c*. As illustrated, track 250 is interconnected to member 10 in three dimensions through fasteners applied through recess channels 258 in track 250 into sidewalls 292 of connector 290A, while leaving the sidewalls 254 of track 250 and sidewalls 14 of member 10 smooth and free of fastener heads or other protrusions.

While track/stud connector 290A is shown in FIG. 114 as interconnecting track 250 to member 10, track/stud connectors 290 and 290A can also be used to interconnect two framing tracks 250, 250A or 250B or two stud members 10, or any combination thereof.

Figure 115:
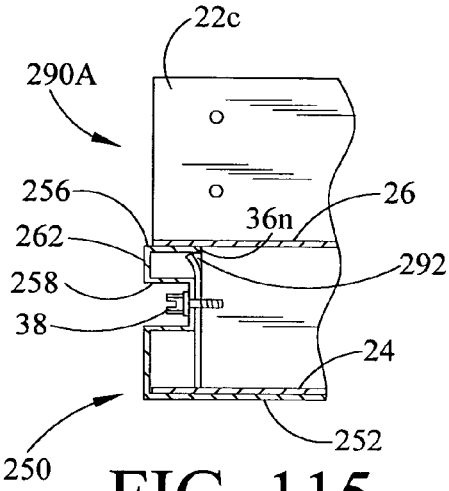
FIG. 115 is a cross-sectional view taken along line 115 of FIG. 114 illustrating in close-up the manner of interaction between the snap-in right angle track/stud connector of FIG. 114 and a framing track.

The manner of interaction between sidewalls 292, notches 36*n*, and lip flange 26 of connector 290A with track lips 256 and recess channel 258 of track 250 is illustrated in close up in FIG. 115, a cross section taken along line 115 of FIG. 114. Base flange 24 of connector 290A lies adjacent to and on top of base 252 of track 250. The edge of lip flange 26 of connector 290A lies adjacent to and on top of lip track 256 of track 250. One sidewall 292 of connector 290A is vertical along its bottom two-thirds and then tapers outwards, away from the connector center, along its top one-third such that it pushes outward against lip 256 of track 250 while being inserted. Once fully inserted, lip 256 of track 250 is locked between the top of sidewall 292 and the bottom of lip flange 26 with its outside edge within notch 36*n*. The raised aspect of recess channel 258 abuts against the straight portion of sidewall 292 and self-tapping screw 38 secures connector 290A within track 250 through recess channel 258 and the straight portion of sidewall 292.

As will be appreciated, right angle track/stud connectors 290 and 290A, having sidewalls 292, and brace plate 22*c* that demonstrates a narrowed bottom, can be used equally with prior art framing stud member 10 to interconnect framing members in two dimensions, or with the smooth-faced framing tracks of the present invention to interconnect framing members in three dimensions. Connectors 290 and 290A are easily inserted and removed from within the stud members and tracks, and lock within the stud members and tracks to facilitate their safe and efficient installation and interconnection.

Summary and Scope

Accordingly, it will be appreciated that the system, tracks and connectors of the present invention facilitate the interconnection of metal stud framing in a manner never before encountered in the construction industry.

The novel system, tracks and connectors described above provide for efficient construction of metal framed structures that exhibit precise dimensions and continuous, smooth outside surfaces. The improved precision in the framed dimensions coupled with the continuous and smooth outside frame surfaces, free of fastener heads or interruptions of other sort, allow for the application of wall coverings faster, less expensively and with better results, compared with metal framing presently encountered in the building industry. Given the time and expense involved in covering framing inside and out, considerable savings can be enjoyed by employing the system, tracks and connectors of the subject invention.

Because the connectors of the present invention, or most of them, interlock with framing members, they can be applied more easily and with less risk, than non-locking connectors presently in use. Because the stud connectors are screwed from the inside out, rather than from the outside in, the connectors of the present invention can be installed while working entirely from within a building.

The connectors of present invention, being configured to secure framing members in at least two dimensions, and including structural elements that serve to interlock with and reinforce the framing members, promote interconnections which are stronger and more durable than interconnections obtained either by presently available connectors or by screwing traditional wall tracks directly into wall studs without the use of connectors.

The novel tracks of the present invention allow for the interconnection of framing members in three dimensions, still leaving the surface aspects of the frame continuous, smooth and free of fastener heads or other protrusions. These novel tracks with their counterpart connectors promote stronger and more durable framing than is possible using presently available interconnection methods.

The system, tracks and connectors of the present invention enable an entire structure to be framed using one size and style of easily obtainable and well understood U-channel metal framing and/or one size and style of track. With the connectors of the present invention, one size and style of metal framing and/or track can be used to form all types of framing components, floor and ceiling joists, wall studs, window sills, door headers, roof ridges, rafters, trusses, fascia, and the like. Because the connectors come equipped with all components required to position and secure the metal studs and tracks, the framing members, whether track or stud members, do not have to be specially manufactured, slotted, tabbed or pre-cut. Rather the metal studs and/or tracks may be cut on-site to the necessary lengths, resulting in substantial savings on the costs of both materials and labor.

In that the connectors, studs, and tracks of the subject invention are highly universal in regard to the construction industry, the connectors can be fabricated to accommodate any pitch on a roof, from a rafter, to a jack rafter, to a fascia, walls, window sills, headers, and any configuration used in or useful to residential and commercial framing. Due to the close structural relationship between the prior art framing studs and the novel tracks of the present invention, the connectors of the present invention support the interconnection of metal stud to stud, track to track, or track to a stud, at any angle as may be required to accommodate the building design. The novel connectors facilitate the joinder of studs in a way never seen previously in the construction industry and promote stronger, easier to build, and more precise metal framed structures. Accordingly, the connectors of this invention should be considered connecting framing components other than those shown, and should also be considered connecting framing at angles other than the angles depicted in the illustrations.

By way of example only and not by way of limitation, it will be appreciated by those skilled in the relevant arts that the right angle stud connectors described and depicted can be easily modified to connect framing members at angles other than ninety degrees without departing from the spirit and scope of the invention. Most of the connectors can also be modified to interconnect framing members at compound angles one to the other. The large variety of framing components and framing angles that are commonly encountered in the construction of residential and commercial structures should not be used to limit in any way the scope or usefulness of the disclosed invention. All such variations and alternative uses should be considered to be within the purview and scope of the present invention as defined in the claims and their legal equivalents.

Also within the scope of the present invention are the use of the novel connectors to interconnect framing studs or tracks in all possible orientations one to the other. As has been illustrated, connector brace plates 22 can be secured alternatively to lips 16 of the second stud member or track, to the inside of base 12 of the second stud member or track, or to the outside of base 12 of the second stud member or track, with either the front or the back face of brace plate 22 lying adjacent to the second framing member. All such varieties of orientations can be used in the framing process and all are within the purview of the subject invention.

The close structural relationship between the various novel connectors of the subject invention and their analogous components should be appreciated and can be exploited to further enhance the advantages of the invention. For example, each of the connectors depicted as having base flanges with radius cut corners can be fabricated instead to exhibit right angle corners, and each of the connectors depicted as having base flanges exhibiting right angle corners can also be fabricated to demonstrate radius cut corners. Each of the connectors that have been described and depicted as having locking clips 28 or support tabs 30 can be manufactured without these elements, and many of the connectors that have been described and depicted without locking clips 28 and support tabs 30 can, instead, be made to include these additional elements. In like manner slots 72, formed in brace plate 22*d* of connector 70 (shown in FIG. 44), can equally be formed in the brace plates 22 of most of the other stud and track connectors of the present invention. It will also be appreciated that the height of the brace plates 22 and the depth of the base flanges 24 can be varied to obtain advantages in efficiency or strength, and that support tabs 30, connector walls 52, sidewall and sidewall flanges 262, 264 and 292, and base flanges 24 can be attached to project, alternatively, forward or rearward, without departing from the spirit or scope of the instant invention.

Exploiting the universal character of the stud and tracks and the close structural relationship between the connectors of the present invention, connectors can be modified on site to provide for a wider variety of uses and functions. Stud connectors can be modified to function as track connectors, connector brace plates can be bent to receive jack rafters and other framing members that join at angles other than 90 degrees, forward projecting tabs, sidewalls and base flanges can be bent to project rearward and vise-versa, and support tabs, sidewalls and locking clips supplied with connectors can be snipped off on-site. Modifying connectors on site permits a smaller variety of connectors to be supplied in the first instance, saving contractors and their clients time and money.

Whereas the connectors have been described and illustrated as being constructed by folding from a single piece of stamped sheet metal, connectors having the same or equivalent form but fabricated by welding or from molds, and from suitable materials other than sheet metal, are equally within the scope and spirit of the instant invention. Connectors can also be fabricated to demonstrate corrugations, crimps or longitudinal indents along the length of the brace plates and flanges for increased rigidity and strength.

Although it is contemplated that the tracks, connectors and system of the present invention will be employed for stick framing on the job site, the tracks, connectors and system can also be used to prefabricate walls, roof trusses, floors and other framed structural components off-site and at any location.

Also, whereas the system, tracks and connectors of the subject invention have been described as fulfilling stated needs, it will be appreciated by those skilled in the art that these connectors can also serve other important objects of the building industry. By way of example only, many of the connectors described above also function as fire-stops by occluding the opening in the U-channel framing member which might otherwise act as chimneys in the context of a fire.

Moreover, it should be understood that, while the connectors and tracks of the subject invention have been designed and described to leave the surfaces of the framed structure smooth and fastener free, where a smooth surface is not needed, the connectors can be secured within the framing members and tracks, and can be secured to interconnect framing members and tracks, by applying screws from outside smooth surfaces inward. That not all the advantages of the tracks, connectors and system of the subject invention are exploited in every instance does not limit the usefulness of novel tracks and connectors in their other respects. It will be appreciated that the various advantages provided by the novel tracks and connectors of the subject invention can be combined in different ways, sometimes to promote smooth surfaces, other times for joint strength, and still other times for ease of framing or to minimize expense, depending upon the precise needs of the job in question, but each time providing distinct advantages over presently available metal framing methodologies and connectors.

Accordingly, the scope of the invention should be determined by the appended claims and their legal equivalents rather than with reference to any particular example, embodiment or illustration.

The invention claimed is:

1. A method for interconnecting a metal framing member with another member in a manner that leaves the framing member sidewalls free of fasteners, said metal framing member having a U-channel configuration formed by a base extending in a longitudinal direction and having a given inside base width, sidewalls on each lateral side of the width of the base extending upright in a perpendicular direction a given sidewall height from the base, and lips that extend laterally inward from the tops of the sidewalls, said method comprising the steps of:

(a) providing a connector having:

(i) a connector body extending in the upright direction having a body width that corresponds to the inside width of the base of said framing member and having a body height that corresponds to the inside height of the sidewalls of said framing member;

(ii) a base flange having a base width that corresponds to the body width of the connector body extending in the longitudinal direction perpendicularly from the bottom of the connector body; and (iii) a lip flange having a lip width that corresponds to the body width of the connector body extending in the longitudinal direction perpendicularly from the top of the connector body;

(b) positioning said connector within said metal framing member, by either twisting said connector directly from above or sliding said connector in from an available end of said metal framing member, such that the base flange of said connector lies atop the base of said metal framing member, the lateral aspects of the lip flange of said connector are in abutting contact with the underside of the lips of said framing member, and the connector body is flush with an available end of said framing member, thereby forming a three-dimensional tight fit of said connector within the U-channel configuration of said metal framing member;

(c) securing said connector to said metal framing member by fasteners applied through the lips of said framing member into the lateral aspects of said lip flange and/or through the base of said framing member into the base flange; and (d) securing the connector body extending outwardly from the end of said metal framing member to another member by fasteners applied therethrough into said other member.

2. The method of claim 1 wherein the lateral sides of the connector body are formed with connector wall portions extending in the longitudinal direction in parallel with the sidewalls of said framing member for forming a tight fit in abutting contact with said sidewalls.

3. The method of claim 1 wherein said lip flange is not continuous and instead comprises a pair of flange tabs one extending out from each side of said connector body.

4. The method of claim 1 wherein each sidewall of said metal track member has at least one recessed channel running along its length in the longitudinal direction and said connector body demonstrates cutouts along its sides to accommodate the recessed channels of said track member.

5. The method of claim 4 wherein the lateral sides of the connector body are formed with connector wall portions extending in the longitudinal direction in parallel with the sidewalls and recessed channels of said framing member for forming a tight fit in abutting contact with said sidewalls and recessed channels, and wherein the connector can be additionally secured to said metal track member by fasteners applied through the recessed channels into the corresponding recessed aspect of said wall portions.

6. The method of claim 4 wherein said lip flange is not continuous and instead comprises a pair of flange tabs one extending out from each side of said connector body.

7. A combination connector and metal framing member for interconnecting metal framing members in a manner that leaves the framing member sidewalls free of fasteners, said metal framing member having a U-channel configuration formed by a base extending in a longitudinal direction and having a given inside base width, sidewalls on each lateral side of the width of the base extending upright in a perpendicular direction a given sidewall height from the base, and lips that extend laterally inward from the tops of the sidewalls, and said connector comprising:

(a) a connector body extending in the upright direction having a body width that corresponds to the inside width of the base of said framing member and having a body height that corresponds to the inside height of the sidewalls of said framing member;

(b) a base flange having a base width that corresponds to the body width of the connector body extending in the longitudinal direction perpendicularly from the bottom of the connector body; and (c) a lip flange having a lip width that corresponds to the body width of the connector body extending in the longitudinal direction perpendicularly from the top of the connector body;

wherein said connector is adapted to be positioning within the metal framing member, by either twisting said connector directly from above or sliding said connector in from an available end of said metal framing member, such that the base flange of said connector lies atop the base of said metal framing member, the lateral aspects of the lip flange of said connector are in abutting contact with the underside of the lips of said framing member, and the connector body is flush with an available end of said framing member, thereby forming a three-dimensional tight fit of said connector within the U-channel configuration of said metal framing member, and wherein said connector is secured to said metal framing member by fasteners applied through the lips of the metal framing member into the lateral aspects of the lip flange and/or through the base of said framing member into the base flange.

8. The combination connector and metal framing member of claim 7 wherein the lateral sides of the connector body are formed with connector wall portions extending in the longitudinal direction in parallel with the sidewalls of said framing member for forming a tight fit in abutting contact with said sidewalls.

9. The combination connector and metal framing member of claim 7 wherein said lip flange is not continuous and instead comprises a pair of flange tabs one extending out from each side of said connector body.

10. The combination connector and metal framing member of claim 7 wherein said connector is formed by bending a single piece of stamped sheet metal.

11. The combination connector and metal framing member of claim 7 wherein said base and lip flanges extend in parallel out from said connector body at angles other than ninety degrees allowing another member to be connected to the metal framing member at different angles.

12. The combination connector and metal framing member of claim 8 wherein said connector wall portions extend in parallel out from the said connector body at angles other than ninety degrees allowing another member to be connected to the metal framing member at different angles.

13. The combination connector and metal framing member of claim 12 wherein said base and lip flanges also extend in parallel out from the said connector body at angles other than ninety degrees allowing another member to be connected to the metal framing member at compound angles.

14. The combination connector and metal framing member of claim 7 wherein said connector body has a planar configuration on one upright side thereof and is drilled with pre-drilled holes for fastening by fasteners to a planar side of another member at an end of said first framing member so as to form a T-connection with the other member.

15. A combination connector and metal framing member for interconnecting metal framing members with another in a manner that leaves the framing member sidewalls free of fasteners, said metal framing member having a U-channel configuration formed by a base extending in a longitudinal direction and having a given inside base width, sidewalls on each lateral side of the width of the base extending upright in a perpendicular direction a given sidewall height from the base and having at least one recessed channel running along its length in a longitudinal direction, and lips that extend laterally inward from the tops of the sidewalls, said connector comprising:

(a) connector body extending in the upright direction having a body width that corresponds to the inside width of the base of said framing member, having a body height that corresponds to the inside height of the sidewalls of said framing member and cutouts along its sides to accommodate the recessed channels of said track member;

(b) a base flange having a base width that corresponds to the body width of the connector body extending in the longitudinal direction perpendicularly from the bottom of the connector body; and (c) a lip flange having a lip width that corresponds to the body width of the connector body extending in the longitudinal direction perpendicularly from the top of the connector body;

wherein said connector is adapted to be positioning within the metal framing member, by either twisting said connector directly from above or sliding said connector in from an available end of said metal framing member, such that the base flange of said connector lies atop the base of said metal framing member, the lateral aspects of the lip flange of said connector are in abutting contact with the underside of the lips of said framing member, and the connector body is flush with an available end of said framing member, thereby forming a three-dimensional tight fit of said connector within the U-channel configuration of said metal framing member, and wherein said connector is secured to said metal framing member by fasteners applied through the lips of the metal framing member into the lateral aspects of the lip flange and/or through the base of said framing member into the base flange.

16. The combination connector and metal framing member of claim 15 wherein the lateral sides of the connector body are formed with connector wall portions extending in the longitudinal direction in parallel with the sidewalls and recessed channels of said framing member for forming a tight fit in abutting contact with said sidewalls and recessed channels, and wherein the connector can be additionally secured to said metal track member by fasteners applied through the recessed channels into the corresponding recessed aspect of said wall portions.

17. The combination connector and metal framing member of claim 16 wherein said connector wall portions extend in parallel out from the said connector body at angles other than ninety degrees and said base and lip flanges also extend in parallel out from the connector body at angles other than ninety degrees allowing another member to be connected to the metal track member at compound angles.

18. The combination connector and metal framing member of claim 15 wherein said lip flange is not continuous and instead comprises a pair of flange tabs one extending out from each side of said connector body.

19. The combination connector and metal framing member of claim 15 wherein said connector is formed by bending a single of stamped sheet metal.

20. The combination connector and metal framing member of claim 15 wherein said connector body has a planar configuration on one upright side thereof and is drilled with pre-drilled holes for fastening by fasteners to a planar side of another member at an end of said first track member so as to form a T-connection with the other member.

* * * * *